United States Patent [19]

Nishimura et al.

[11] Patent Number: 4,470,706

[45] Date of Patent: Sep. 11, 1984

[54] ANALOG TYPE OF ELECTRONIC TIMEPIECE

[75] Inventors: Katsuo Nishimura; Minoru Watanabe, both of Tokorozawa, Japan

[73] Assignee: Citizen Watch Company Limited, Tokyo, Japan

[21] Appl. No.: 361,226

[22] Filed: Mar. 24, 1982

[30] Foreign Application Priority Data

| | | | |
|---|---|---|---|
| Mar. 27, 1981 | [JP] | Japan | 56-44921 |
| Mar. 27, 1981 | [JP] | Japan | 56-44922 |
| Apr. 7, 1981 | [JP] | Japan | 56-52301 |
| Jun. 16, 1981 | [JP] | Japan | 56-91501 |
| Jun. 16, 1981 | [JP] | Japan | 56-95122 |
| Jun. 26, 1981 | [JP] | Japan | 56-99148 |
| Jul. 24, 1981 | [JP] | Japan | 56-116065 |

[51] Int. Cl.[3] ..... G04B 23/02; G04B 19/04; G04C 21/16

[52] U.S. Cl. ..... 368/74; 368/80; 368/251

[58] Field of Search ..... 368/69–74, 368/76, 80, 155–157, 185, 187, 250, 251

[56] References Cited

U.S. PATENT DOCUMENTS

| | | | |
|---|---|---|---|
| 4,135,359 | 1/1979 | Yajima | 368/69 |
| 4,143,510 | 3/1979 | Sakuma | 368/202 |
| 4,205,519 | 6/1980 | Deruns | 368/73 |
| 4,223,523 | 9/1980 | Kamijo | 368/259 |
| 4,259,737 | 3/1981 | Berney | 368/76 |
| 4,266,288 | 5/1981 | Berney | 368/76 |
| 4,358,840 | 11/1982 | Ono et al. | 368/251 |

*Primary Examiner*—Vit W. Miska

*Attorney, Agent, or Firm*—Jordan and Hamburg

[57] ABSTRACT

In an analog type of electronic timepiece provided with an alarm function, means are provided whereby the timepiece hands are rapidly rotated into positions indicating a preset alarm time, when changeover from a normal operating mode to an alarm time mode is designated, and are rapidly rotated back to indicate current time when return to the normal operating mode is designated. Signals for controlling these rapid rotations of the hands are generated using only two counter circuits, for measuring and storing the difference between the alarm time and current time, and the system differs from prior art arrangements in that no errors are introduced into the time information during the intervals in which changeover between current time display and alarm time display takes place.

16 Claims, 54 Drawing Figures

DISPLAY DIFFERENCE COUNTER 12
TIME DIFFERENCE COUNTER 10
RESET COUNTER 14
ZERO DETECTION O/P (ALARM COINCIDENCE) 50
>3456 MAGNITUDE O/P 52
ZERO DETECTION O/P
MAGNITUDE DETECTION O/P (>863)
÷5
÷864
U
D
Q
C
B
L
S
42
44
46
48
54
56
58
16
18
20
22
24
26
28
30
32
34
36
38
40

Fig. 4A

| STATUS AND PROCESSING \ MODE CHANGEOVER | CHANGEOVER (A) FROM CURRENT TIME TO ALARM TIME DISPLAY, WITH RAPID FORWARD ROTATION | CHANGEOVER (B) FROM CURRENT TIME TO ALARM TIME DISPLAY, WITH RAPID REVERSE ROTATION |
|---|---|---|
| INITIAL STATUS | F=1 MC SC<br>720 −$t_1$<br>$t_1$ −360<br>MC=$t_1$−360<br>SC=0<br>F = 1<br>106<br>NT<br>$t_1$<br>107<br>AT | F=0 MC SC<br>$t_2$<br>MC=$t_2$<br>SC=0<br>F = 0<br>112<br>AT<br>$t_2$<br>NT<br>113 |
| PRE-PROCESSING | ——— | F=1 MC=0 SC<br>$t_2$<br>MC=$t_2$−360<br>=0<br>SC=360−$t_2$<br>104 |
| STATUS AFTER RAPID ROTATION | F=1 MC=0 SC<br>MC=($t_1$−360)→360<br>=0<br>720−$t_1$<br>SC=720−$t_1$<br>108<br>NT<br>$HD_{AT}$=$HD_{NT}$+720−$t_1$<br>AT 720−$t_1$ | F=0 MC SC=0<br>SC=(360−$t_2$)→360<br>=0<br>116<br>$t_2$<br>MC=$t_2$<br>AT<br>$t_2$<br>NT<br>$HD_{AT}$=$HD_{NT}$−$t_2$ |
| POST-PROCESSING | F=1 MC SC=0<br>720 −$t_1$<br>$t_1$ −360<br>SC=(720−$t_1$)→360<br>=0<br>MC=$t_1$−360<br>F = 1<br>110 | ——— |

Fig. 4B

| STATUS AND PROCESSING / MODE CHANGE-OVER | CHANGEOVER (C) FROM ALARM TIME TO CURRENT TIME DISPLAY, WITH RAPID FORWARD ROTATION | CHANGEOVER (D) FROM ALARM TIME TO CURRENT TIME, WITH RAPID REVERSE ROTATION |
|---|---|---|
| INITIAL STATUS | F=0 MC SC<br>$t_3$<br>MC = $t_3$<br>SC = 0<br>F = 0<br>118<br>NT<br>$t_3$<br>AT | F=1 MC SC<br>720<br>$t_4$<br>$t_4$<br>-360<br>MC = $t_4$ - 360<br>SC = 0<br>F = 1<br>124<br>NT<br>$t_4$<br>AT |
| PRE-PROCESSING | F=1 MC=0 SC<br>$t_3$<br>360-$t_3$<br>MC = $t_3$ → 360<br>= 0<br>SC = 360 − $t_3$<br>120 | — |
| STATUS AFTER RAPID ROTATION | F=0 MC SC=0<br>$t_3$<br>SC = (360 − $t_3$) → 360<br>= 0<br>MC = $t_3$<br>122<br>NT<br>$t_3$<br>$HD_{NT} = HD_{AT} + t_3$<br>AT | F=0 MC SC<br>720-$t_4$<br>MC = ($t_4$ − 360) → 360<br>= 0<br>720-$t_4$<br>SC = 720 − $t_4$<br>126<br>NT<br>$HD_{NT} = HD_{AT} - (720 - t_4)$<br>720 − $t_4$<br>AT |
| POST-PROCESSING | — | F=1 MC SC=0<br>720<br>-$t_4$<br>SC = (720 − $t_4$) → 360<br>= 0<br>MC = $t_4$ − 360<br>128 |

Fig. 5(B)-1
| STATUS AND PROCESSING / CURRENT TIME SETTING | CURRENT TIME SETTING (A) WITH FORWARD ROTATION | CURRENT TIME SETTING (B) WITH REVERSE ROTATION ($t_8 > t_8'$) |
|---|---|---|
| INITIAL STATUS | 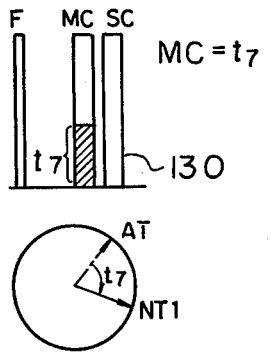  | 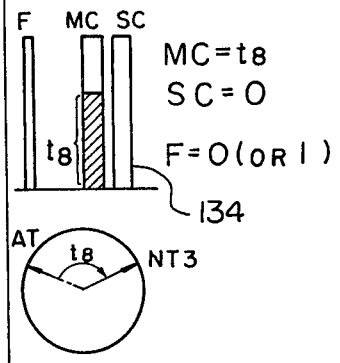  |
| STATUS AFTER SETTING | 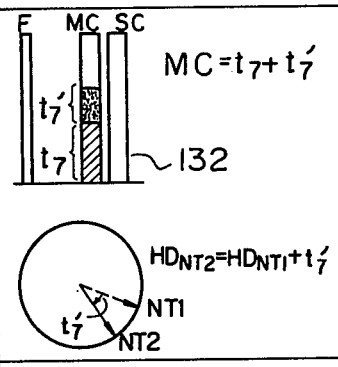  | 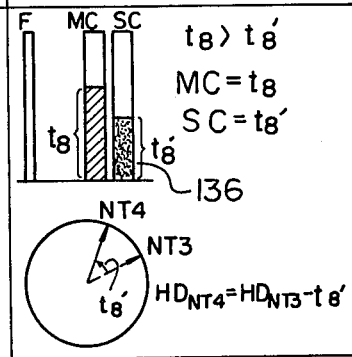  |
| POST-PROCESSING | — | 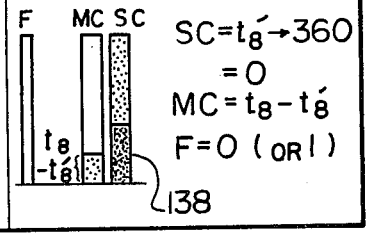  |

Fig. 6A

| STATUS AND PROCESSING / MODE CHANGE-OVER AND TIME SETTING | CURRENT TIME DISPLAY MODE (A) | CURRENT TIME SETTING (FORWARD ROTATION) (B) | CURRENT TIME SETTING (REVERSE ROTATION) (C) | ALARM TIME DISPLAY MODE (D) |
|---|---|---|---|---|
| PRE-PROCESSING | — | — | — | — |
| COUNTER STATUS AND HANDS MOVEMENT | MC SC 202 NT NT+1 MC (+1) HD (+1) | — | — | MC SC 204 AT MC (+1) |
| POST-PROCESSING | — | — | — | — |

Fig. 6 B

| STATUS AND PROCESSING / MODE CHANGE-OVER AND TIME SETTING | ALARM TIME SETTING (FORWARD ROTATION) (E) | ALARM TIME SETTING (REVERSE ROTATION) (F) | CURRENT TO ALARM DISPLAY CHANGEOVER (FORWARD ROTATION)(G) |
|---|---|---|---|
| PRE-PROCESSING | — | — | — |
| COUNTER STATUS AND HANDS MOVEMENT | MC SC 206 AT1 AT2 MC (+1) | MC SC 210 AT4 AT3 MC (+1) | MC SC 212 NT AT3 MC (+1) HD (+1) |
| POST-PROCESSING | MC SC 208 AT2 MC (+1) | — | MC SC 214 AT MC (+1) |

Fig. 6 C

| STATUS AND PROCESSING / MODE CHANGE-OVER AND TIME SETTING | CURRENT TO ALARM DISPLAY (REVERSE ROTATION) (H) | ALARM TO CURRENT DISPLAY (FORWARD ROTATION) (I) | ALARM TO CURRENT DISPLAY (REVERSE ROTATION) (J) |
|---|---|---|---|
| PRE-PROCESSING | MC SC 226 NT NT+1 MC +1 HD +1 | MC SC 220 NT AT MC +1 | — |
| COUNTER STATUS AND HANDS MOVEMENT | MC SC 218 AT NT MC +1 | MC SC NT+1 222 NT AT MC +1 HD +1 | MC SC 224 NT NT+1 AT 225 MC +1 |
| POST-PROCESSING | — | — | MC SC 226 227 NT AT NT+1 MC +1 HD +1 |

OPERATION SELECTION CIRCUIT 252

φSII
φSII
φSIO
φSIO
φSI2a
φSI2b
φF
φF
φFF
φFF
φPC
φPC
264
266
268
φNM
φAM
φNB
φNF
φAB
φAF
φANB
φANF
φNAB
φNAF
φMCSC2
φINSA
φINSB

HANDS POSITION SENSING CIRCUIT 472

473
R
R
Q
Q
φ1
φ2
φ3
486
φ11
484
φ9
φ4
φ5
U
D
MAIN COUNTER CIRCUIT
R
S
474
480
φ7
479
478
477
φ6
S
Q17
R
482
φ8
TIMEKEEPING FUNCTION CIRCUIT 471
φ10
φ11
U
D
SECONDARY COUNTER CIRCUIT
R
S
φ12
476
φ13
φ14

ANALOG TYPE OF ELECTRONIC TIMEPIECE

BACKGROUND OF THE INVENTION

At present, large numbers of electronic timepieces are being manufactured, of various types and having various different functions. Digital and "combined analog-digital" timepieces are frequently provided with an alarm function, whereby the user can preset a desired time at which an alarm signal is to be generated. Such a function can be relatively easily and economically provided by using digital circuitry and a digital display device, for storing and displaying the preset alarm time. However in the case of an analog type of timepiece, i.e. a timepiece in which only time indicating hands are provided, it has not hitherto been practicable to provide an alarm function which can be set to a desired alarm time with a high degree of accuracy, such as is often available with relatively inexpensive digital timepieces. Various methods have been proposed and utilized to provide a relatively inaccurate alarm function in these analog electronic timepieces, for example by using an alarm time indicating hand or dial which is mechanically coupled to switch contacts. However such methods are not suited to high quality analog electronic timepieces. Another type of method which has been proposed for implementing an accurate alarm function in an analog electronic timepiece is to provide means whereby, when the user designates operation in an alarm time mode in which a preset alarm time is displayed, the timepiece hands are rapidly rotated through angles such that the alarm time is displayed. Subsequently, when the user designates return to the normal, i.e. current time display mode, then the hands are rotated into positions to display current time. However, as will be described hereinafter with reference to a specific example, prior art systems for implementing such an alarm function in an analog electronic timepiece present a number of serious disadvantages, including a possibility of errors being introduced into the current time information displayed by the timepiece, as a result of count errors occurring during the transitions between the alarm mode and the current time display mode. Such prior art systems also have the disadvantages of circuit complexity, whereby the size of timepiece integrated circuit chip is substantially increased, introducing design limitations, increased power consumption, and increased manufacturing cost. For these reasons, practical implementation of an alarm function of the type described above, utilizing a rapid advancement of the timepiece hands, has not yet been achieved.

With an alarm system for an analog electronic timepiece according to the present invention, the disadvantages of the prior art described above are eliminated. With an alarm system according to the present invention, the amount of circuitry required is substantially reduced by comparison with prior art proposals, as will be made clear in the specification, and introduction of time information errors during the transitions between current time display and alarm time display is completely eliminated. As a result, an alarm system for an analog electronic timepiece according to the present invention can be applied to practical manufacture of timepieces on a mass production basis, and enables the functional capabilities and hence the market appeal of such an analog electronic timepiece to be substantially increased.

Various other additional features can be provided with an analog electronic timepiece equipped with an alarm function according to the present invention as will be made clear by the description of the embodiments given hereinafter.

SUMMARY OF THE DISCLOSURE

The present invention relates to an analog electronic timepiece provided with an alarm function, whereby the user can freely designate either display of current time information or of a preset alarm time, and in which the timepiece hands are rapidly rotated into appropriate positions for indicating the time information designated by the user.

The alarm system in an analog electronic timepiece according to the present invention is based upon utilizing a pair of counter circuits, i.e. a main counter and a secondary counter, to memorize the relationships between the preset alarm time and current time, and to count a timekeeping signal to thereby register changes in that relationship as the current time elapses, with signals being generated as described hereinafter to rapidly drive the timepiece hands into new positions, upon changeover between the alarm time and the current time display modes, the latter signals being controlled in accordance with the contents of the main and secondary counter circuits at the time of changeover. It is an important and basic feature of the present invention that the relationship between the alarm time and current time can be continuously updated, in accordance with a timekeeping signal, while transitions from current time display to alarm time display, and vice versa, are occurring. As a result of this continuous updating, no errors can be introduced into the current time or alarm time display information during the latter transitions, and this marks a major point of difference between an alarm system for an analog electronic timepiece according to the present invention and prior art systems having similar objectives.

BRIEF DESCRIPTION OF THE DRAWINGS

In the attached drawings:

FIGS. 4, 5(A)-1, 5(A)-2, 5(B)-1 and 5(B)-2 are diagrams for graphically illustrating counting operations provided by a main counter circuit and secondary counter circuit in a timekeeping function circuit of an analog electronic timepiece provided with an alarm function according to the present invention, for the case of up-counter circuits being utilized, having a maximum count value equivalent to 6 hours;

FIGS. 6A–6C are diagrams for graphically illustrating an interrupt feature available with an analog electronic timepiece provided with an alarm function according to the present invention, whereby rapid advancement counting and hands rotation operations during mode changeover may be momentarily interrupted to permit updating of the timekeeping function circuit counter contents and hands position in response to a timekeeping signal;

DESCRIPTION OF THE PREFERRED EMBODIMENTS

Figure 1:
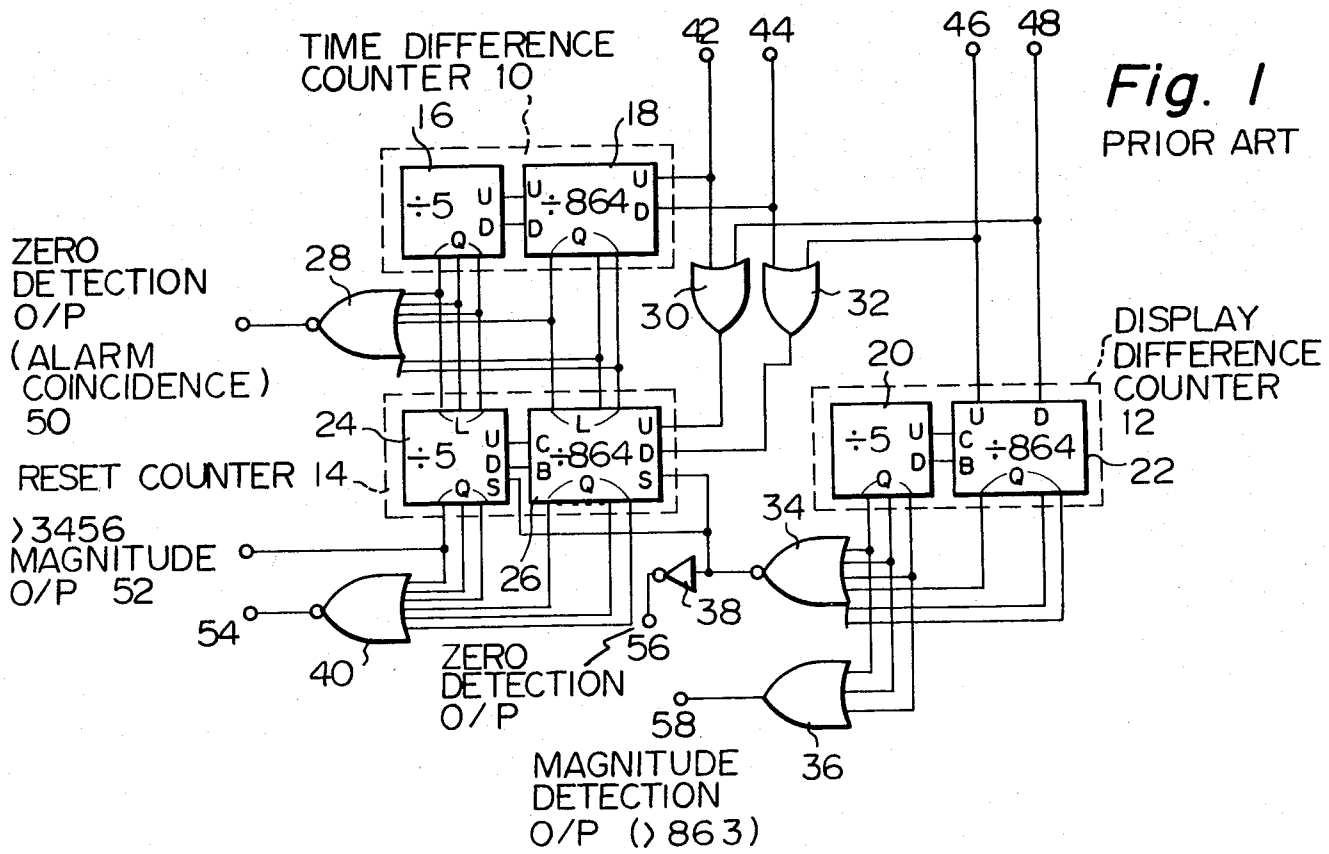
Fig. 1 PRIOR ART
FIG. 1 is a circuit diagram of a prior art example of a timekeeping function circuit for an analog electronic timepiece provided with an alarm function.

Before describing embodiments of the present invention, a prior art system for providing an alarm function in an analog electronic timepiece will be described, in order to point out the disadvantages of such a system which are overcome by the system according to the present invention. Such a prior art system is illustrated in FIG. 1, although for brevity of description only the basic portions of the system are shown in the drawing. Such a system has been proposed for an analog electronic timepiece employing a reversible stepping motor. It basically comprises three counter circuits, namely a time difference counter circuit 10, a display difference counter circuit 12, and a preset counter circuit 14. Each of these is an up-down counter circuit with a maximum count value of 4320. Time difference counter circuit 10 comprises two up-down counter circuits 16 and 18, having count factors of 5 and 864 respectively. Display difference counter circuit 12 comprises counter circuits 20 and 22, similarly having count factors of 5 and 864, while preset counter circuit 14 similarly comprises two counter circuits 24 and 26. The time difference counter circuit 10 serves to store a count value representing the difference between the current time and a preset alarm time. Since this continually decreases as current time passes, the contents are successively counted down by pulses of a time keeping signal applied at a rate of one pulse per 10 seconds, from a terminal 44 to the count down input of time difference counter circuit 10. Means are provided whereby, when the user actuates a switch to correct the displayed current time information, drive pulses at a relatively high frequency (hereinafter referred to as rapid advancement drive pulses) are applied to the timepiece stepping motor, such as to rotate the hands in the clockwise or counter clockwise direction. Synchronously with these rapid advancement drive pulses, pulses are input to either the count-up or count-down inputs of time difference counter circuit 10, depending upon the direction in which the hands are rotated during correction.

When the alarm time coincides with the current time, then the count in time difference counter circuit 10 reaches zero, and an output signal from a NOR gate 28 thereby sets a terminal 50 to the high logic level (referred to hereinafter as the H level). This output acts to initiate generation of an audible alarm signal.

The display difference counter circuit 12 contains a count value which represents the difference between the time which is being indicated by the timepiece hands and the current time. Thus when the timepiece is in the normal, i.e. current time display mode, the contents of display difference counter circuit 12 are zero. When the timepiece is in an alarm time display mode, then the contents of display difference counter circuit 12 represent the difference between the displayed alarm time and the current time.

A terminal 48 is coupled to the down-count input of display difference counter circuit 12 and also through an OR gate 30 to the up-count input of preset counter circuit 14. Similarly, a terminal 46 is coupled to the up-count input of display difference counter circuit 12 and through an OR gate 32 to the down-count input of preset counter circuit 14. When the contents of display difference counter circuit 12 are zero, this is indicated by the output from a NOR gate 34 coupled thereto being at the H level and the output of an inverter 38, connected to output terminal 56, being at the low level (hereinafter referred to as the L level). An output terminal 58 coupled to the output of an OR gate 36 is set to the H level if the value of the count in display difference counter circuit 12 is greater than 863, and otherwise is at the L level.

The output from NOR gate 34 is applied to the preset enable input S of preset counter circuit 14, so that the contents of time difference counter circuit 10 are preset into preset counter circuit 14 when the count in display difference counter circuit 12 becomes other than zero. The preset counter circuit 14 is connected such as to count up in response to pulses applied to the count-up input of time difference counter circuit 10 and pulses applied to the down-count input of display difference counter circuit 12, while preset counter circuit 14 is connected such as to count down in response to pulses applied to the down-count input of time difference counter circuit 10 and pulses applied to the up-count input of display difference counter circuit 12.

The operation of this circuit will now be described. In the current time display mode, the count value in time difference counter circuit 10 represents the difference between the preset alarm time and current time, the latter being displayed by the hands at that time. In addition, as explained above, the count in display difference counter circuit 12 will be zero, at this time. If now the user designates changeover to the alarm time display mode, by actuating a switch (not shown), pulses at a relatively high frequency (referred to hereinafter as rapid advance count pulses) are input on terminals 46 or 48 (depending upon the direction in which the timepiece hands are rotated during this changeover), while in synchronism with these rapid advance count pulses, rapid advancement drive pulses are applied to the stepping motor to rotate the hands. The contents of display difference counter circuit 12 thereupon become other than zero, whereupon the output signal from NOR gate 34 acts to preset the count value in time difference counter circuit 10 into preset counter circuit 14. At this time, the rapid advance count pulses applied to display difference counter circuit 12 are also being input to preset counter circuit 14, such that if display difference counter circuit 12 is counting up, then preset counter circuit 14 will be counting down (or vice versa). When the contents of preset counter circuit 14 reach zero, indicating that the time displayed by the hands is identical to the preset alarm time, then the resultant output signal from terminal 54 is used to terminate generation of the rapid advancement drive pulses and rapid advance count pulses, thereby halting rotation of the hands.

In this condition, the count value in display difference counter circuit 12 represents the difference between the alarm time and current time at the moment when changeover from the current time to the alarm time display mode was initiated, or, in other words, the difference between the time now being indicated by the hands and the current time at the moment of changeover. Subsequently, the timekeeping signal is input both to time difference counter circuit 10 and to display difference counter circuit 12, such as to maintain the correct value of count in display difference counter circuit 12 with respect to the actual current time.

At this time, if it is desired to modify the preset alarm time, the user performs switch actuations whereby drive pulses are generated to rotate the hands in the clockwise or counterclockwise direction. Corresponding pulses are input on terminals 42 or 44 respectively, to increase or decrease the contents of time difference counter circuit 10, and simultaneously on terminal 46 or 48 to accordingly modify the contents of display difference counter circuit 12.

To return from the alarm time display to the current time display mode, the user actuates a switch, whereby rapid advance count pulses are input to display difference counter circuit 12 and rapid advancement drive pulses are applied simultaneously, in synchronism with the rapid advance count pulses, to the timepiece motor. The timepiece hands are thereby rotated in the clockwise or clockwise direction (in accordance with whether rapid advance count pulses are input on terminal 46 or 48 to display difference counter circuit 12). When the count in display difference counter circuit 12 reaches zero, then the zero detection output from terminal 56 returns to the H level, and as a result of this, further application of rapid advance count pulses and rapid advancement drive pulses is terminated. The hands have now been rotated back through an amount equivalent to the previous contents of display difference counter circuit 12, i.e. an amount representing the difference between the time indicated by the hands and the actual current time, in the alarm time display condition.

Figure 2:
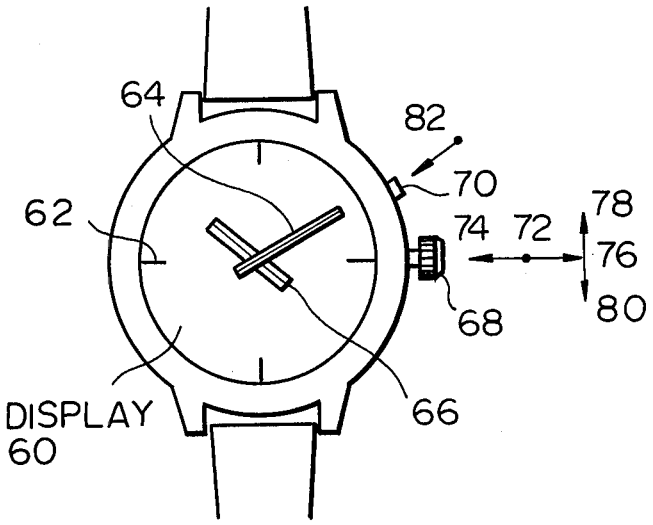
FIG. 2 is a plan view of an embodiment of an analog electronic timepiece provided with an alarm function according to the present invention.

This prior art system has some basic disadvantages. Firstly, it is necessary to use three up-down counter circuits. Thus, the size of the timepiece integrated circuit must be increased because of this additional circuitry, and this larger size of IC chip will present limitations upon the freedom of design of such an analog electronic timepiece. Secondly, while changeover between the alarm time and current time display modes is taking place, timekeeping errors can be introduced whereby the displayed current time and alarm time information may become incorrect. For example, during changeover from the alarm time display mode back to the current time display mode, with rapid advance count pulses being input to display difference counter circuit 12 and rapid advancement drive pulses being simultaneously applied to the stepping motor, the timekeeping signal is not being input to display difference counter circuit 12. Thus, while this changeover is taking place, one or more timekeeping signal pulses may be input to time difference counter circuit 10, thereby altering the count held therein. The amount by which the timepiece hands are rotated in order to return to the current time display will therefore be incorrect, since it will be based upon a count value representing the previous difference between the hands position and current time, held in display difference counter circuit 12, which will be incorrect by the time rotation of the hands is terminated. In a similar way, an error may be introduced into the alarm time indicated by the hands when changeover from the current time to the alarm time display mode is performed. FIG. 2 is a plan view of an embodiment of an analog electronic timepiece provided with an alarm system according to the present invention. Reference numeral 60 denotes an analog display mechanism comprising a dial plate 62, a minutes hand 64 and an hours hand 66. The timepiece is provided with external operating members, comprising a crown 68 and a pushbutton 82. Crown 68 is coupled to a plurality of switches, as described hereinafter, for performing several functions. To perform these functions, crown 68 can be pushed inward from a normal stationary position 72 to an inward position 74, or can be pulled out from position 72 to an outward position 76. While pulled out to position 76, crown 72 can be rotated in a clockwise direction 78 (referred to herein as the forward direction) or in a counterclockwise direction 80 (referred to herein as the reverse direction). Pushbutton 82 is actuated by being pushed inward to position 82.

Figure 3:
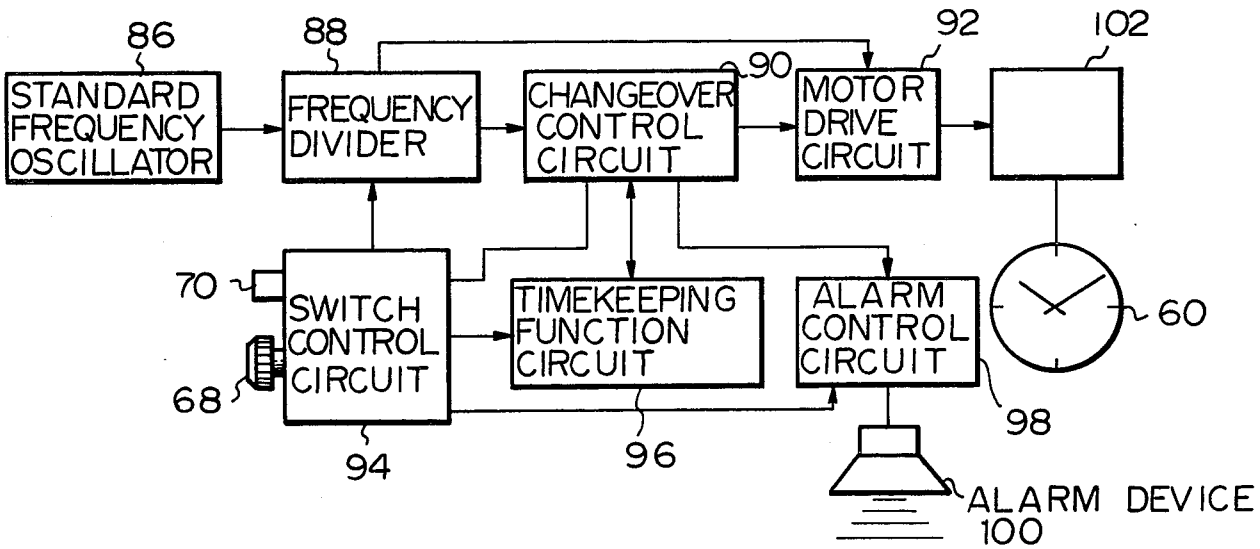
FIG. 3 is a simplified block circuit diagram of the embodiment of FIG. 2.

FIG. 3 is a general block circuit diagram of the embodiment of FIG. 1. The comprises a standard frequency oscillator circuit 86, controlled by a miniature quartz crystal vibrator, which produces a standard frequency time signal, of e.g. 32 kHz or 4 kHz. This signal is frequency divided by a frequency divider circuit 88, to produce a timekeeping signal comprising a pulse train having a period for example of 1 minute, and to produce various clock timing signals which are omitted from the diagram. The timekeeping signal is transferred by a changeover control circuit 90 to a motor drive circuit 92, which performs waveform shaping of this signal to produce suitable drive pulses to periodically drive a reversible stepping motor 102. Motor 102 drives analog display mechanism 60, to rotate hands 64 and 66, Numeral 96 denotes a timekeeping function circuit, which includes a main counter circuit and a secondary counter circuit as described hereinafter, and which responds to signals applied from crown 68 or pushbutton 70 transferred by a switch control circuit 94, with timekeeping function circuit 96 being controlled by signals from changeover control circuit 90 and timing signals from frequency divider circuit 88. Information representing a preset alarm time can be stored in timekeeping function circuit 96, by actuations of operating members 68 and 70, and this circuit also acts to detect coincidence between the current time and this preset alarm time, whereby signals are generated to activate an alarm drive circuit 98 to generate signals to drive an alarm device 100, for thereby producing an audible alarm signal.

When changeover is designated from a display of current time to a display of alarm time (or vice versa) on analog display section 60, then signals are generated by timekeeping function circuit 96 whereby rapid advancement drive pulses are applied to motor 102, to thereby drive hands 64 and 66 to indicate the desired time information. This operation is based upon the main counter circuit and secondary counter circuit of timekeeping function circuit 96, which is a basic and important feature of the present invention.

Before describing the configuration of this embodiment in greater detail, the manner in which the contents of the main counter circuit and secondary counter circuit in timekeeping function circuit 96 are utilized to control the timepiece operation during changeover between the current time and alarm time display modes and during correction of current time information or setting in of alarm time information will be explained, in graphical form, referring first to FIG. 4. For the purpose of explanation, it will be assumed that the minutes hand 64 is advanced once per minute, in the current time display mode. FIG. 4 illustrates how the main counter circuit and secondary counter circuit contents are controlled and utilized during four different types of changeover between the current time and alarm time display modes, each type of changeover being illustrated by one of the four columns "Changeover (A)" to "Changeover (D)". The diagram is further divided into four rows, designated as "Initial status", "Pre-processing", "Status after rapid rotation" and "Post-processing". In this embodiment, timekeeping function circuit 96 also includes a flag circuit, whose output goes to the H level each time the contents of the main counter circuit hereinafter abbreviated to MC circuit) reach a count of 360, and whose output goes to the L level each time the contents of the secondary counter circuit (hereinafter abbreviated to SC circuit) reach a count of 360, while the MC and SC circuits are each up-counter circuits. In FIG. 4, the "Initial status" row illustrates the contents of the MC circuit and the SC circuit for each type of changeover (A) to (D), prior to changeover being initiated, and also shows the status of the flag circuit. In the drawings, "F=1" indicates that the flag output is at the H level, while "F=0" indicates that the flag output is at the L level. The graphs in the upper part of each row, e.g. as denoted by numeral 106, show the contents of the MC circuit and the SC circuit, and the flag status, for the time display condition shown in the diagram immediately below, e.g. as denoted by numeral 107. Each of the latter diagrams only shows the position of hours hand 66, for simplicity of description.

In the normal, i.e. current time display mode of the timepiece, the contents of the MC circuit are incremented by a count of one, once per minute, while the count in the SC circuit is held at zero. The maximum count of the MC circuit and the SC circuit is 360, i.e. corresponding to 6 hours, and when a count of 360 is attained in either the MC circuit or SC circuit then the contents of that counter are reset to zero and the state of the flag output F is inverted. In order to initiate changeover from the current time to the alarm time display mode, the user presses crown switch 68 inward to position 74. For the example of changeover (A) in FIG. 4, i.e. changeover from the current time to the alarm time display mode, it is assumed that the initial status of the timepiece is such that a current time of 1:00 is being displayed, and that there is a preset alarm time of 5:00 (5 hours). In this case, the difference between the current time and alarm time is expressed in terms of a time value t1, (in this example equal to 8 hours, or 480 minutes). With this relationship between the current time and alarm time, changeover is most rapidly achieved by rotating the hands in the forward (i.e. clockwise) direction. For this condition, the contents of the MC circuit will be equal to (t1−360), the contents of the SC circuit zero, and the flag bit is at the L level, as shown by graph 106. The count value (t1−360) in the MC circuit, attained through input of a timekeeping signal once per minute, is indicated by a cross-hatched area, while the remaining count capacity of the MC circuit and SC circuit is indicated by the blank regions of the graph. Thus, the remaining capacity of the MC circuit, which is (720−t1) in this example, represents the time which must elapse before the current time will coincide with the alarm time (i.e. 4 hours, in this example). When changeover from the current time to alarm time display mode is designated, then rapid advance count pulses, at a rate of 64 Hz, are input to the MC circuit and SC circuit simultaneously, and also are simultaneously applied as rapid advancement drive pulses to stepping motor 102, such as to rotate hands 64 and 67 in the forward direction. These pulses continue until the count in the MC circuit reaches zero, and are thereupon terminated. It will be apparent that a number of rapid advance count pulses equivalent to a time (720−t1), i.e. in this example 4 hours, will then have been applied to rotate the hands (each of these rapid advance count pulses advancing the displayed time by one minute). The status of the MC circuit and SC circuit will now be as indicated by graph 108, with the count quantities which have been input to each counter by the rapid advance count pulses simultaneous with the application of rapid advancement drive pulses being indicated by black portions. The hands will now have been rotated from the current time indicating position (denoted as NT) to the alarm time indicating position (denoted as AT). This status, after rapid rotation of the hands has been completed for a type (A) changeover, is shown in the row designated "Status after rapid rotation".

Post-processing is now performed, to prepare the contents of the MC circuit and SC circuit for subsequent return to the current time display mode. In this case, post-processing is performed by inputting rapid advance count pulses at a high frequency (1024 Hz) simultaneously to the MC circuit and SC circuit. When the count in the SC circuit reaches 360 (i.e. after a number of pulses equivalent to (t1−360) have been input), the flag signal goes to the H level, the rapid advance count pulses are terminated, and now a count equivalent to (t1−360) is left in the main counter circuit, while the SC circuit is reset to a count of zero.

In the case of a type (B) changeover shown in FIG. 4, the hands are initially in a relationship such that changeover from the current time to the alarm time display mode can be most rapidly performed by clockwise rotation of the hands, this being determined by the time difference t2 (measured as for time difference t1 above). In this case, the status of the counter and flag circuits are as indicated by graph 112, i.e. the flag signal is at the H level, the SC circuit has a count of zero, and the MC circuit contains a count equivalent to time difference t2. In this example it is assumed that the alarm time AT is 2:00, and the current time NT is 3:00, so that t2 is one hour, i.e. a count of 60 is held in the MC circuit at that moment. When the user designates changeover from current time to the alarm time display mode, then in this case, pre-processing must be carried out, as indicated by the contents of the "Pre-processing" row in FIG. 4. Count values which are input to the MC circuit and the SC circuit are indicated as dotted regions of graphs 114 and 116. In this example, pre-processing consists of inputting rapid advance count pulses simultaneously to the MC circuit and the SC circuit, at a rate of 1024 Hz, until a count of 360 is reached in the MC circuit. The flag signal is thereby set to the H level, and input of pulses is terminated. At this point, the status is as shown by graph 114, with the remaining count capacity of the SC circuit being equivalent to time difference t2.

Thereafter, rapid advance count pulses at a rate of 64 Hz are input to the SC circuit and MC circuit simultaneously, while rapid advancement drive pulses are applied in synchronism with these rapid advance count pulses to the stepping motor 102, such as to rotate the hands 64 and 66 in the reverse direction. This input of pulses and hands rotation is terminated when the count in the SC circuit reaches 360, whereupon the flag signal is set to the L level, and the count in the SC circuit reset to zero. The pulses which have been input to the MC circuit and SC circuit during this hands rotation process are shown by the black portions of graph 116. The hands have now been rotated through an amount t2, in the counterclockwise direction, so that the alarm time is now displayed.

The type (C) changeover, from alarm time to current time display mode will now be described. In this case, the initial time difference t3 between the displayed alarm time and the current time is such that changeover is performed by forward rotation of the hands. As shown by graph 118, the count in the MC circuit is equivalent to time difference t3, which in this example will be assumed to be 5 hours, with the current time being 7:00 and the alarm time 11:00, so that a count of 300 is initially held in the MC circuit. The flag signal is at the L level. To perform changeover from the alarm time to the current time display mode in this case, preprocessing is first carried out, as illustrated by graph 120. Here, rapid advance count pulses at a rate of 1024 Hz are input simultaneously to the MC circuit and SC circuit, until a count of 360 is reached by the MC circuit. A count value equal to (360−t3) is thereby stored in the SC circuit, and the flag signal set to the H level. Upon completion of this pre-processing, rapid advance count pulses are simultaneously input to the MC circuit and the SC circuit, while rapid advancement drive pulses are input in synchronism with the rapid advance count pulses, for thereby rotating the hands rapidly in the forward direction. This input of pulses and hands rotation is terminated when the count in the SC circuit reaches 360, i.e. after the hands have been rotated forward by an amount equal to t3, so that now the current time is being displayed. The flag signal is now at the L level, and the SC circuit is reset to a count of zero, while the count in the MC circuit is now equivalent to t3, i.e. the time difference between alarm time and current time.

In the case of a type (D) changeover, the display is changed from an alarm time to a current time display mode, but the time difference t4 between the alarm time and current time is such that changeover is performed by rapid reverse rotation of the hands. The input of rapid advance count pulses to the MC circuit and SC circuit in this case are identical to the case of a type (A) changeover described above, except for the fact that rapid advancement drive pulses (input in synchronism with the rapid advance count pulse amounts shown by the black regions of graph 126) act on the stepping motor such as to rotate the hands in the reverse direction. The type (D) changeover will therefore not be described further.

In this embodiment, changeover between the current time and alarm time display mode is performed by pressing crown switch 68 from the normal position 72 shown in FIG. 2 to the inward position 74. Correction of the displayed current time or changing of the displayed alarm time can then be carried out by the preset alarm time can then be carried out by pulling the crown 68 out to position 76 and then rotating it in the forward direction 78 or reverse direction 80, to thereby rotate the hands 64 and 66 in the clockwise or counterclockwise direction respectively. With the crown 68 pulled out to position 76, depression of pushbutton switch 70 inward to position 82 will result in an "all reset" signal being generated by switch control circuit 94, which acts to reset the contents of the MC circuit and SC circuit in timekeeping function circuit 96 to zero, and reset the flag signal F to the L level. This "all reset" capability is very convenient. When the timepiece battery is changed over, then after the new battery has been inserted, this "all reset" signal can be generated to start the count in the MC circuit from zero, since while crown switch 68 is pulled out to position 76, input of the timekeeping signal to the MC circuit is inhibited. In addition, the user can at any time cancel a preset alarm time, simply by generating the "all reset" signal as described above. It will be apparent that generating this "all reset" signal when a battery changeover is performed, or when the alarm time is cancelled or altered, will ensure that the correct relationship between the state of flag signal F and the contents of the MC circuit and the SC circuit will be maintained. It will be understood from the above description of changeover operations, given with reference to FIG. 4, that the latter relationship is essential to the operation of the timepiece. It can also be arranged that this "all reset" signal will be generated automatically each time a new battery is inserted into the timepiece, and each time contact with the battery is temporarily interrupted in the event of the timepiece being dropped. This will ensure correct operation of the timepiece, with respect to changeover between the current time and alarm time display mode under all conditions. Since establishment of the "overall reset" condition will result in the alarm time and current time becoming, in effect, coincident, an alarm signal will be generated each time the "overall reset" signal is generated, thereby providing confirmation to the user.

In the above description it has been assumed that the "overall reset" signal will reset the count in the MC circuit and SC circuit to zero. However it is equally possible to reset these counters to some other suitable time difference, for example 3 hours.

Figures 1, 5A:
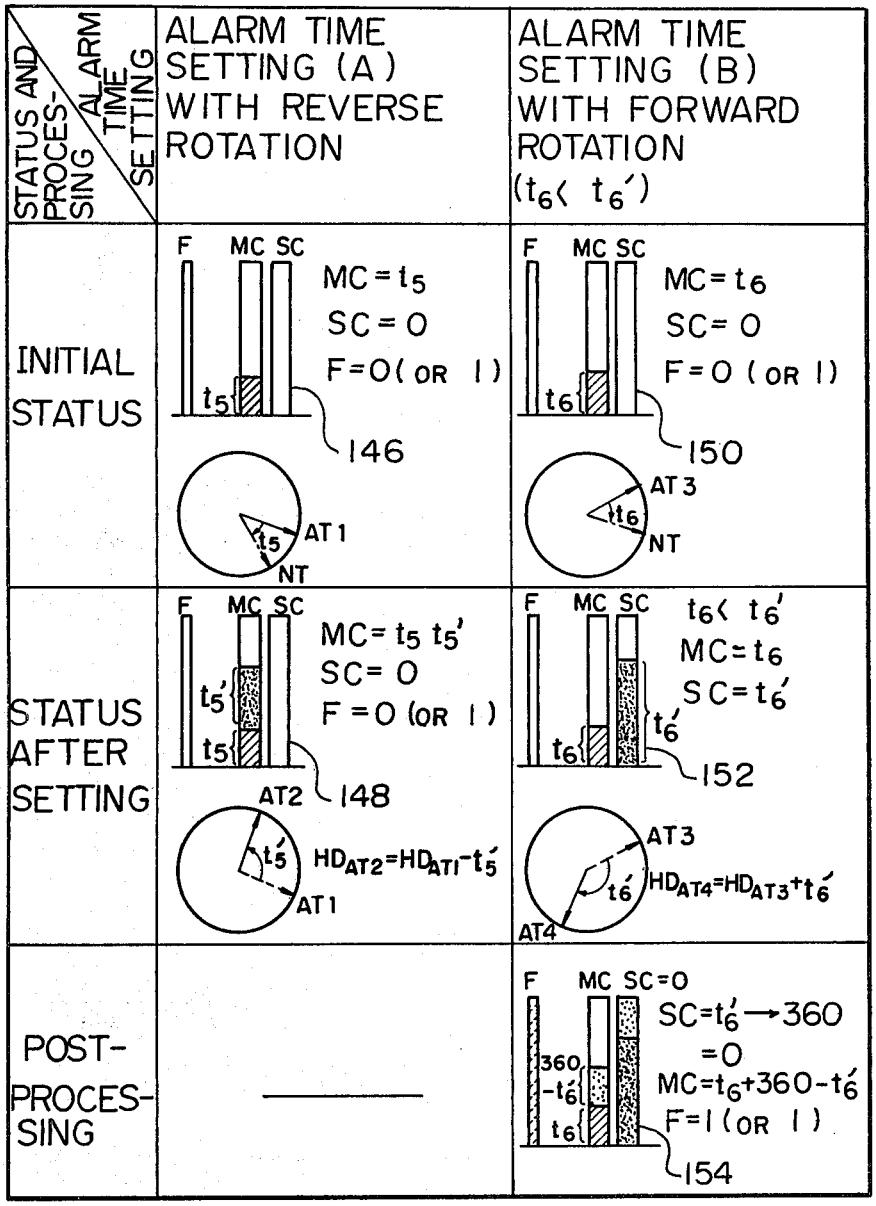

The manner in which time setting is performed will now be described, with reference to FIGS. 5(A) and 5(B). FIG. 5(A) illustrates three types of alarm time setting, designated as (A), (B) and (C). FIG. 5(A) is divided into four rows, indicating the initial status, status after setting and post processing, for each type of alarm time setting.

In alarm time setting (A), the timepiece is first set into the alarm time display mode, as described above. In this example, the previously set alarm time AT differs from the current time NT by a time difference t5, so that in the initial status, before alarm time setting is begun, a count value equivalent to t5 is stored in the MC circuit, as indicated by graph 146. The crown 68 is then pulled out to position 76, and rotated to generate setting pulses. When crown 68 is rotated slowly, these pulses are output at the rate of one per "click" emitted by the crown in rotating, with each pulse acting to rotate the hands by one minute. In alarm time setting (A), the crown 68 is rotated such that the hands are rotated in the reverse direction, by an amount t5′, to a new alarm time AT2. The rate at which setting pulses are applied to drive the hands is determined by the speed with which crown 68 is rotated, and above a certain speed of rotation, the setting pulses are generated at a rate of 64 Hz. In either case, while setting pulses are being generated to rotate the hands, count pulses are input in synchronism with these setting pulses, to the MC circuit. Thus, upon completion of setting the hands to the new alarm time AT2, the count in the MC circuit will have been increased by an amount equivalent to the amount of reverse rotation of the hands, i.e. t5′.

In the alarm time setting (B), the time difference between the alarm time AT3 and the current time NT is designated as t6. In this case, the new alarm time AT4 is set by rotation of the hands in the forward direction (in other words, the user has rotated crown 68 in the opposite direction to the case of alarm time setting (A) described above.) In this case, while drive pulses for alarm time seting are being generated and driving stepping motor 102, count pulses are input in synchronism with the setting pulses, to the SC circuit, with the count value t6 in the MC circuit being left unchanged. As a result, the contents of the SC circuit become equal to the time difference t6′ btween the previous alarm time AT3 and the new alarm time AT4, as illustrated by graph 152. In this case, post-processing must be performed after completion of hands rotation. As illustrated by graph 154, the count in the SC circuit is incremented by rapid advance count pulses at a rate of 1024 Hz, until a count of 360 is attained, with pulses being simultaneously input to the MC circuit. Counting is then terminated, with the flag signal F being inverted, the count in the SC circuit reset to zero, and a final count of t6+(360−t6′) being left in the MC circuit. It will be apparent from the explanation of the type (A) changeover shown in FIG. 4 that this is the correct count value which should be left in the MC circuit.

In the case of alarm time setting (C), the time difference between the current time and the alarm time is again initially t6. However, in alarm time setting (B), the magnitude of the time difference t6 was less than the value t6′. In the alarm time setting (C) example, however, the value of t6 is greater than the value t6″0 (the latter being the difference between the previous alarm time AT3 and the new alarm time AT5), as shown in the diagram. In this case, after forward rotation of the hands by the amount t6″ to set the new alarm time AT5, so that a count of t6″ is left in the SC circuit, post-processing is again performed. However in this case, during input of rapid advance count pulses at 1024 Hz to the MC circuit and SC circuit simultaneously during post-processing, the MC circuit reaches a count of 360 first, causing flag signal F to be inverted, and thereafter the count in the SC circuit reaches a count of 360, whereupon the flag signal F is once more inverted, and further input of rapid advance count pulses is terminated. The final status is as shown by graph 160, with a count of (t6−t6′) remaining in the MC circuit, and with the state of the flag signal F being unchanged from the initial status.

It should be noted that, since the current time will change while alarm time setting is being carried out, it is necessary to continue input of timekeeping signal pulses to the MC circuit during the setting process, i.e. at a rate of one pulse per minute, to successively count up the contents of the MC circuit. However for simplicity of description, the effects of such changes in the contents of the MC circuit have been omitted from the above explanation of alarm time setting.

The process of current time setting, i.e. correcting the value of current time indicated by the timepiece, will now be described, with reference to FIG. 5(B).

At this point, the manner in which the state of the flag signal F indicates the relationship between the current time and a preset alarm time will be summarized. If the time difference between the alarm time and the current time is more than 6 hours, as measured by rotation from the alarm time position to the current time in the clockwise direction (for example, time difference t1 in diagram 107 in FIG. 4) then the flag signal F will be at the H level. If the time difference between the preset alarm time and the current time is less than 6 hours, (for example as in the case of time difference t2 shown in diagram 113 in FIG. 4), then the flag signal will be at the L level. These conditions are valid both for the current time and the alarm time display modes.

Figures 2, 5A:
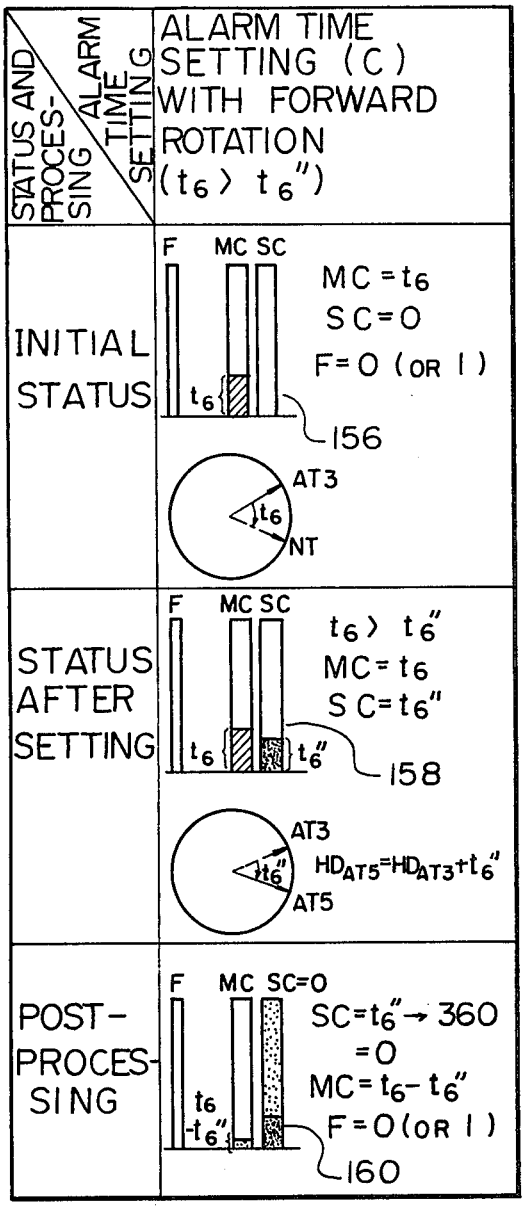
Figures 2, 5B:
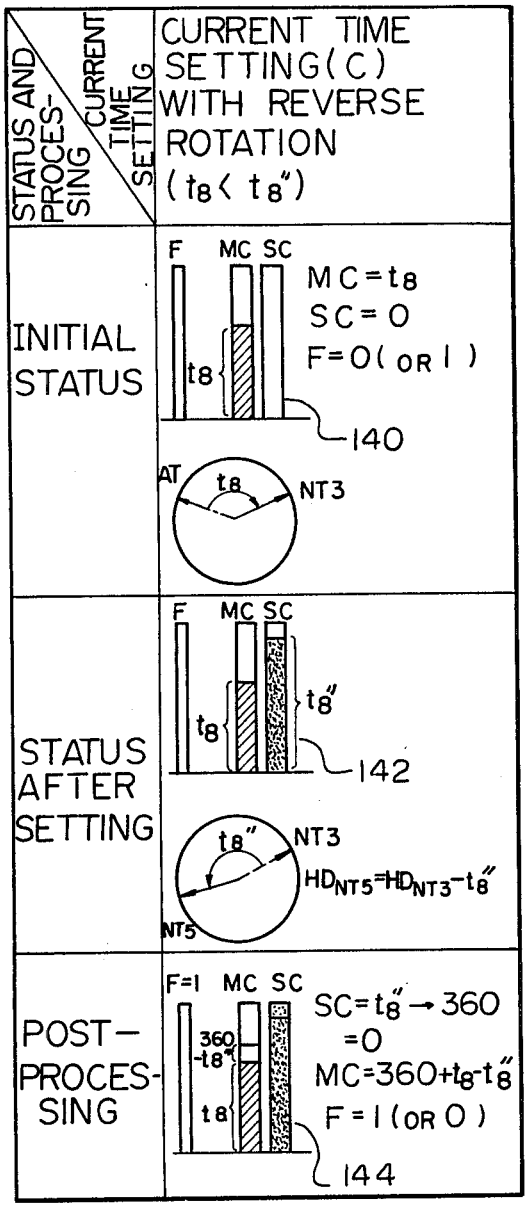

FIG. 5(B) illustrates three types of current time setting operations. In the first of these, current time setting (A), there is a time difference t7 between the alarm time AT and the current time NT1 at the moment of changeover from the current time display mode to the current time setting condition (this changeover being performed by pulling crown switch 68 outward to position 76 in FIG. 2). Thus in the initial status, there is a count equivalent to T7 in the MC circuit, while flag signal F is at the L level. Current time setting is then carried out by rotating crown switch 68 in direction 78 or 80, whereby forward rotation drive pulses are applied from motor drive circuit to stepping motor 102 in response to signals from changeover control circuit 90. Pulses are input to the MC circuit in synchronism with these drive pulses. Thus, upon the completion of setting the hands to the new position NT2, as shown in diagram 133, by rotation through an amount t7′, a count of t7′ will have been added to the count in the MC circuit so that the final count therein is (t7′+t7).

In the case of current time setting (B), there is a time difference t8 between the alarm time AT and the initial current time NT3, so that the contents of the MC circuit are equivalent to t8. The flag bit F can be at the H or the L level. When setting pulses are generated by rotating crown 68 in this case, the hands are rotated in the reverse direction, to a new current time position NT4, being rotated by an amount t8′. Pulses are added to the contents of the SC circuit in synchronism with the setting drive pulses, in this case, with the count in the MC circuit being left as t8. Thus, upon completion of setting to time NT4, the count values are as shown by graph 136. In this example, t8′ is greater than t8. When post-processing is now carried out, rapid advance count pulses at 1024 Hz are added to the MC circuit and SC circuit simultaneously, until the count in the SC circuit becomes zero. Since t8 is greater than t8′ the count in the MC circuit will reach 360, and hence be reset to zero, before that of the SC circuit. Thus, the state of flag signal F will be inverted twice by this setting operation, and hence will be unchanged. The final count in the MC circuit will be (t8−t8′), as shown by graph 138.

In the case of current time setting (C), setting of a new current time NT5 is again performed by reverse rotation of the hands. However in this case, the magnitude of the amount of rotation t8″ from previous current time position NT3 to the new position NT5 is sufficiently great that t8″ is greater than the time difference t8 between the alarm time and the initial current time position. Thus, when post-processing is carried out, the contents of the SC circuit reach a count of 360 prior to that of the MC circuit, whereupon further input of rapid advance count pulses to the MC circuit and SC circuit is terminated. It will be apparent that the number of rapid advance count pulses added to the SC circuit contents during the post-processing will be equivalent to (360−t8″). Thus, this amount will be added to the MC circuit contents in the post-processing so that the final count value in this circuit will be (360+t8−t8″). In this case, since only the SC circuit attains a count of 360, the flag signal F will be inverted only once.

As described with reference to FIG. 1 above, prior art systems for providing an alarm function in an analog electronic timepiece can introduce errors in the displayed time, due to timekeeping signal pulses occurring for example while rapid advancement changeover is taking place between the current time and alarm time display modes. With an electronic analog timepiece according to the present invention, such errors are eliminated by updating the contents of the timekeeping function circuit counter circuits in response to any timekeeping signal pulse which occur while changeover operations are taking place. This is achieved by an interrupt function, whereby transfer of rapid advance count pulses or rapid advancement drive pulses is temporarily interrupted to permit updating the MC count value and, if necessary the hands position in response to a periodic timekeeping signal, if a pulse of the latter signal occurs while a changeover is taking place. The interrupt function operates during application of rapid advance count pulses and rapid advancement drive pulses at a 64 Hz rate, and also during input of rapid advance count pulses at the 1024 Hz rate to the timekeeping function counter circuits during pre-processing and post-processing operations. This interrupt function will be illustrated, for various conditions of timepiece operation, with reference to FIG. 6.

In FIG. 6, the designation MC +1 indicates that, during that step of pre-processing, hands rotation, or post-processing, the contents of the MC circuit are incremented through an interrupt each time a pulse of the timekeeping signal occurs. The designation HD −1 indicates that a forward rotation drive pulse is applied to drive the hands into rotation, through an interrupt, each time a pulse of the timekeeping signal occurs during that step.

In the current time display mode (A) column in FIG. 6, the "counter status and hands movement" section indicates that during the current time display mode, the contents of the MC counter circuit and the hands position are advance in synchronism, in response to the timekeeping signal. In FIG. 6, the hatched region of each graph, such as graph 202, indicates count contents which have been formed by successive counting of timekeeping signal pulses. The regions filled with circles indicate that the MC circuit contents will be incremented by any timekeeping signal pulse occurring during that step (i.e. of pre-processing, hands rotation or post-processing). The black portions indicated count values formed in response to input of 64 Hz rapid advance count pulses, synchronous with rapid advancement drive pulses applied to the stepping motor 102.

In the case of current time setting with forward rotation, and current time setting with reverse rotation of the hands, as shown by the second and third columns in FIG. 6, no pulses are input to the MC circuit of SC circuit, and no drive pulses are applied for hands rotation.

In the alarm time setting mode, as indicated by columns (E) and (F), it is necessary as stated previously to continue to increment the contents of the MC circuit while setting is being carried out. Thus, as shown in column (E), which illustrates the case of alarm time setting with forward rotation of the hands from AT1 to AT2, timekeeping signal pulses are added to the MC circuit count by the interrupt function, both during setting and during post-processing while no stepping motor drive pulses are generated in response to the timekeeping signal during alarm time setting or during post-processing. During alarm time setting with reverse rotation of the hands, as shown in column (F), the interrupt function also acts to increment the MC circuit contents in response to the timekeeping signal, while setting is being performed.

Column (G) shows the case of changeover from the current time display mode to the alarm time display mode, with forward rotation of the hands. In this case, the MC circuit contents are incremented by the timekeeping signal, through the interrupt function, during rotation of the hands, if a timekeeping signal pulse occurs during this rotation. In addition, the hands are also advanced by such a timekeeping signal pulse, as indicated. During the post-processing however, only the MC circuit count will be incremented by the timekeeping signal, and no stepping motor drive pulse will be output.

Column (H) illustrates the case of changeover from the current time to the alarm time display mode. In this case, the MC circuit contents and the hands position will both be advanced in response to the timekeeping signal during the pre-processing operation. When the alarm time display mode is entered, however, the MC circuit contents will continue to be incremented by the timekeeping signal, but no stepping motor drive pulses will be output in response to the timekeeping signal.

Column (I) shows the case of changeover form the alarm time to the current time display mode with forward hands rotation. Here, during the pre-processing, the MC circuit contents will be incremented by the timekeeping signal, as shown, but no stepping motor drive pulses will be output to advance the hands in response to the timekeeping signal. When the current time display mode is entered, then of course the timekeeping signal pulses will synchronously advance the position of the hands and the contents of the MC circuit.

Column (J) shows the case of changeover from the alarm time to the current time display mode with reverse rotation of the hands. In this case, while rapid rotation of the hands is taking place, the MC circuit contents will be incremented by the timekeeping signal, but no stepping motor drive signals will be produced in response to the timekeeping signal. Thus, as illustrated by diagram 225, although the actual valve of current time may change from NT to (NT+1) during the rapid rotation of the hands in changeover, the final position of the hands will be correct, as a result of the contents of the MC circuit having been updated by the timekeeping signal. Similarly, both the MC circuit contents and the hands position are advanced by the timekeeping signal during input of the 1024 Hz rapid advance count pulses to the MC circuit and SC circuit during post-processing. Thus, even if the current time should change from a value NT at the start of post-processing to a value (NT+1) by the end of post-processing, the contents of the MC circuit will be correct, as will the hands position. In other words, upon completion of post-processing, the MC circuit will contain a count value equivalent to the time difference between the alarm time AT and the actual current time, (NT+1).

Figure 7A:
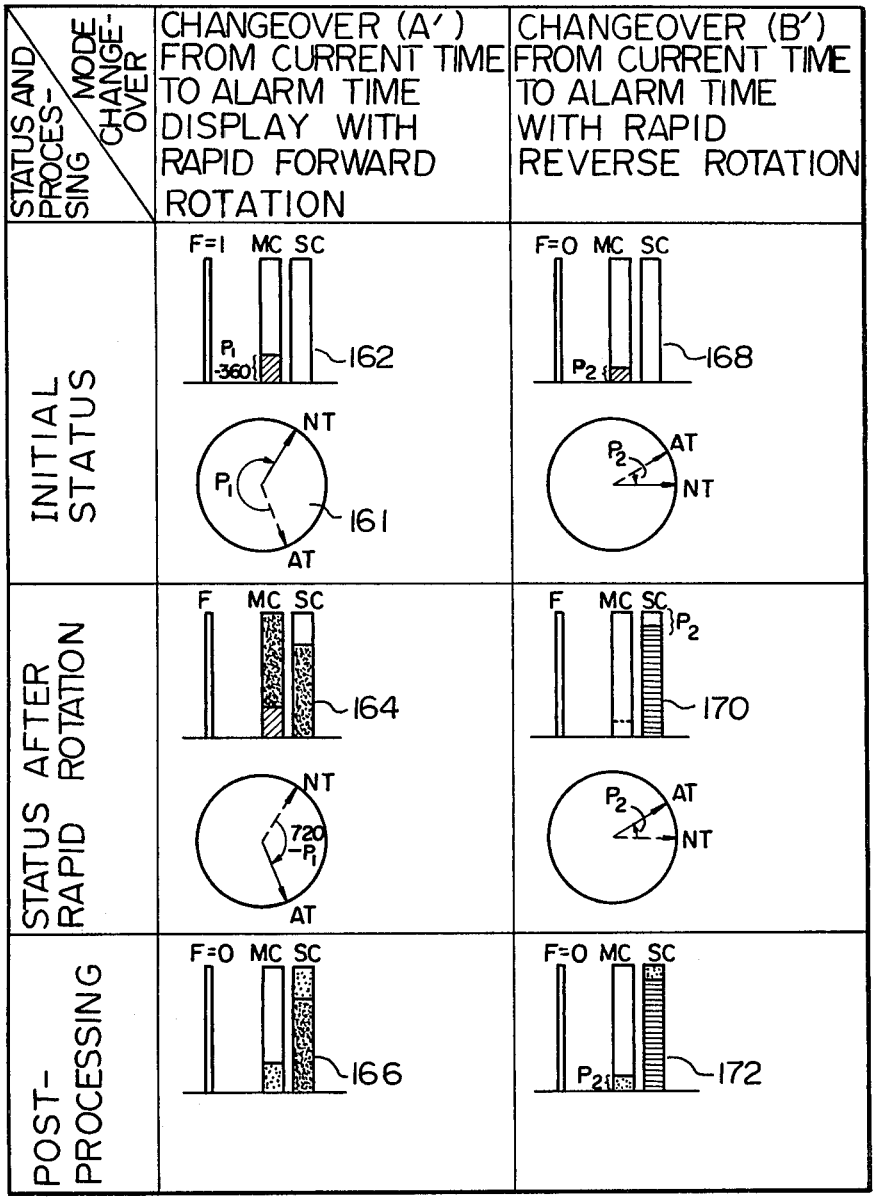
FIGS. 7A–7B are diagrams for graphically illustrating count operations performed by a main counter circuit and a secondary counter circuit in a timekeeping function circuit of an analog electronic timepiece provided with an alarm function according to the present invention during mode changeover, for the case in which these counter circuits are up-down counters each having a maximum count equivalent to six hours.
Figure 7B:
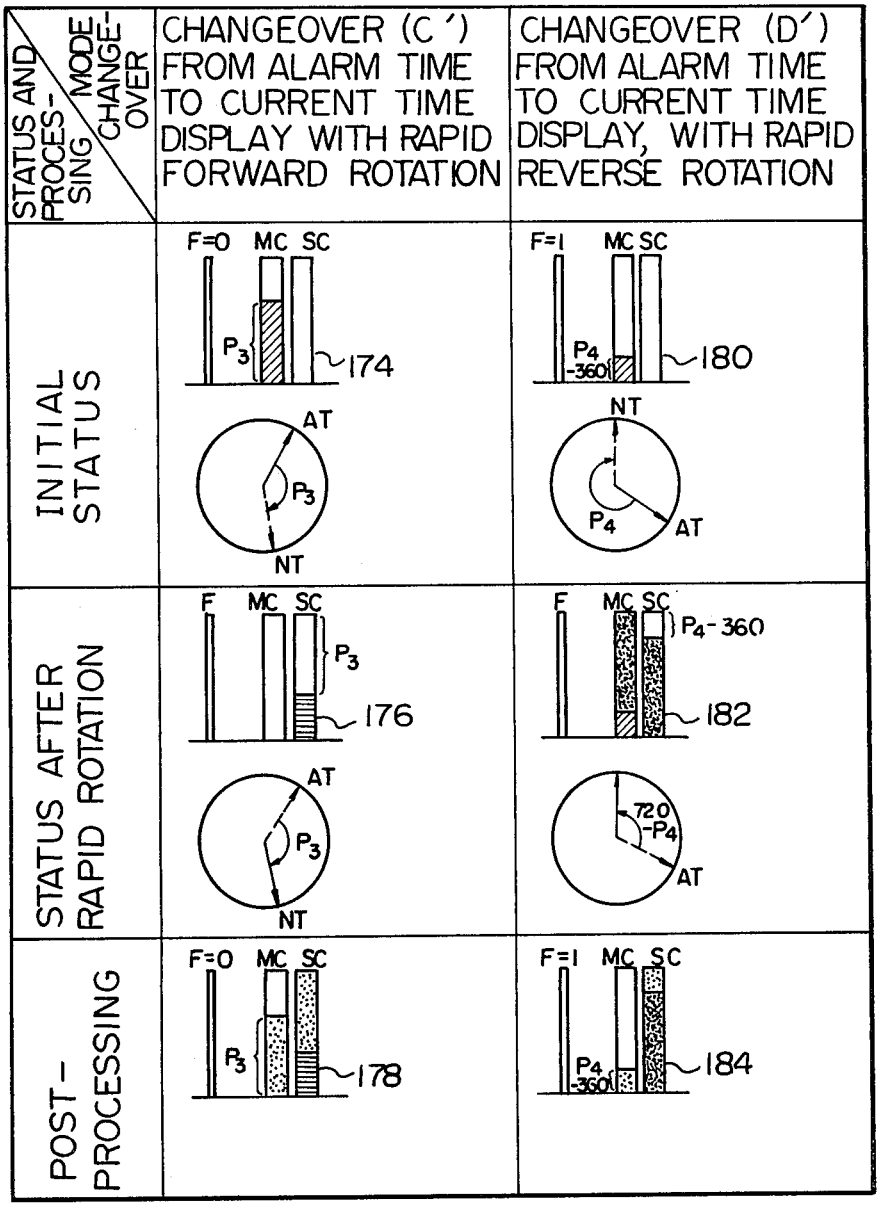
Figure 8A:
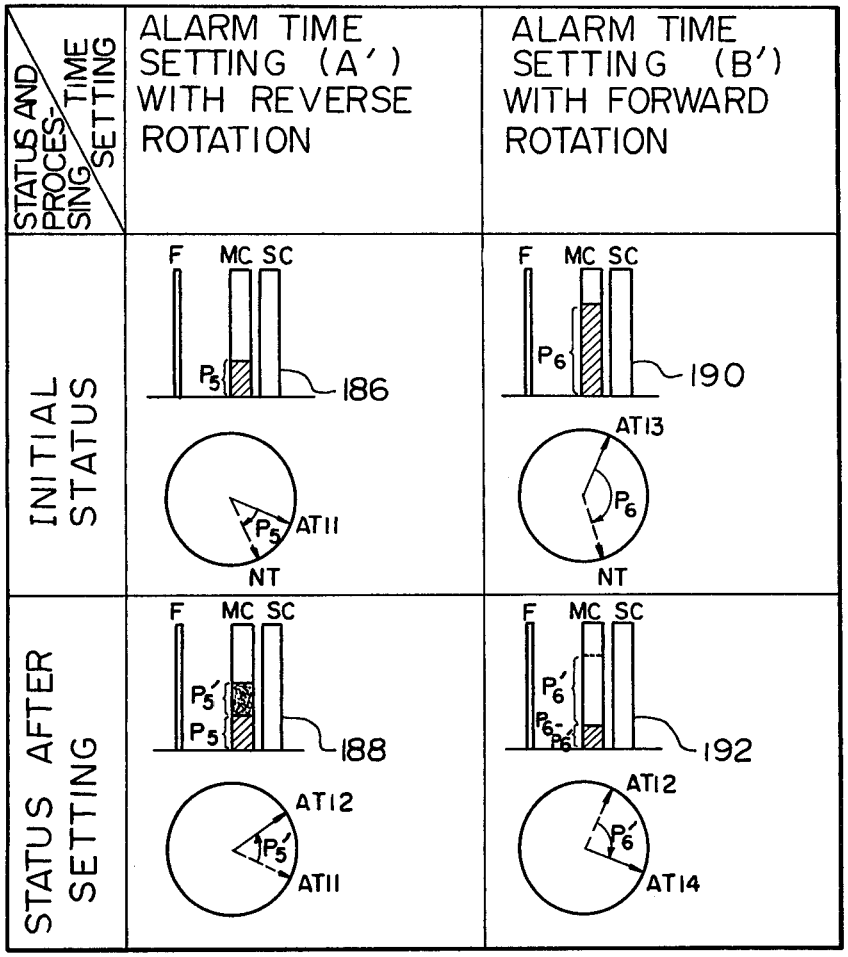
FIGS. 8A–8B are diagrams for graphically illustrating count operations performed by main and secondary counter circuits, each being up-down counters, during current time and alarm time setting.
Figure 8B:
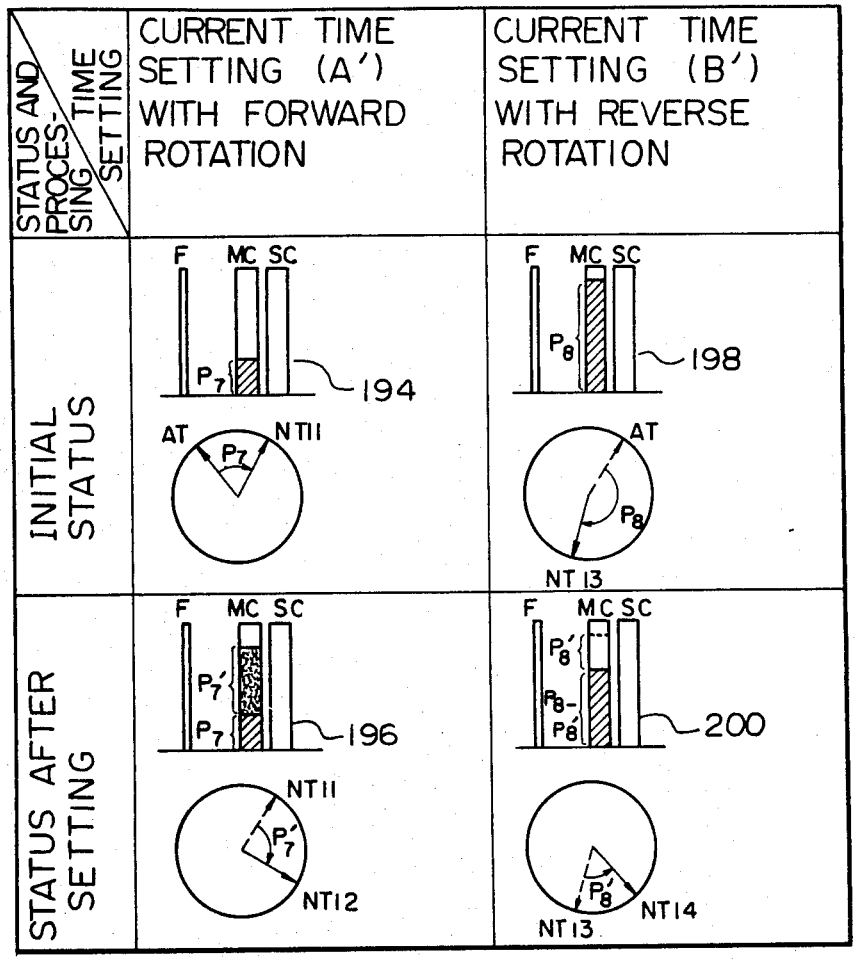

In the descriptions given above with reference to FIG. 4 to FIG. 6, it has been assumed that the MC circuit and the SC circuit each comprise an up-counter which is reset to zero after counting up of 360 input pulses has occurred. However, it is equally possible to use up-down counter circuits for the MC and SC circuits, as will now be described with reference to FIG. 8. Four types of changeover operation are illustrated in FIG. 7, with the first of these being changeover (A') from the current time to the alarm time display mode with rapid forward rotation of the hands. In this case, the initial contents of the MC circuit are (P1−360), where P1 is the time difference between the alarm time and current time NT at the start of the changeover. This initial status is illustrated by chart 162 and diagram 161. As in the case of changeover (A) in FIG. 4, rapid advance count pulses are input simultaneously to the MC circuit and SC circuit, in synchronism with rapid advancement drive pulses applied to the stepping motor to drive the hands forward by an amount (720−P1), as illustrated by graph 164. Thereafter, post-processing is performed to set the contents of the MC circuit to (P1−360). It will be seen that this sequence of operations is identical to that of changeover (A) in FIG. 4, described above.

In the case of changeover (B'), using up-down counters, the relationship between the alarm time and current time at the start of changeover is such that reverse rapid rotation of the hands is performed. Initially the count in the MC circuit represents the time difference P2 between the alarm time and current time NT. However in this case, while rapid advancement drive pulses are being applied to rotate the hands by the amount P2, rapid advance count pulses are input in synchronism with the rapid advancement drive pulses to the MC and SC circuit such as to count down the contents of these circuits, as illustrated by graph 170. Here, the horizontally striped portions of the graph indicate counter circuit contents resulting from counting down. In this case, counting down is continued until the MC circuit contents become zero, whereupon hands rotation is terminated. Each time the MC circuit or SC circuit contents reach zero, the state of the flag signal F is inverted. For the condition shown in graph 170, at the completion of rapid hands rotation, a count of (360−P2) will be left in the SC circuit. Post-processing is then performed by applying rapid advance count pulses at a rate of 1024 Hz, to perform counting up of the MC circuit and SC circuit simultaneously, until the SC circuit reaches a count of 360 and is reset to zero. The flag signal F is then inverted to the L level, and a count value of P2 is left in the MC circuit.

In the case of changeover B′, from the alarm to current time display, with rapid forward rotation of the hands, the initial display time difference between the current time and the alarm time is P3. Changeover is performed by applying rapid advancement drive pulses at 64 Hz to drive the hands forward, while rapid advance count pulses are input in synchronism with these drive pulses such as to count down the contents of the MC circuit and SC circuit. This counting is continued until the contents of the MC circuit reach zero, whereupon the flag signal F is inverted, and a count of (360−P3) is left in the SC circuit, as shown by graph 176. Post-processing is then performed, by inputting rapid advance count pulses at 1024 Hz simultaneously to the MC circuit and SC circuit such as to perform counting up by these circuits. This counting up is continued until the contents of the SC circuit become zero, whereupon a count value of P3 is left in the MC circuit, as shown by graph 178, while the flag signal F is inverted to its original state at the start of the changeover process.

In the case of changeover (D′), the time difference P4 between the alarm time and current time is such that changeover is carried out by rapid reverse rotation of the hands. The operation in this case is identical to that described for the changeover (D) shown in FIG. 4, with only counting up being performed by the MC circuit and SC circuit.

The operations of setting in new values of alarm time and current time will now be described, for the case of the MC and SC circuits comprising up-down counters. In the case of alarm time setting (A′), the initial time difference P5 between the alarm time AT11 and the current time NT is changed by reverse rotation of the hands, by an amount P5′. The operation of the MC circuit in this case is identical to that described in FIG. 5(A), alarm time setting (A), described hereinabove, since no down-counting operations are performed.

In the case of alarm time setting (B′), there is an initial time difference P6 between alarm time AT13 and current time NT. The initial contents of the MC circuit are therefore equal to P6, while the SC circuit contents are zero. During changeover from the alarm time AT13 to the new alarm time AT14, by setting pulses produced in response to rotation of crown switch 68, count pulses are input in synchronism with the setting pulses, such as to count down the contents of the MC circuit by an amount P6′. Thus, the count in the MC circuit on the completion of setting of the new alarm time is (P6−P6′), as shown by chart 192.

In the case of current time setting (A′), setting pulses are generated to rotate the hands forward from a current time indication NT11 to a new current time position NT12, by rotation through an angle P7′, with the initial time difference between the alarm time and current time being P7. In this case, no down counting operations are performed, and so the processing is identical to that of current time setting (A) described hereinabove with reference to FIG. 5(B).

In the case of current time (B′), in which the hands are rotated from an initial current time indication of NT13 to a new current time position NT14, by rotation in the reverse direction, the initial contents of the MC circuit are equal to the time difference P8 between the alarm time AT and the initial current time NT13. While setting drive pulses are being applied to drive the hands in this case, by an amount P8′, count pulses are applied in synchronism with the drive pulses to the MC circuit such as to cause counting down by this circuit, by an amount P8′. As a result, the final count value in the MC circuit on completion of setting to the new current time NT14 will be (P8−P8′).

It will be apparent from the above that precisely the same results can be obtained, using up-down counters for the MC circuit and SC circuit as can be obtained using up-counters for these circuits, with only minor changes being necessary in the control of counting by these circuits. It will also be apparent that the method of the present invention whereby the contents of the MC circuit and the position of the hands are updated in accordance with the timekeeping signal, through an interrupt function, is equally applicable to the use of up-down counter circuits for the MC circuit and SC circuit.

In the above description, it has been assumed, for simplicity of explanation, that the 12-hour system is utilized, and that the timepiece hands (i.e. the minutes and hours hands) are advanced once per minute in synchronism with advancement of the MC circuit contents. However in general, the present invention is applicable to an analog electronic timepiece in which the hands are advanced n times per minute, where n is an integer (e.g. of value 1, 2, 3, 4, 5, 6, 12, 15, 30, 60, etc.), i.e. in which the hands are advanced every 60/n seconds, and in which the maximum count of the MC circuit and SC circuit is (360×n). The present invention is equally applicable to an analog electronic timepiece functioning on the 24-hour system, in which means are provided for detecting and indicating the time as being AM or PM.

The present invention is also applicable to an analog timepiece which is equipped with a seconds hand as well as the hours and minutes hands. It has in practice been found that it is highly undesirable to utilize the same drive mechanism for driving the hours and minutes hands and also the seconds hand of an analog timepiece provided with an alarm function based upon rapid rotation of the hands into different positions for indicating alarm time and current time respectively. This is due to the excessively long time which becomes necessary for performing changeover between the alarm time and current time display modes. It is therefore highly preferable to use separate drive mechanisms for the hours and minutes hands and for the seconds hand, with two separate stepping motors being provided for each of these drive mechanisms. If this is done, then the time required for changeover between the current time and alarm time display mode can be made very short.

Figure 9A:
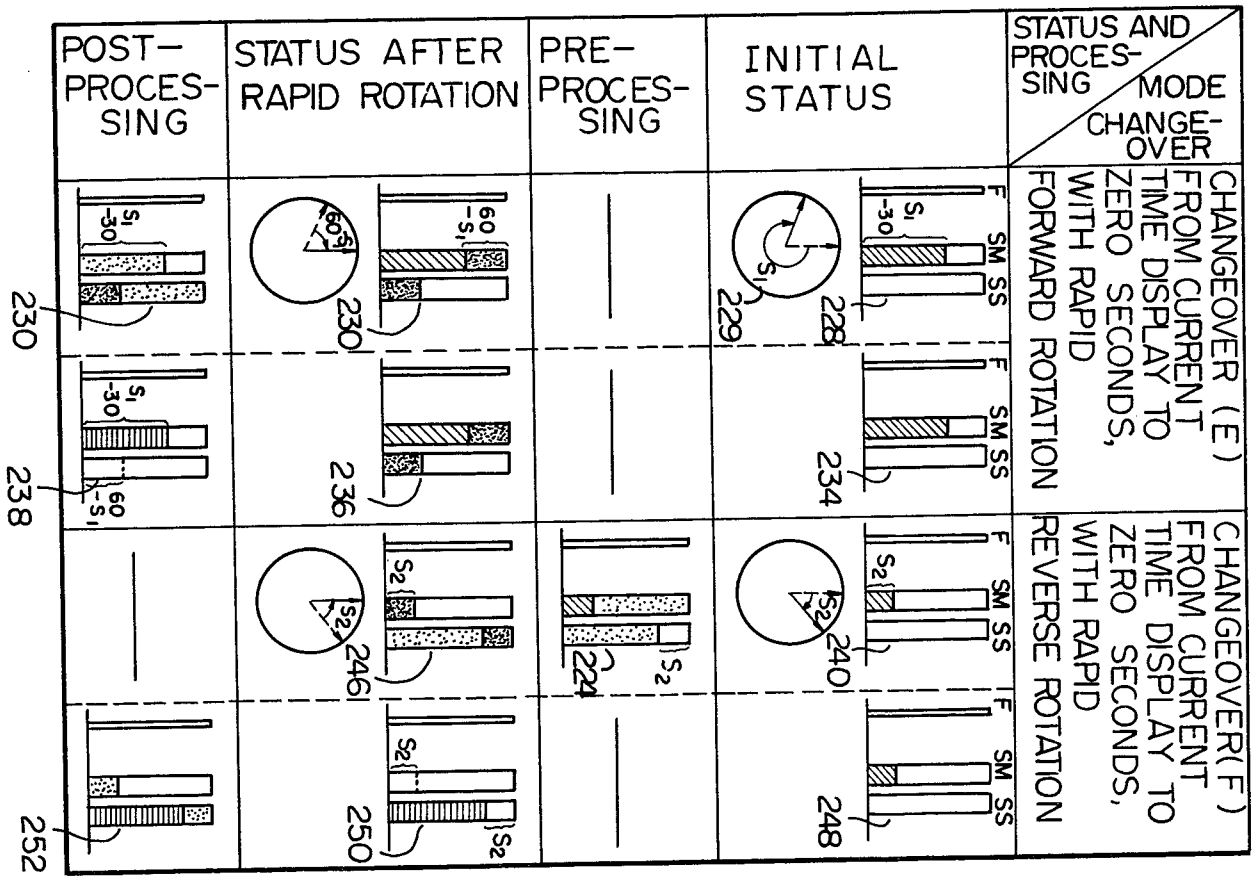
FIGS. 9A–9B are diagram for graphically illustrating count operations performed by a seconds counter in an analog electronic timepiece provided with an alarm function according to the present invention, whereby a seconds hand is returned to the zero indicating position upon changeover from a current time to an alarm time display mode.
Figure 9B:
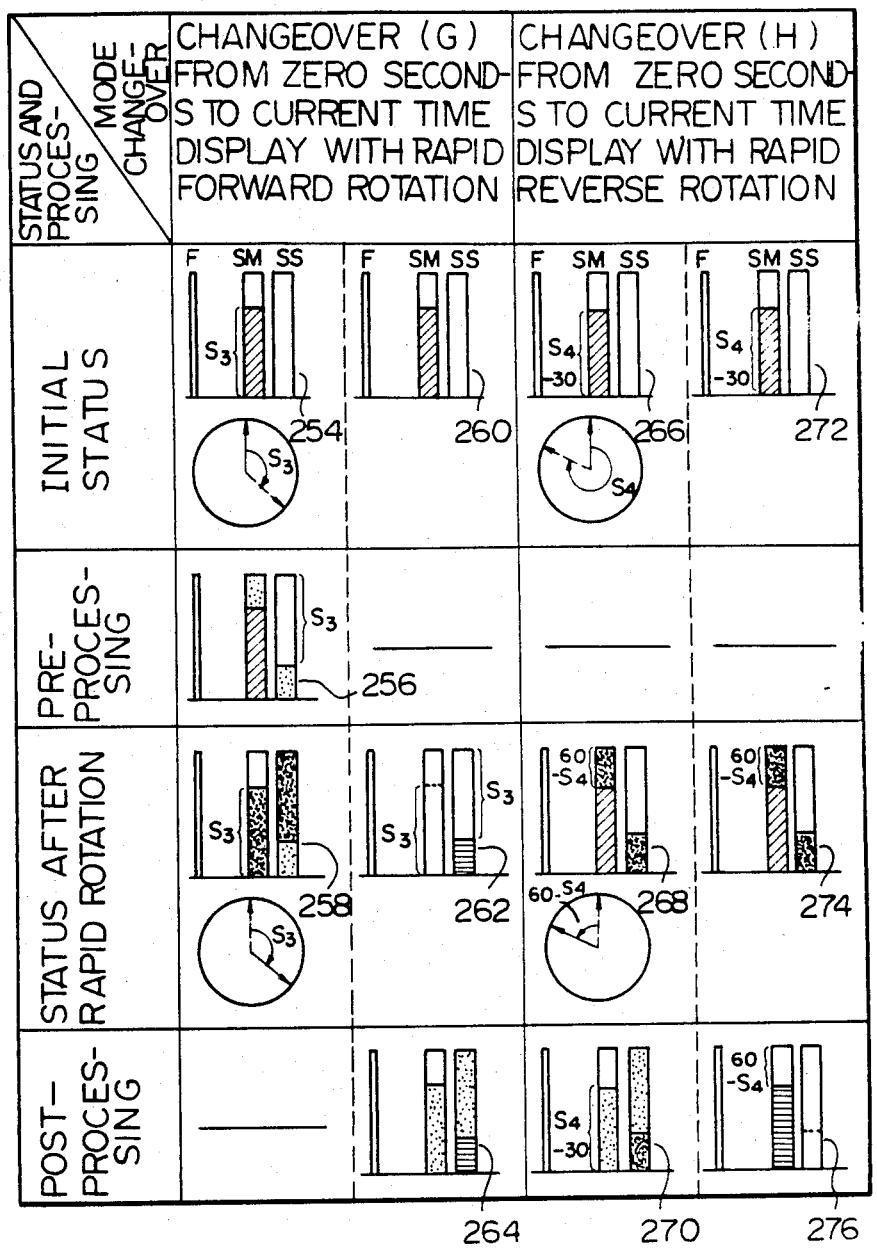

In an analog electronic timepiece provided with an alarm function, and having a seconds hand, it is convenient for the user to arrange that the seconds hand is reset to the zero seconds position, and held stationary in that position, when the alarm time display mode is entered. This will provide a clear indication that the timepiece is in the alarm time display mode. A suitable method for arranging this in an analog timepiece according to the present invention will now be described, with reference to FIG. 9. FIG. 9 illustrates the relationship between the count contents of a main seconds counter circuit (hereinafter abbreviated to SM circuit) and a secondary seconds counter circuit (hereinafter abbreviated to SS circuit), which constitute a seconds timekeeping function circuit (described hereinafter) in conjunction with a seconds flag signal generating circuit (hereinafter abbreviated to SF circuit). Four different types of changeover between the current time position of the seconds hand and the zero seconds position are illustrated in FIG. 9, in the four columns designated as changeover (E), changeover (F), changeover (G) and changeover (H). Each of these columns is divided into a left-hand and right-hand portion, and the contents of each left-hand portion illustrate the operation of the SM, SS and SF circuits in the case of the SS and SM circuits being up-counters. The diagrams and graphs in the right-hand portion of each column illustrate the corresponding operation in the case of the SS and SM circuits each comprising an up-down counter circuit.

The following description will first be given for the case of the SS and SM circuits comprising up-counters, i.e. with reference to the left-hand portion of each of the columns (E) to (H). In the case of changeover (E), from current time display to the zero seconds position of the seconds hand, changeover is performed by rapid forward rotation of the seconds hand. At the start of changeover there is a time difference of S1 seconds between the current time and the zero seconds positions, as shown by diagram 229. The SS and SM circuits each have a maximum count of 30 (i.e. each is reset to zero when 30 input pulses have been counted), and in this case the initial count in the SM circuit is (S1−30), while the flag signal F from the SF circuit is at the H level. When changeover is performed, rapid advancement drive pulses are applied to the seconds hand stepping motor, to rotate the seconds hand to the zero position in the forward direction, while rapid advance count pulses are simultaneously input to the SS and SM circuits. These pulse inputs are terminated when a count of 30 is reached in the SM circuit, with the seconds hand now being at the zero position, and a count value of (60−S1) in the SS circuit. Post-processing is then performed, by input of rapid advance count pulses at a rate of 1024 Hz simultaneously to the SM and SS circuits, until the SS circuit contents reach a count of 30. The flag signal F is thereby inverted to the H level, and counting is terminated with the SM circuit contents being equal to (S1−30).

The right-hand part of the "changeover (E)" column illustrates the same changeover operations as described in the previous paragraph, but for the case in which the SS and SM counter circuits are up-down counters. In this case, the initial conditions, shown by graph 234, are that the SM circuit holds a count of (S1−30), and the SS circuit contents are zero. No pre-processing is performed. When changeover is carried out from the current time to the zero seconds position of the seconds hand, rapid advance count pulses are input to count up the contents of the SM and SS circuits, as shown by graph 236. Following completion of rotation of the seconds hand, post-processing is carried out by applying rapid advance count pulses at 1024 Hz simultaneously to the SM and SS circuits, such as to cause counting down of the contents thereof. This is continued until the count in the SS circuit reaches zero, as shown by graph 238. Since counting-down by an amount (60−S1), it will be apparent that the final count left in the SM circuit will be (S1−30).

The changes in the contents of the SS and SM circuits, for the cases of changeover (F) from current time display to the zero seconds position, changeover (G) from zero seconds position to the current time position, and changeover (H) from zero seconds position to the current time position with reverse rotation, will be apparent from the diagrams of FIG. 9, in view of the above description of changeover (E) of the seconds hand. Further description will therefore be omitted.

It is possible to arrange to increment the contents of the SM counter by an interrupt function, in response to any timekeeping signal occurring during changeover between the current time position and the zero seconds position of the seconds hand. However, the time required for rotation of the seconds hand through a display angle of 30 seconds, using a 64 Hz rapid advancement drive pulses, is less than 0.5 seconds. Thus, it is possible to arrange that rapid advancement of the seconds hand, as well as any pre-processing or post-processing of the SS and SM counter circuits, will be completed within the approximately 1 second interval between successive timekeeping signal pulses which advance the seconds hand in the current time display mode.

Figure 10:
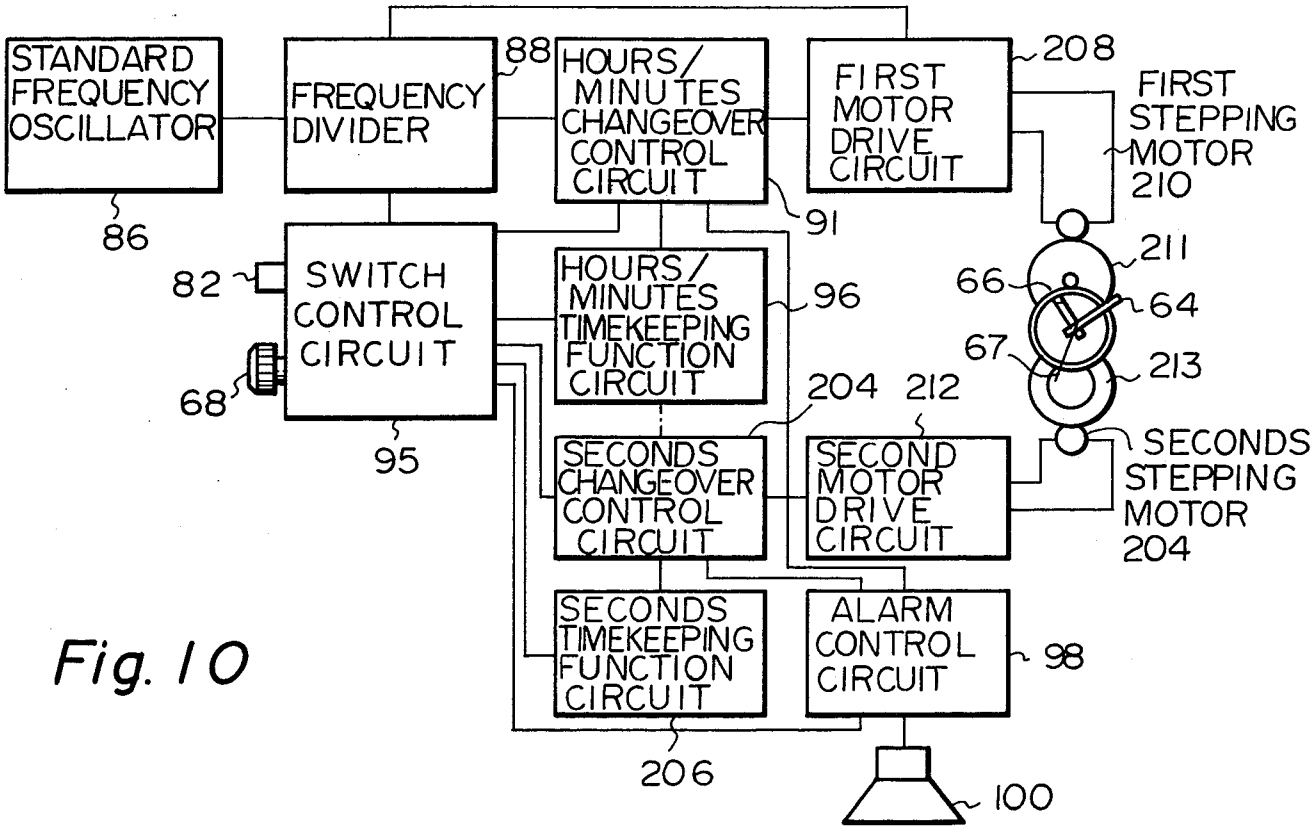
FIG. 10 is simplified block circuit diagram of a second embodiment of an analog electronic timepiece provided with an alarm function according to the present invention, provided with a seconds hand and two stepping motors for hands rotation.

Referring now to FIG. 10, another embodiment of an analog electronic timepiece including an alarm system according to the present invention is shown in general block circuit diagram form. The main point of difference between this embodiment and that of FIG. 2 and FIG. 3 lies in the provision of a seconds hand 67, and associated drive and control circuit means. The hours and minutes hands 64 and 66 are driven through a wheel train 211 by a first stepping motor 210, which is driven by drive pulses applied from a first motor drive circuit 208. Input signals to drive circuit 208 are transferred by changeover control circuit 91, in accordance with the status of an hours/minutes timekeeping function circuit 96. The seconds hand 67 is driven through a wheel train 213 by a second stepping motor 214, which is operated by drive pulses generated by a second drive circuit 212. Input signals to second drive circuit 212 are applied from a seconds changeover control circuit 204, in accordance with the status of a seconds timekeeping function circuit 206. Seconds hand 67 is advanced by one step per second. Hours and minutes hands 64 and 66 are advanced at a rate of once every 20 seconds.

Figure 11:
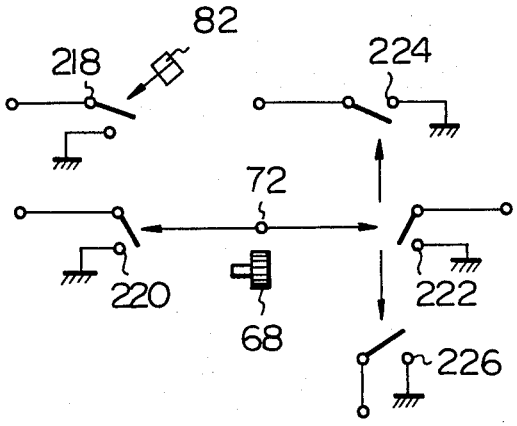
FIG. 11 is a diagram illustrating switches which are actuated by manipulation of external operating members provided on the second embodiment.

The output signal from a standard frequency oscillator circuit 86 is frequency divided by frequency divider circuit 88, which produces timekeeping signals at frequencies of 1 Hz and 1/20 Hz, together with various clock signals used in the circuit operation. As in the first embodiment, the external operating members of the timepiece comprise a crown switch 68 which can be manipulated as shown in FIG. 2, and a pushbutton switch 70. The switch mechanisms which are actuated by these external operating members are shown in FIG. 11. Each switch mechanism has one terminal connected to ground potential (i.e. Vdd), and the other terminal connected to an input of switch control circuit 95. Switch mechanism 218 is closed by depressing pushbutton switch 82 inward, as shown. Switch 220 is actuated by depressing crown 68 inward from the normal position 72 shown in FIG. 2, and opens when crown 68 is released. A switch 222 is closed when crown 68 is pulled outward to position 76 and left there. Clockwise rotation of crown 68 results in successive opening and closing of a switch 224, with an audible click being emitted on each switch closure. Similarly, counterclockwise rotation of crown 68 causes successive opening and closing of a switch 226.

Switch control circuit 95 produces output signals which are applied to other circuits, in accordance with switch open/closed conditions. Hours/minutes changeover control circuit 91 applies output signals to first motor drive circuit 208 in accordance with the status of switch control circuit 95 and hours/minutes timekeeping function circuit 96, and thereby drives first motor drive circuit 208 to rotate hours and minutes hands 64 and 66 through first stepping motor 210 acting through wheel train 211. Seconds changeover control circuit 204 similarly applies input signals to second motor drive circuit 212, in accordance with the status of switch control circuit 95 and seconds timekeeping function circuit 206, whereby seconds hand 67 is driven through wheel train 213 by second stepping motor 214. First and second stepping motors 210 and 214 each comprises a reversible pulse-operated motor.

Hours/minutes timekeeping function circuit 96 receives switch input signals and a 1/20 Hz timekeeping signal, and in response performs counting of current time and alarm time setting signal pulses, memorizes the time difference between current time and alarm time, and designates to hours/minutes changeover control circuit 91 the amount by which the hands are rotated when changeover occurs between current time and alarm time display modes. Seconds timekeeping function circuit 206 counts the pulses of the 1 Hz timekeeping signal, for thereby memorizing the position of the seconds hand 67.

Alarm control circuit 98 serves to control the operation of alarm device 115, for generating various types of audible signals for indicating alarm time coincidence, etc.

The overall operation of this embodiment will now be described. In the current time display mode, crown 68 is left in position 72 shown in FIG. 2. Seconds hand 67 is advanced by one step per second, while the hours and minutes hands 64 and 66 are advanced once per 20 seconds. Changeover from the current time to alarm time display mode is started by depressing crown 68, as is changeover from the alarm time to current time display mode. If the alarm is in the set state (i.e. such that an audible signal will be produced when the alarm time is reached), then this is indicated, in the alarm time display mode by the seconds hand 67 vibrating back and forth between the 1 second and the 59 second position, about the zero seconds position.

When changeover is performed from the alarm time to the alarm time display mode, seconds hand 67 is rotated from the zero seconds position to the current time position, by forward or reverse rotation, whichever provides the most rapid transition, and thereafter advances by one step per second. Similarly, minutes and hours hands 64 and 66 are rotated forward or in reverse to the current time indicating position, and thereafter are advanced by one step each 20 seconds. When changeover has been performed from the current time to alarm time display mode, or vice versa, then two consecutive high-pitched audible tone bursts are emitted by alarm device 100. When the alarm time time display mode has been entered, then three more audible tone bursts are emitted, while when the current time display mode is entered, a single tone burst is emitted. In this way, changeover to each display mode is indicated audibly. With the timepiece in either the current time or alarm time display mode and crown 68 in normal position 72, depression of pushbutton 82 will produce an audible indication of whether the alarm is in the set or reset state. If the alarm is set, then two consecutive high-pitched tone bursts will be emitted, while if it is reset, a single tone burst will be emitted.

If pushbutton 82 and crown 68 are depressed simultaneously, while in the current time display mode, then seconds hand 67 will be rapidly returned to the zero seconds position, in either the forward or reverse direction, so that one-touch seconds reset can be performed prior to setting the current time to a correct value. At the same time, the minutes and hours hands 64 and 66 are moved in the forward or reverse direction by a sufficient amount to compensate for the rotation of the seconds hand 67. If now crown 68 is pulled outward, to position 76 shown in FIG. 2, then all of the hands will be halted in their positions at that instant, i.e. the seconds hand will remain at the zero position, if zero reset has just been performed as described above. Correction of the current time can then be carried out, and if the crown 68 is returned to its normal position 72 at some predetermined time, e.g. in synchronism with a radio time signal, thereafter accurate timekeeping operations will continue. During current time setting, the hours and minutes hands will be rotated by a step of 20 seconds for each audible "click" emitted by crown 68 in rotating. If crown 68 is rotated above some predetermined speed, then rapid advancement setting pulses, as described hereinabove, will be generated. If pushbutton 82 alone is depressed, in the current time setting condition, then an "all reset" signal will be generated, and the current time then displayed by the hands will be set as the alarm time.

Setting of an alarm time is similarly carried out, by first setting the timepiece in the alarm time display mode as described above, then pulling crown 68 outward, and rotating crown 68 in the clockwise or counterclockwise direction to correct the hours and minutes of alarm time. Advancement by one step per "click" of crown 68, or rapid advancement setting can be carried out. However in alarm time setting, the minutes hand 64 is advanced by 3 steps (i.e. one minute) for each "click" of crown 68, so that minutes hand 64 always stops precisely at a minutes graduation. This is also true when rapid advancement setting is performed. If pushbutton 82 is depressed while in the alarm time setting mode, then setting and cancellation of the alarm will be produced alternately in response to successive depressions. Audible indications of the alarm condition, either set or cancelled, are provided, together with visual indications by means of seconds hand 67 as described above. On completion of alarm time setting, crown 68 is depressed back to normal position 72, whereupon changeover by rapid advancement to the current time display mode is performed as described above. When the current time and the preset alarm time coincide, then an audible alarm tone is generated by alarm device 100, which can be terminated by depressing pushbutton 82.

In this embodiment, backlash compensation is provided, in order to prevent errors occuring in the displayed time after changeover between the current time and alarm time display modes has been performed by reverse rotation of the hands, due to minutes hand 64 not moving to the precise position after changeover because of backlash between the teeth of the gearwheels in wheel train 211. Such backlash errors can also occur due to reverse rotation of the minutes and hours hands 64 and 66 when setting of the current time or alarm time is carried out. The basis of this backlash compensation is that, upon completion of reverse rotation, the hands are moved by one additional step in reverse, and then rotated forward by one step.

Figure 12:
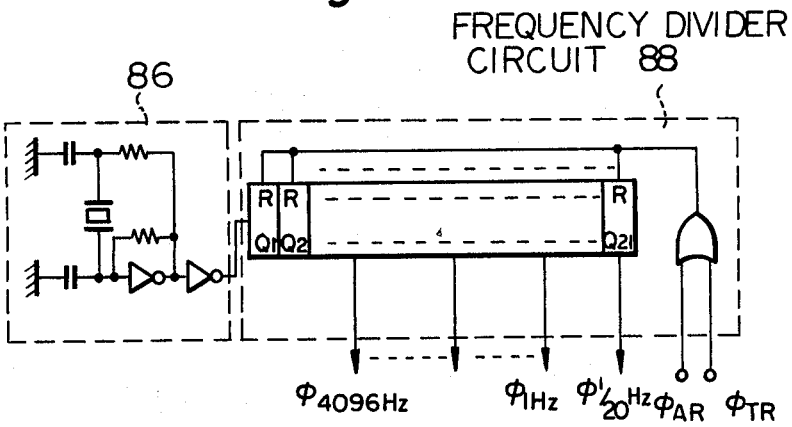
FIG. 12 and FIG. 13 are circuit diagrams of timekeeping and clock timing signal generating circuit means, and of a switch control circuit respectively, for the second embodiment.

FIG. 12 is a circuit diagram of standard frequency oscillator 86 and frequency divider 88. Oscillator 86 is quartz crystal vibrator controlled, and produces an output signal of 32,768 Hz. Frequency divider circuit 88 comprises 17 divider stages, and produces timekeeping signals $\phi$1 Hz with a frequency of 1 Hz, $\phi$1/20 Hz with a frequency of 1/20 Hz, $\phi$4096 Hz, etc, as shown in FIG. 12. An all reset signal $\phi$AR and a time reset signal $\phi$TR are input, and act to reset each stage of frequency divider 88.

Figure 13:
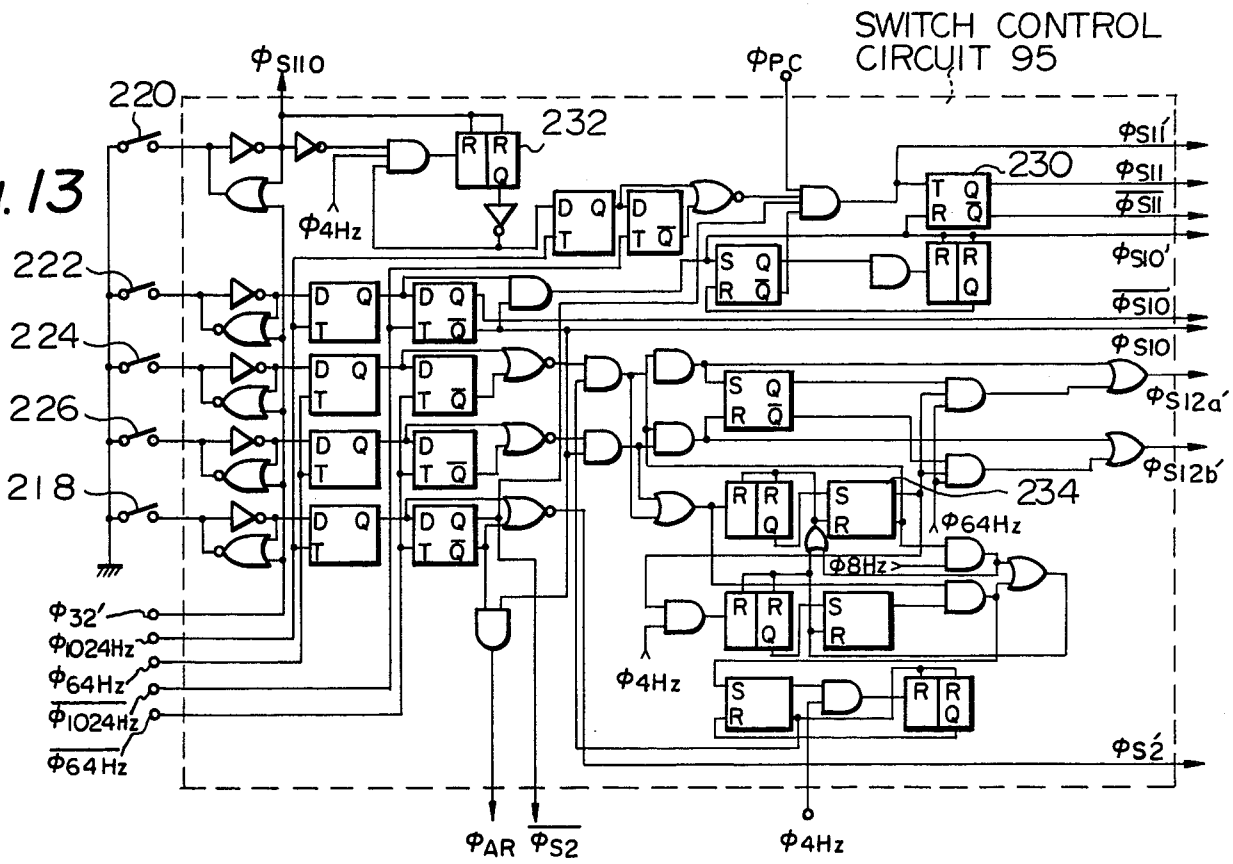
Figure 14:
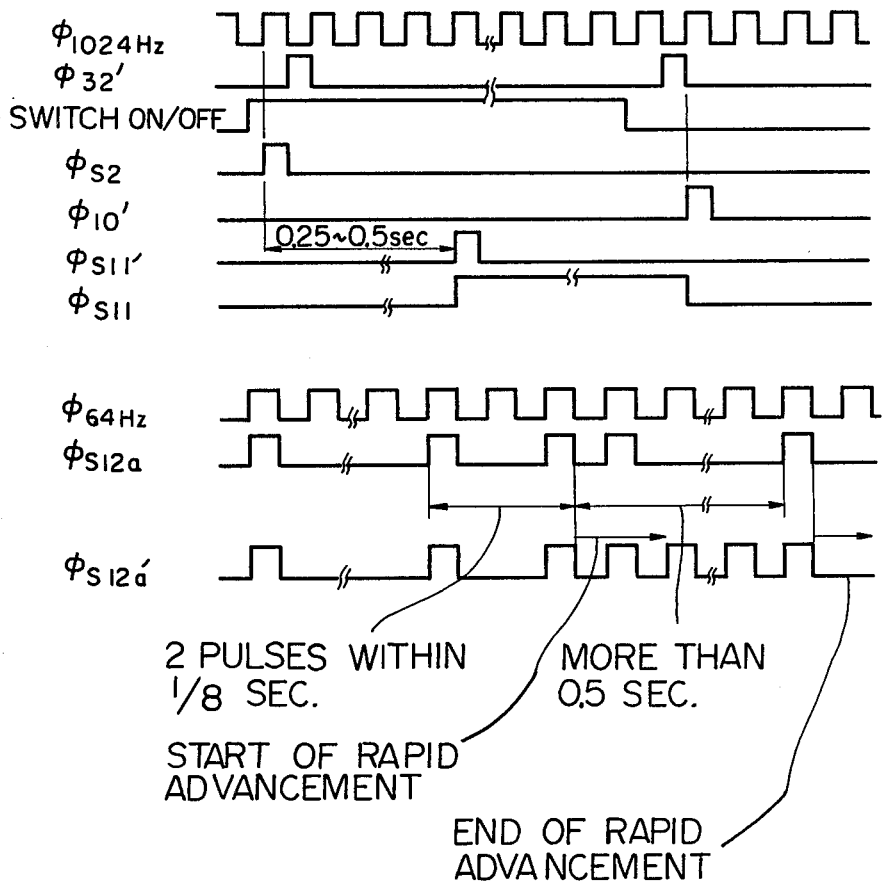
FIG. 14 is a timing chart for illustrating the operation of the circuit of FIG. 13.

FIG. 13 is a circuit diagram of switch control circuit 95, and FIG. 14 is a waveform diagram to illustrate the operation of switch control circuit 95. As shown, switch control circuit 95 receives various switch signal and clock signal inputs, and produces output signals accordingly. Switch 220 is a mode changeover switch, shown in FIG. 11. Each time switch 220 is closed, a pulse of signal 100 S11'is output from switch control circuit 95, due to counting of a $\phi$4 Hz clock signal by counter circuit 232. Each time a pulse of signal $\phi$S11' is produced, the state of a toggle-type flip-flop (abbreviated hereinafter to FF) 230 is inverted, so that the logic levels of output signals $\phi$S11 and $\overline{\phi S11}$ are inverted. Signal $\phi$S11 goes to the H level in the alarm time display mode, and signal $\phi$S11 to the H level in the current time display mode. A signal $\phi$PC is also input to switch control circuit 95, generated as described hereinafter. When signal $\phi$PC is at the L level, then this indicates that mode changeover is in progress, and switch 220 is made inoperative. Similarly, switch 220 is made inoperative for a short interval immediately after switch 222 is opened. When switch 222 is closed, the time setting mode (for alarm time or current time) is entered, and a pulse of signal $\phi$S10' is produced as shown in FIG. 14, while signal $\phi$S10 goes to the H level. When switch 224 is closed, a pulse of signal $\phi$S12A' is output from switch control circuit 95, synchronized with a 64 Hz clock signal $\phi$64 Hz. If switch 224 is closed twice or more in succession, at a rate of between 8 and 64 times per second, then FF234 is set and signal $\phi$S12A' is output as a rapid advancement signal comprising a train of 64 Hz pulses. Signal $\phi$S21B' is produced similarly in response to rapid actuations of switch 226. When switch 218 is closed, an output pulse of signal $\phi$S2' is generated, which is synchronized with the $\phi$1024 Hz clock signal.

Figure 15:
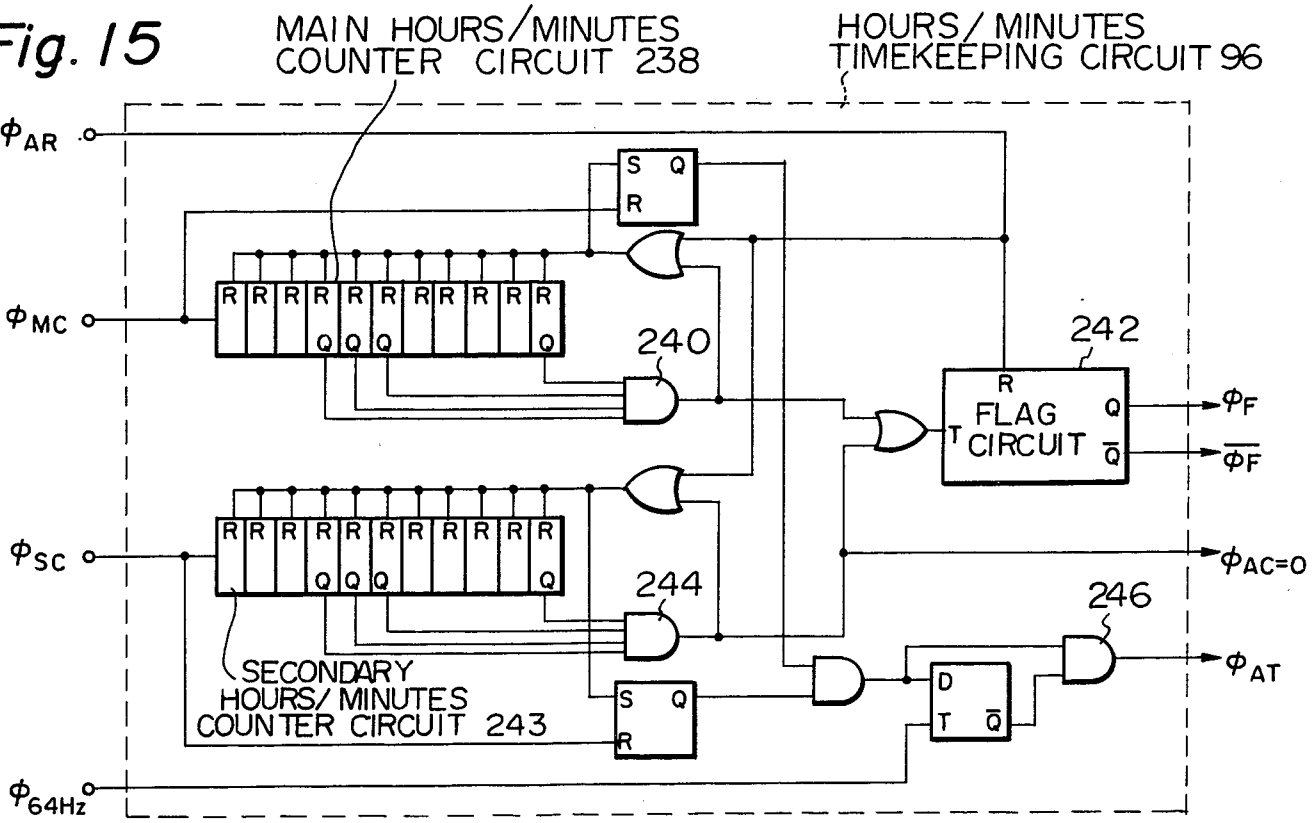
FIG. 15 is a circuit diagram of an hours/minutes timekeeping function circuit in the second embodiment.

FIG. 15 is a circuit diagram of the hours/minutes timekeeping function circuit 96. The operating principles of this circuit have been described in detail hereinabove, so that detailed description will be omitted. In this embodiment, the minutes hand 64 is advanced once every 20 seconds, and because of this the main hours/minutes counter circuit 238 (corresponding to the MC circuit in the description of the first embodiment given hereinabove) comprises an 11 stage up-counter circuit. When a count of 1080 is reached, a reset signal is output from AND gate 240, which resets main hours/minutes counter circuit 238 to zero, and at the same time inverts the state of flag signals $\phi$F and $\overline{\phi F}$ from the flag circuit 242. Similarly, when the secondary counter circuit 243 (corresponding to the SC circuit of the first embodiment described hereinabove) reaches a count of 1080, an output signal from AND gate 244 inverts the state of flag signals $\phi$F and $\overline{\phi F}$. Input signal $\phi$SC comprises count pulses input to secondary hours/minutes counter circuit 243, and is slightly delayed with respect to the count signal $\phi$MC which is input to counter circuit 238. As a result, it is ensured that the states of flag signals $\phi$F and $\overline{\phi F}$ will be correctly inverted in response to changes in signals from AND gates 240 and 244. When the main hours/minutes counter circuit 238 reaches a count of zero together with secondary hours/minutes counter circuit 243, then a coincidence signal $\phi$AT, indicating coincidence between the preset alarm time and current time, and is input to the alarm control circuit 98. The "all reset" signal $\phi$AR acts to reset the contents of the main hours/minutes counter circuit 38 and secondary hours/minutes counter circuit 243 to zero, and resets signal $\phi$F to the L level.

Figure 16:
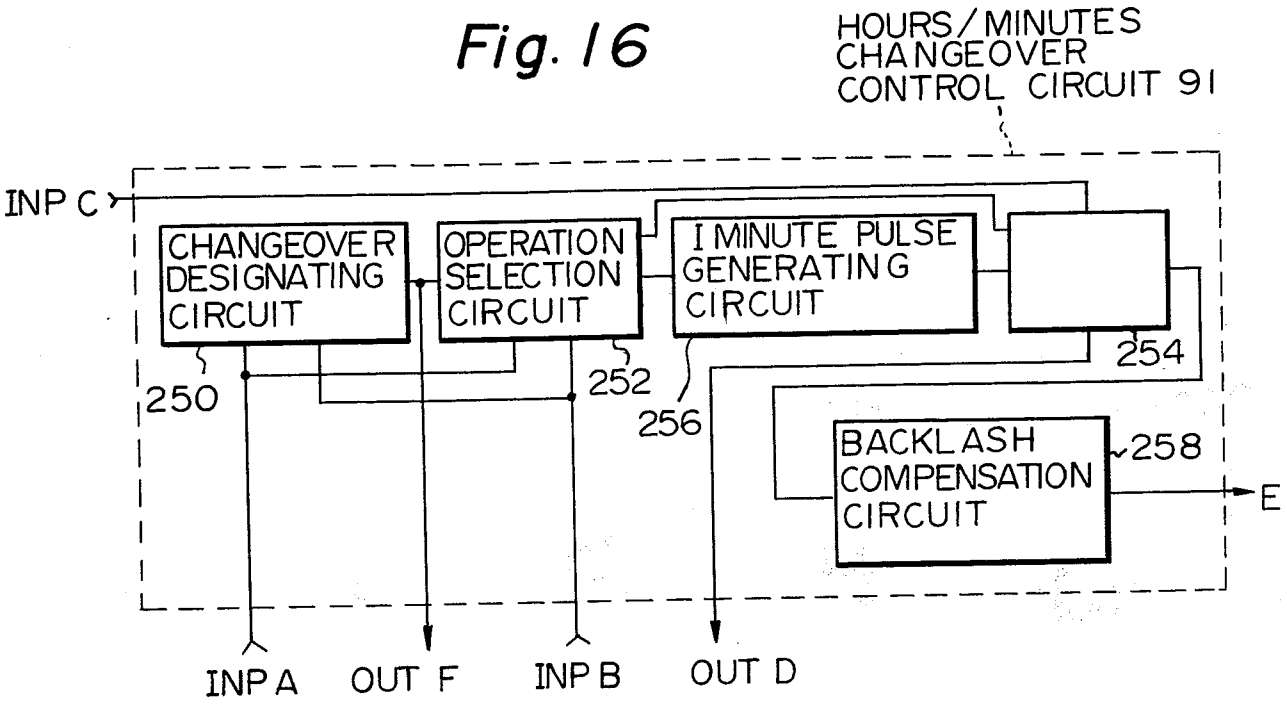
FIG. 16 is a simplified block circuit diagram of an hours/minutes changeover control circuit used in the second embodiment.

FIG. 16 is a block circuit diagram of hours/minutes changeover control circuit 91. In response to an input signal A from switch control circuit 95, and the flag input signal B from hours/minutes timekeeping function circuit 96, changeover designation circuit 250 outputs signals which initiate mode and terminate mode changeover, and which are applied to operation selection circuit 252. Depending upon the status of switch control circuit 95, flag circuit 242 and changeover designation circuit 250, operation selection circuit 252 selects mode changeover, time setting, rapid advancement of the hands, or other operations, through control of a drive count control circuit 254. The latter circuit generates forward/reverse drive control signal E, through backlash compensation circuit 258. Count control circuit 254 also applies count pulses D to hours/minutes timekeeping function circuit 96. The 1 minute pulse generating circuit 256 generates a set of three pulses for each "click" of crown 68 when alarm time setting is being performed, for thereby producing drive pulses to advance minutes hand 64 in steps of one minute each, as described hereinabove. Output signals from backlash compensation circuit 258, which provide backlash compensation in the event of reverse rotation of the minutes hand 64, are applied to first motor drive circuit 208, which responds by generating drive pulses applied to first stepping motor 210.

Figure 17:
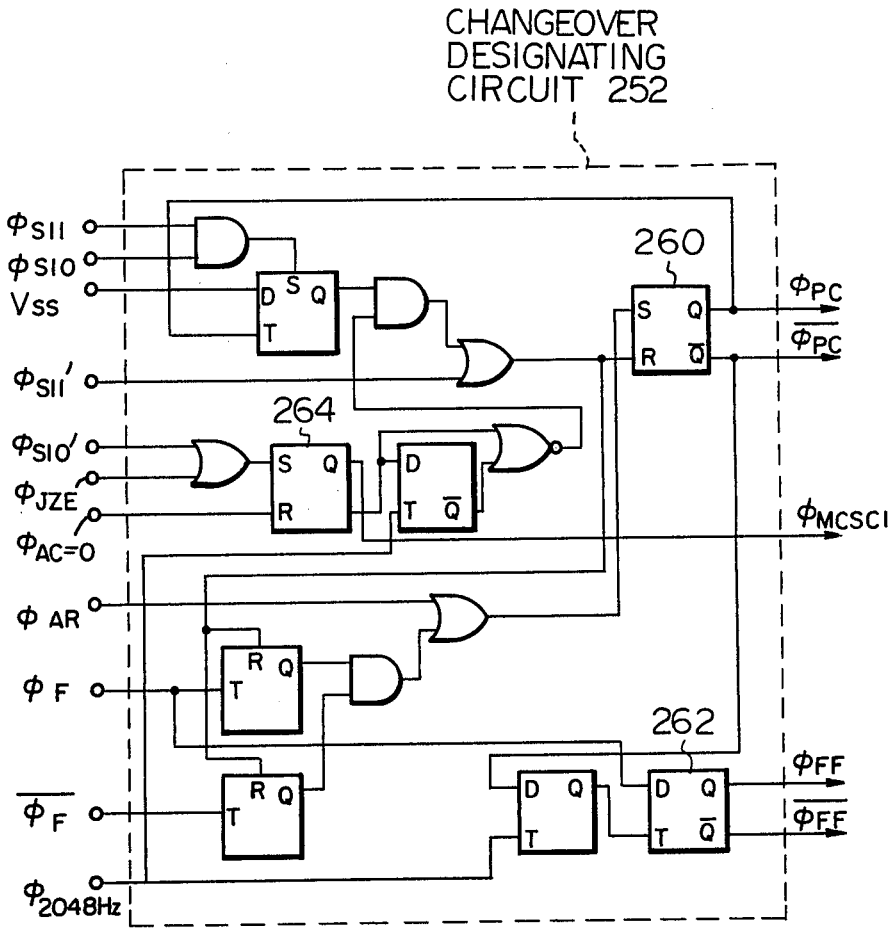
FIG. 17 is a circuit diagram of a changeover designating circuit in the hours/minutes changeover control circuit of the second embodiment.

FIG. 17 is a circuit diagram of changeover designating circuit 252. This produces signal $\phi$PC, which is reset to the L level in response to signal $\phi$S11' or signal $\phi$AC=0, whereby mode changeover is started. Signal $\phi$PC is set to the H level when flag signal $\phi$F is inverted twice in succession, and acts to terminate mode changeover. Signal $\phi$FF indicates whether mode changeover is to be performed by forward or reverse rotation of the hours and minutes hands 64 and 66, and memorizes the state of flag signal $\phi$F when mode changeover is initiated. Signal $\phi$MCSC1 is also produced by changeover designating circuit 252, and is used in post-processing performed after current time or alarm time setting. When signal ϕMCSC1, output from FF264, is at the H level, the post-processing is initiated, and is terminated when signal ϕMCSC1 goes to the L level in response to input signal ϕAC=0.

Figure 18:
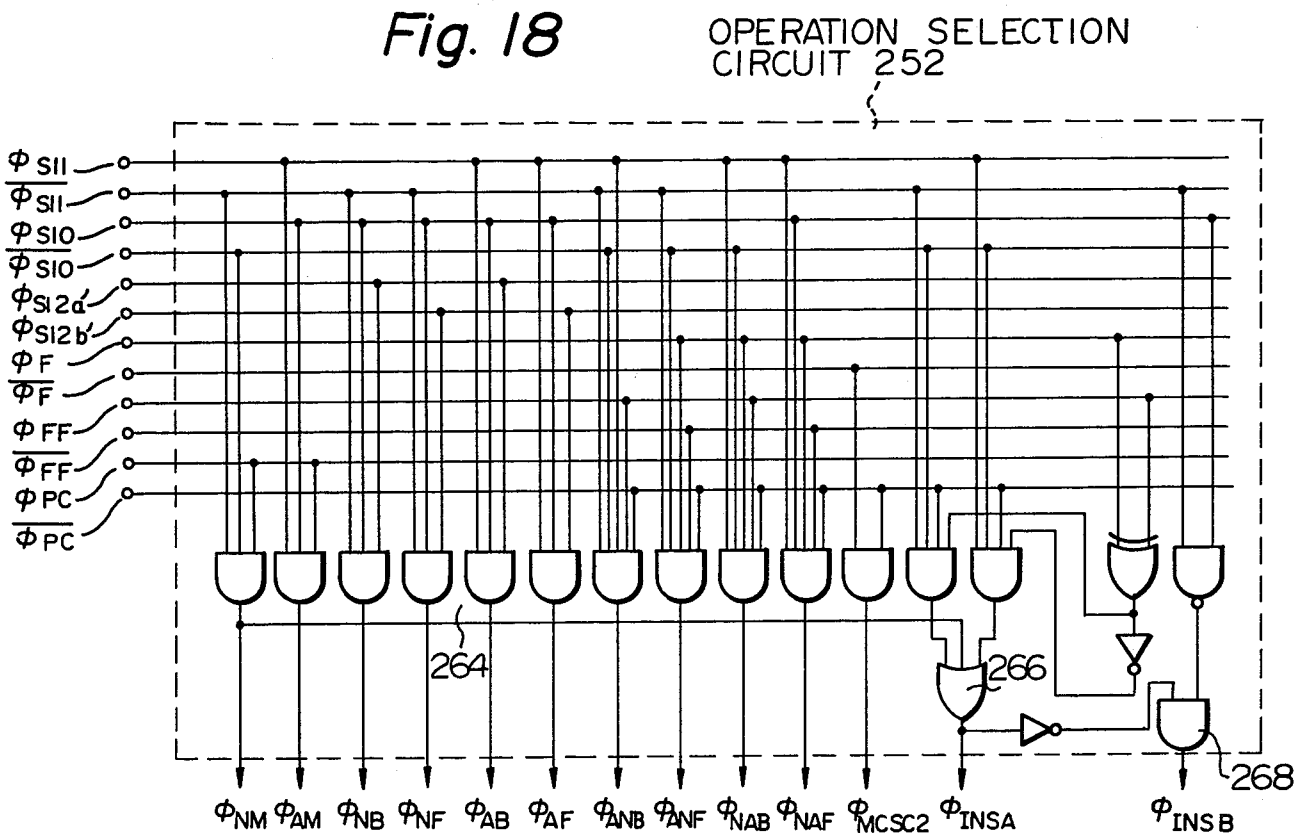
FIG. 18 is a circuit diagram of an operation selection circuit in the second embodiment.

FIG. 18 is a circuit diagram of operation selection circuit 252. The output signals from this circuit go to the H or L level in dependance upon the closed or open conditions of switches 220, 224, and 226, and the states of signals ϕF, ϕFF and ϕPC. The conditions designated by the H level status of each of the output signals from operation selection circuit 252 are as follows. Signal ϕNM indicates that the timepiece is in the current time mode. Signal ϕAM indicates that the timepiece is in the alarm time display mode. Signals ϕNB and ϕNF designate reverse rotation and forward rotation respectively of the hours and minutes hands during correction of current time. Signals ϕAB and ϕAF′ designate rotation of the hours and minutes hands in the reverse and in the forward directions respectively, during alarm time setting. Signals ϕANB and ϕANF indicate reverse and forward rotation of the hours and minutes hands, respectively, are in progress during changeover from the alarm time to the current time display mode. Signals ϕNAB and ϕNAF indicate reverse rotation and forward rotation respectively are in progress, during changeover from the current time to the alarm time display mode. Signal ϕMCSC2 indicates that either pre-processing or post-processing for mode changeover is in progress. Signal ϕINSA indicates when it is possible to initiate an interrupt, to increment the count in the main hours/minutes counter circuit 238 by one, in response to a ϕ1/20 Hz timekeeping signal pulse, simultaneously with driving the minutes and hours hands 64 and 66 by one step. Signal ϕINSP similarly controls operation of an interrupt whereby only the count in main hours/minutes counter circuit 238 are incremented by the timekeeping signal pulse.

Figure 19:
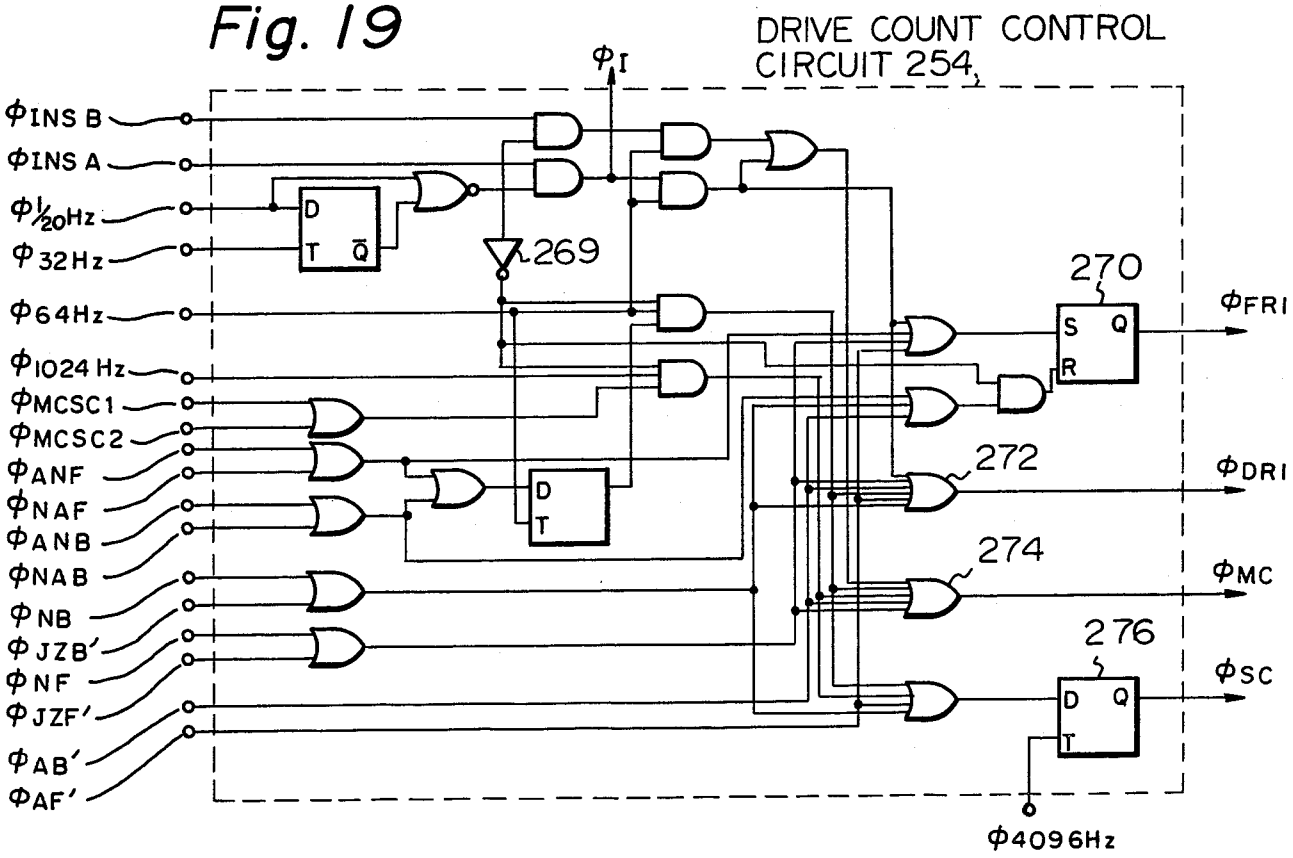
FIG. 19 is a circuit diagram of a drive count control circuit in the second embodiment.

FIG. 19 is the circuit diagram of the drive count control circuit 254. This circuit controls the signals described above which are output from changeover designating circuit 252, and also receives as inputs the ϕ1/20 Hz timekeeping signal, hours/minutes compensating signals ϕJZB′ and ϕJZB′ from a zero reset designating circuit 148, and alarm time setting signals ϕAB′ and ϕAF′ from the 1-minute pulse generating circuit 256. Drive count control circuit 254 produces output signal ϕRF1 from an FF270, which is set to the H level to designate forward rotation of hours and minutes hands 64 and 66 and to the L level to designate reverse rotation. Drive count control circuit 254 also produces output signals ϕDR1, ϕMC and ϕSC from OR gates 272 and 274 and FF276, respectively. ϕDR1 is a trigger pulse signal, synchronized with signal ϕ64 Hz, and will be referred to herein as the uncompensated drive input signal, since as described hereinafter signal ϕDR1 is used to generate a compensated drive input signal, whereby drive signals providing backlash compensation are produced when the hours and minutes hands are rotated in reverse. ϕMC is a count-up signal, applied to the main hours/minutes counter circuit 238, and is synchronized with the ϕ64 Hz or the ϕ1024 Hz clock signal. ϕSC is a count-up signal applied to the secondary hours/minutes counter circuit 243, which is slightly delayed in phase relative to ϕMC.

When timekeeping signal ϕ1/20 Hz causes the input to an inverter 269 to go to the H level, then the output therefrom goes to the L level, and as a result all of the current operations of drive count control circuit 254 are halted. In this condition, if either of signals ϕINSB or ϕINSA is at a level designating an interrupt, then a pulse will be output as signal ϕDR1 and signal ϕMC. When the output of inverter 269 returns to the H level, the previous operations are resumed.

ϕI is an interrupt signal which is applied to backlash compensation circuit 258.

Figure 20:
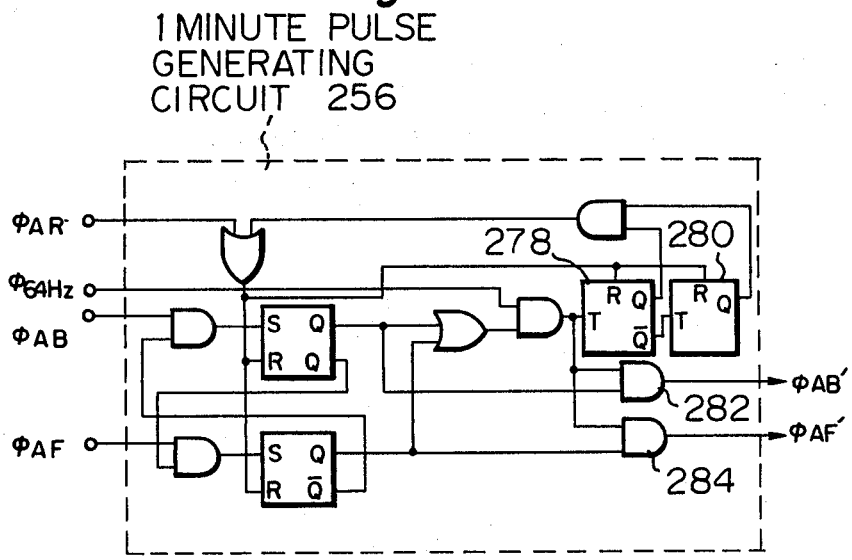
FIG. 20 is a circuit diagram of a 1-minute pulse generating circuit of the second embodiment.
Figure 21:
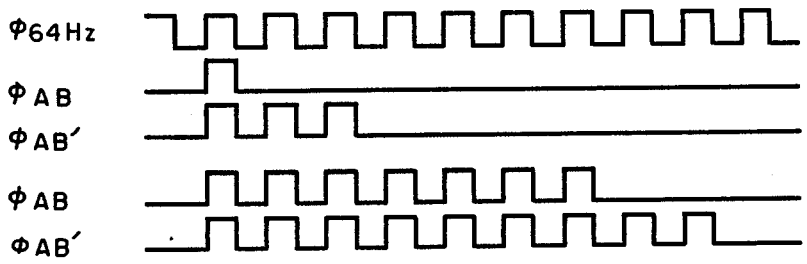
FIG. 21 is a timing diagram for illustrating the operation of the circuit of FIG. 20.

FIG. 20 is a circuit diagram of the 1-minute pulse generating circuit 256, and FIG. 21 is a waveform diagram of that circuit. Each time a pulse of the alarm time setting signal ϕAB or ϕAF is input, three consecutive pulses of signal ϕAB′ or ϕAF′ are output synchronized with the ϕ64 Hz signal, as a result of counting of the latter signal by FF278 and 280. In the case of rapid advancement setting being performed, signal ϕAB′ or ϕAF′ is output synchronized with the ϕ64 Hz signal, as shown in FIG. 21.

Figure 22:
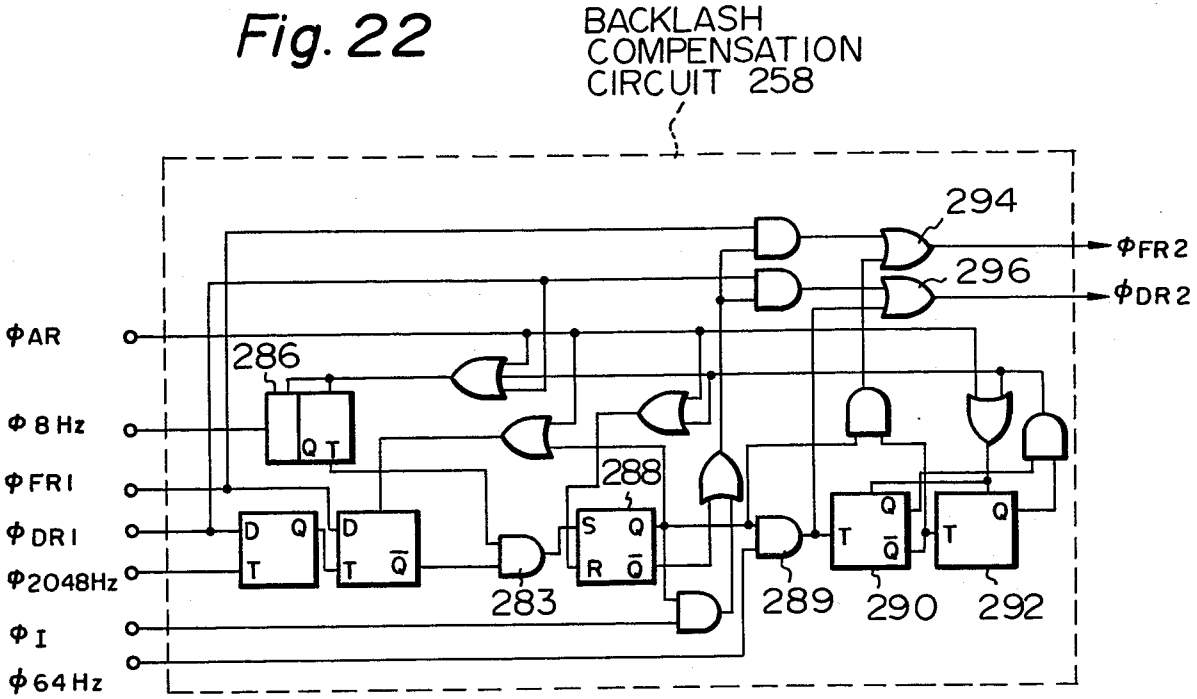
FIG. 22 is a circuit diagram of a backlash compensation circuit in the second embodiment.
Figure 23:
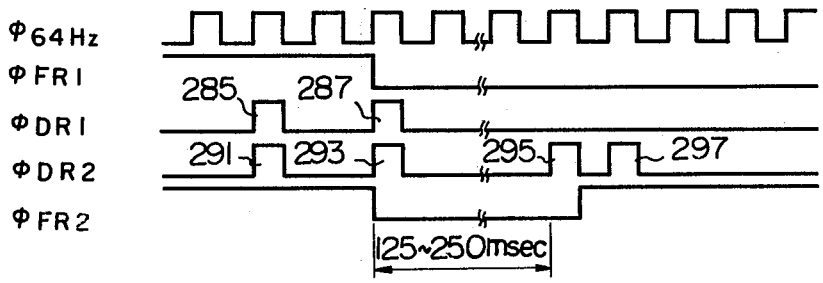
FIG. 23 is a timing chart for illustrating the operation of the circuit of FIG. 22.

FIG. 22 is a circuit diagram of backlash compensation circuit 258, and FIG. 23 is a waveform diagram for that circuit. If crown 68 begins to be rotated in the forward direction, for clockwise rotation setting of the hands, then input signal ϕFR1 of circuit 258 goes to the H level, and one pulse of signal ϕDR1 is input to circuit 258 for each "click" of crown 68. Similarly, signal ϕFR1 goes to the L level in the case of reverse rotation setting, with pulses of signal ϕDR1 being input. As stated above, signals ϕDR1 and ϕFR1 will be referred to as uncompensated drive input signals. In the event of a pulse of signal ϕDR1, such as that denoted by numeral 285 in FIG. 23 being generated with signal ϕFR2 at the H level, then pulse 285 will be transferred through backlash compensation circuit 258 to appear at the output of an OR gate 296 as a pulse 291 of signal ϕDR2. Furthermore, so long as signal ϕFR1 is at the H level, output signal ϕFR2 from an OR gate 294 will be held at the H level. This H level state of ϕFR2 designates to the first motor drive circuit 208 that a single forward rotation drive pulse is to be produced for each pulse of signal ϕDR2.

If on the other hand crown 68 is rotated in the opposite direction, designating reverse rotation setting of the hands, i.e. reverse rotation of first stepping motor 210, then signal ϕFR2 goes to the L level, in response to signal ϕFR1 going to the L level. Again, a pulse, e.g. pulse 293 in FIG. 23, will be output as ϕDR2 in response to each pulse, e.g. 287, of ϕDR1. The first stepping motor 210 will thereafter be rotated in the reverse direction by one step for each pulse of signal ϕDR2. If rapid advancement is being performed, then of course signal ϕDR2 will be output as a train of 64 Hz pulses.

If a certain maximum time elapses after generation of one or more pulses of signal ϕDR1, then the output Qt of a delay counter circuit 286 goes to the H level, whereby, if signal ϕFR1 is at the L level, the output of an AND gate 283 goes to the H level, causing FF288 to enable clock signal ϕ64 Hz to be transferred through an AND gate 289, and hence to be output from OR gate 296 as pulses of signal ϕDR2, e.g. pulses 295 and 297 shown in FIG. 23. After one of these pulses has been output from AND gate 289, the Q output of FF290 acts to set signal ϕFR2 to the H level, thereby designating forward rotation of first stepping motor 210. First stepping motor 210 will be rotated in reverse by one step in response to pulse 295 of ϕDR2. After the second of the ϕ64 Hz pulses has been output from AND gate 289, FF292 output Q acts to reset counter circuit 286, whereby further transfer of $\phi$64 Hz clock signal pulses in inhibited, so that only two pulses of signal $\phi$DR2, e.g. 295 and 297, are generated. Since signal $\phi$FR2 is at the H level when the second pulse 297 of signal $\phi$DR2 is output, first stepping motor 210 will be rotated forward by one step in response to this final pulse. This final forward rotation by one step of first stepping motor 210 acts to eliminate the effects of backlash in the gear wheels of wheel train 211, so that minutes hand 64 will always stop at a predetermined position, after completion of reverse rotation of the minutes and hours hands.

If rapid advancement setting of the hands position by reverse rotation is performed, then after the final pulse of the train of 64 Hz rapid advancement pulses of signal $\phi$DR1, and hence signal $\phi$DR2, have been produced, two pulses of signal $\phi$DR2, designating forward and reverse rotation respectively, will be generated, corresponding to pulses 295 and 297 in FIG. 23, whereby first stepping motor 210 will be rotated successively by a single step of reverse rotation and a step of forward rotation.

Figure 25:
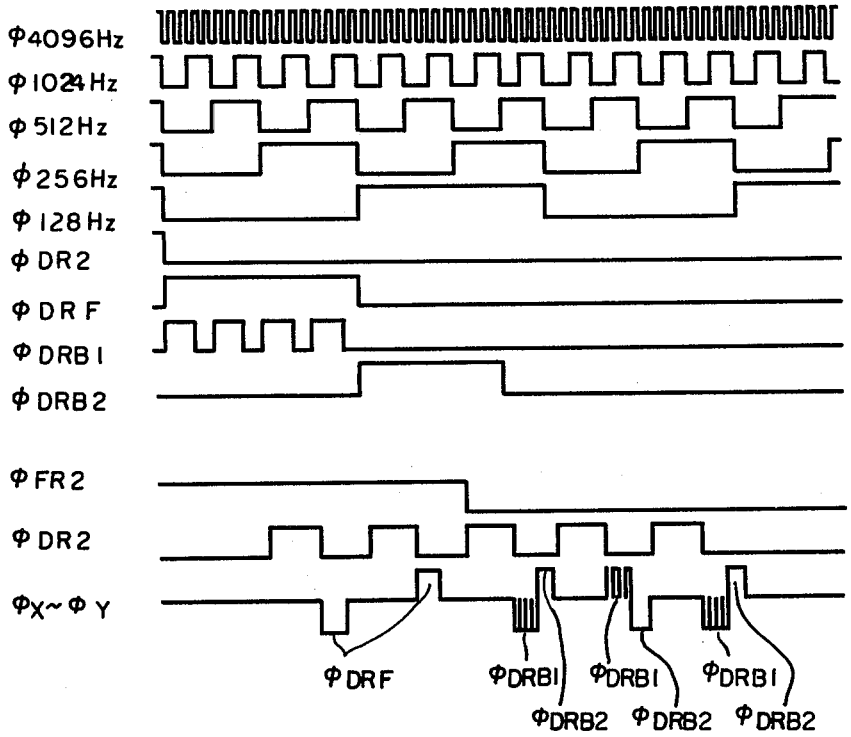
FIG. 25 is a timing chart for illustrating the operation of the circuit of FIG. 24.
Figure 24:
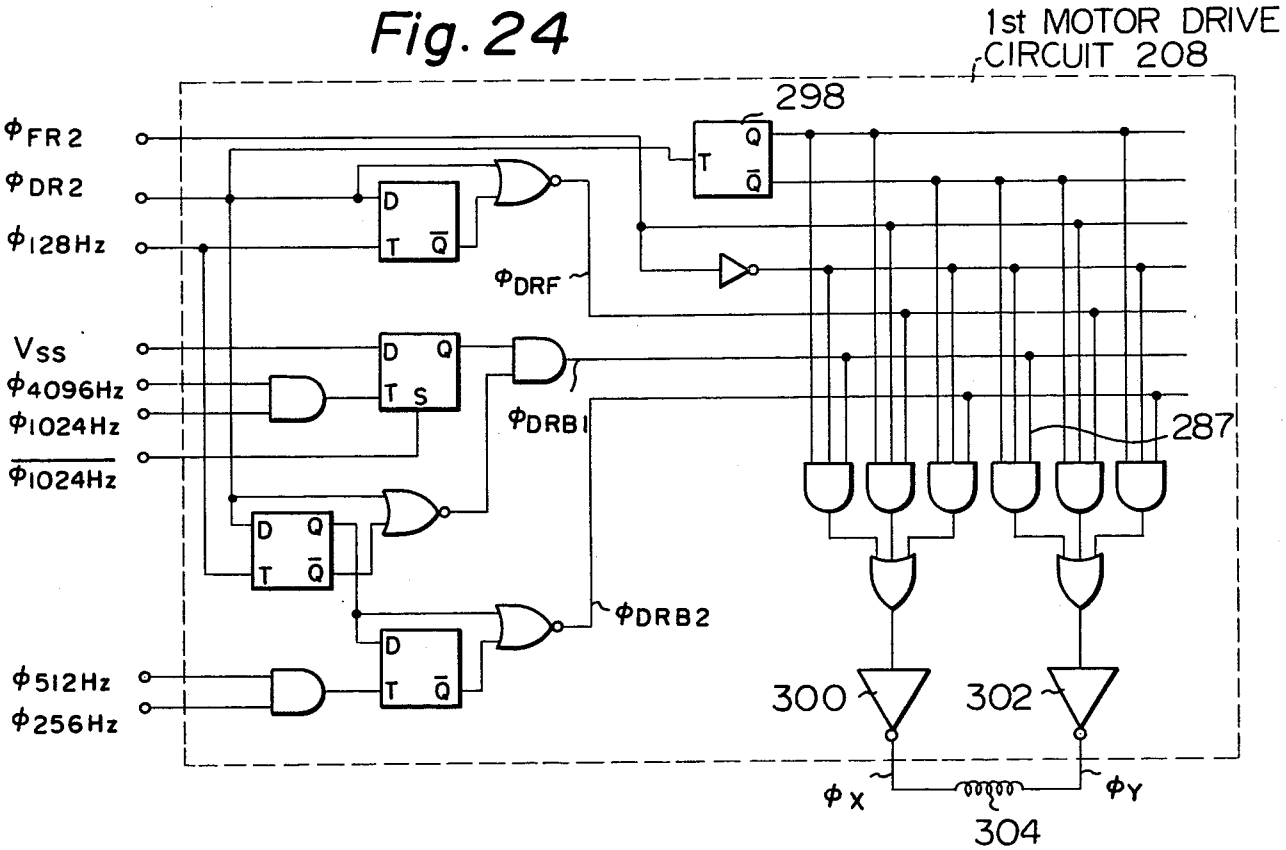
FIG. 24 is a circuit diagram of a first motor drive circuit in the second embodiment.

FIG. 24 is a circuit diagram of first motor drive circuit 208, and FIG. 25 is the waveform diagram of that circuit. As shown in FIG. 25, a pulse of a signal $\phi$DRF is produced upon each falling edge of signal $\phi$DR2, having a pulse width of the order of 3.8 msec, if signal FR2 is at the H level, designating forward rotation of first stepping motor 210. As shown, a forward drive signal pulse ($\phi$X−$\phi$Y) is generated for each pulse of $\phi$DRF, alternating in polarity successively. If signal $\phi$FR2 goes to the L level, designating reverse rotation of first stepping motor 210, then drive signal ($\phi$X−$\phi$Y) is made to comprise successive bursts of high frequency pulses $\phi$DRB1 and pulses $\phi$DRB2, alternating as shown. This method of causing reverse rotation of a stepping motor is well known in the art, and will not be described in detail. Control of the alternation of polarity pulses output from buffer amplifiers 300 and 302 is attained by output signals from a toggle type FF298, acting on an array of gate circuits 287. Numeral 304 denotes the drive coil of first stepping motor 210.

Figure 26:
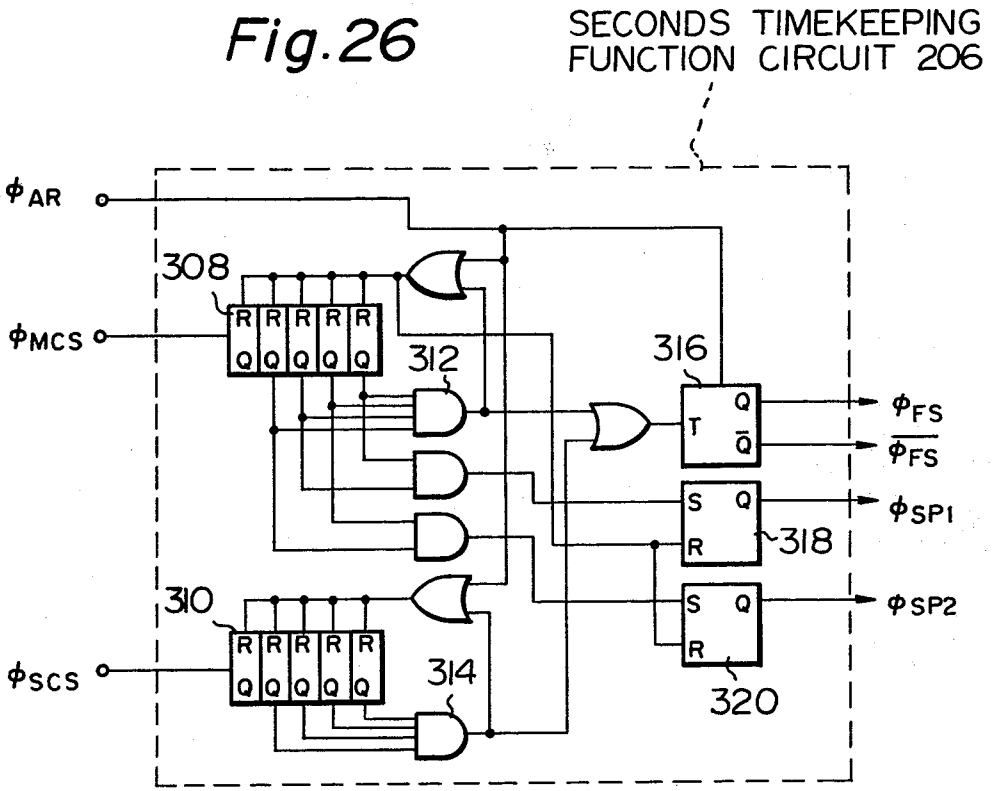
FIG. 26 is a circuit diagram of a seconds timekeeping function circuit used in the second embodiment.

FIG. 26 is a circuit diagram of seconds timekeeping function circuit 206. This circuit memorizes the position of the seconds hand, thereby enabling the seconds hand 67 to be returned to the zero seconds position when changeover from the current time to the alarm time display mode is performed, and to be returned to the current time position when changeover from the alarm time to the current time display mode is performed. It also provides the "one-touch" seconds reset function, whereby the seconds hand 67 is reset to zero seconds while hours and minutes hands 66 and 64 are simultaneously compensated for this shift of seconds hand 67. The basic configuration and operation of this circuit is similar to that of hours/minutes timekeeping function circuit described above. Main seconds counter circuit 308 and secondary seconds counter circuit 310 are each up-counters with a maximum count of 30. When a count of 30 is attained by main second counter circuit 308 or secondary seconds counter circuit 310, then the output of AND gate 312 or 314 respectively goes to the H level, thereby resetting the corresponding counter circuit 308 or 310 to zero. At the same time, the state of a seconds flag signal $\phi$FS is inverted, from the output of FF316. When the contents of main seconds counter circuit 308 reach 10 and 20, then signals $\phi$SP1 and $\phi$SP2 respectively go to the H level. These signals determine the amount and direction of compensating rotation applied to hours and minutes hands 66 and 64 when seconds hand zero reset is performed. The "all reset" signal $\phi$AR acts to reset the main seconds counter circuit 308 and secondary seconds counter circuit 310 contents to zero, and set $\phi$FS to the L level. A count-up signal $\phi$MCS for main seconds counter circuit 308 and count-up signal $\phi$SCS for secondary seconds counter circuit 310 are input from seconds changeover control circuit 204.

Figure 27:
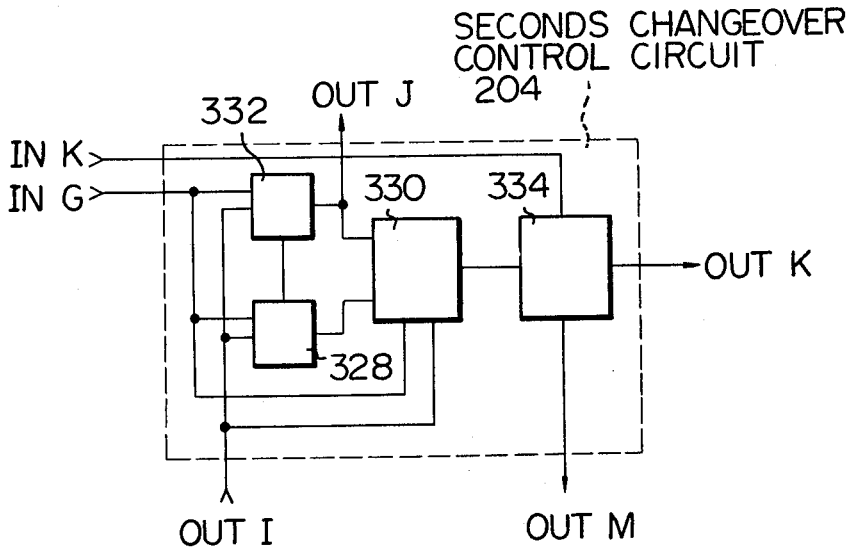
FIG. 27 is a general block circuit diagram of a seconds changeover control circuit used in the second embodiment.

FIG. 27 is a block circuit diagram of seconds changeover control circuit 204. This includes a seconds changeover designation circuit 332, which produces seconds hand changeover start and termination signal under the control of control signal I from seconds timekeeping function circuit 206 and signal G from switch control circuit 95. Seconds changeover designation circuit 332 produces a signal J which designates the amount of compensation applied to the hours and minutes hands positions when zero reset of seconds hand 67 is performed, this signal being also input to seconds operation selection circuit 330. Seconds operation selection circuit 330 performs selection of circuit operations such as mode changeover, seconds hand zero reset, current time advancement of seconds hand 67 by one step per second, etc, in according with input signals G and I and the states of switches 218 to 226. Seconds drive count control circuit 334 produces forward-/reverse drive designating signal K count pulses M which are input to seconds timekeeping function circuit 206.

Figure 28:
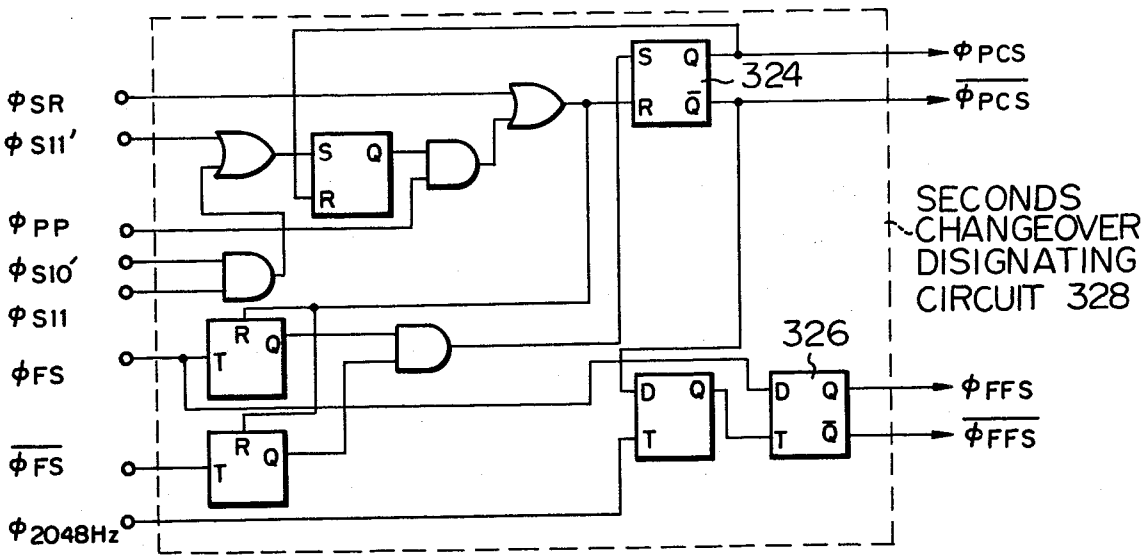
FIG. 28 is a circuit diagram of a seconds changeover designating circuit used in the second embodiment.

FIG. 28 is a circuit diagram of seconds changeover designation circuit 328. Seconds display changeover start signal $\phi$PCS is reset to the L level in response to the seconds zero reset signal $\phi$SR, the mode changeover signal $\phi$S11′, and alarm time setting termination signal $\phi$S10′. When the seconds flag signal $\phi$FS is inverted twice in succession, then signal $\phi$PCS is set to the H level, and changeover termination is thereby designated. Signal $\phi$FSS memorizes the state of seconds flag signal $\phi$FS at the start of changeover of the seconds hand 67 position.

Figure 29:
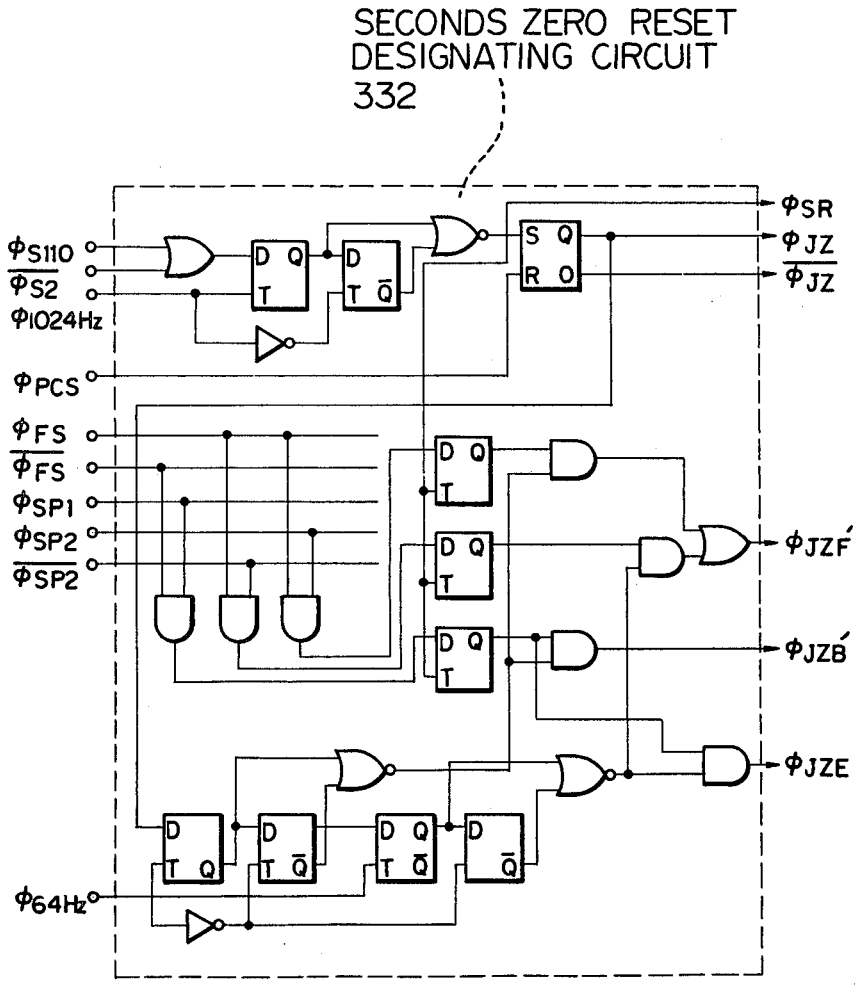
FIG. 29 is a circuit diagram of a seconds zero reset designating circuit used in the second embodiment.

FIG. 29 is a circuit diagram of seconds zero reset designating circuit 332. When output signal $\phi$S110 and $\phi$S2 from switch control circuit 95 are both at the L level, i.e. when both crown 68 and pushbutton 82 are simultaneously depressed, then one pulse of seconds reset signal $\phi$SR is output from circuit 332, signal $\phi$JZ is set to the H level, and thereby causes seconds hand reset operationsa to be performed by seconds changeover designating circuit 322 and seconds operation selection circuit 147. The hours and minutes hands compensation signals $\phi$JZF and $\phi$JZB selectively output in accordance with the states of signals $\phi$FS, $\phi$SP1, and $\phi$SP2, from the seconds timekeeping function circuit 206. The latter signals collectively indicate whether the seconds hand is in the range 0 to 19 seconds, 20 to 29 seconds, 30 to 39 seconds, or 40 to 59 seconds. Signals $\phi$JZF′ and $\phi$JZB′ respectively designate forward rotation and reverse rotation of minutes hand 64 when zero reset of seconds hand 67 is performed, with the minutes hand being rotated by either one step corresponding to 20 seconds (if a single pulse of signal $\phi$JZF′ or $\phi$FZB′ is generated) or by two steps of 20 seconds, i.e. by 40 seconds, (if two pulses of signal $\phi$JZF′ or $\phi$JZB′ are generated). The direction of this compensating rotation of minutes hand 64 depends upon the direction in which seconds hand 67 is rotated when zero reset is performed, with the latter being determined by whether seconds hand 67 is in the range 0 to 30 seconds or 30 to 59 seconds at the instant of zero reset of that hand. In this way, the position of minutes hand 60 (and hence hours hand 66) is accurately compensated for the slight change in the displayed time resulting from reset of seconds hand 67 to the zero position. Thus, for example if the seconds hand 67 is displaying 35 seconds at the instant when zero reset is performed, then two pulses of signal $\phi$JZF' will be output from circuit 332, which will designate both forward rotation of seconds hand 67 to the zero seconds position and also designate that minutes hand 64 is to be advanced by two steps, i.e. by an amount corresponding to 40 seconds. This will therefor compensate to substantial degree for the change in the position of seconds hand 67.

Signal $\phi$JZE goes to the H level upon completion of this hours/minutes hand compensation process, and is input to hours/minutes changeover designation circuit 250.

Figure 30:
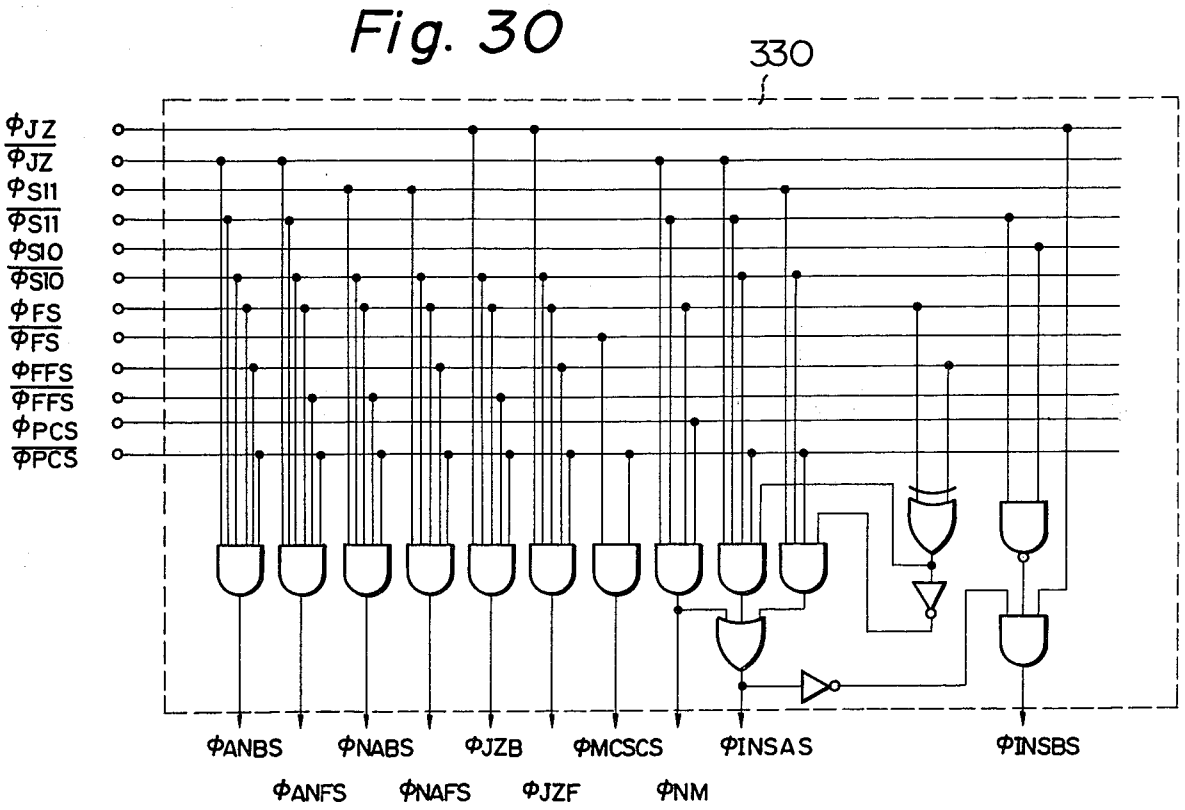
FIG. 30 is a circuit diagram of a seconds operation selection circuit used in the second embodiment.

FIG. 30 is a circuit diagram of seconds operation selection circuit 330. This circuit selects circuit operations relating to seconds hand 67 in accordance with the states of the group of signals $\phi$JZ, $\phi$S11, $\phi$S11, $\phi$FS, $\phi$jFFS and $\phi$PCS, described above, and controls the operation of seconds drive count control circuit 334. Signals $\phi$ANBS and $\phi$ANFS designate changeover from the alarm time to the alarm time display mode by reverse rotation and forward rotation of seconds hand 67, respectively. Signal $\phi$NABS and $\phi$NAFS designate changeover from the current time to the alarm time display mode by reverse rotation and forward rotation respectively of seconds hand 67. Signals $\phi$JZB and $\phi$JZF designate reverse and forward rotation of seconds hand 67 when reset to zero of that hand is performed, as described above. Signal $\phi$MCSCS controls input of count-up signal pulses to the main seconds counter circuit 308 and to secondary seconds counter circuit 310. Signal $\phi$NM designates advancement of seconds hand 67 by one step per second in the current time display mode. Signal $\phi$INSAS is an interrupt control signal which designates advancement of seconds hand 67 by one step in response to the $\phi$1 HZ timekeeping signal, simultaneous with incrementing the count in main seconds counter circuit 308 by one. Signal $\phi$INSBS is an interrupt control signal which designates that only the contents of main seconds counter circuit 308 are to be incremented by one in response to the 1 Hz timekeeping signal.

Figure 31:
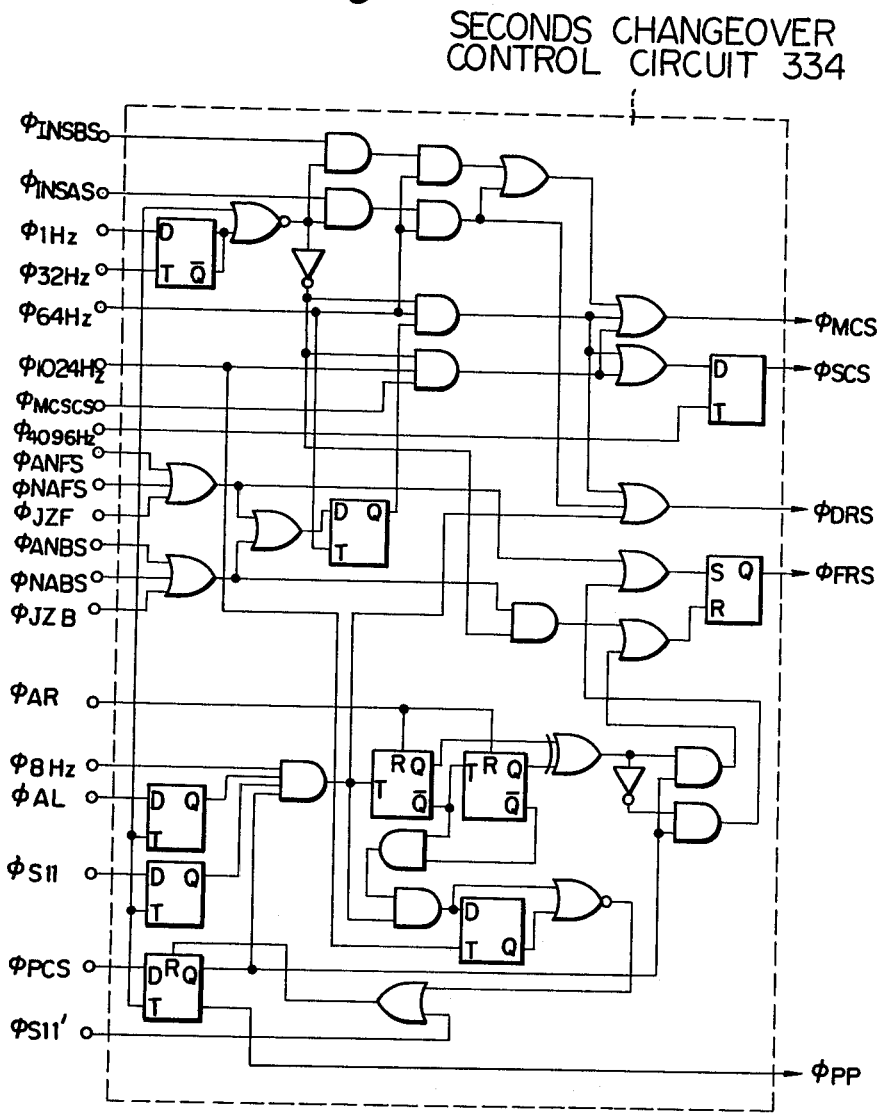
FIG. 31 is a circuit diagram of a seconds changeover control circuit used in the second embodiment.

FIG. 31 is a circuit diagram of seconds drive count control circuit 334. This circuit generates drive trigger pulse signal $\phi$DRS for seconds hand drive, forward-/reverse rotation control signal $\phi$FRS, count-up signal $\phi$MCS for main seconds counter circuit 308, count-up signal $\phi$MCS for secondary seconds counter circuit 310. Count control circuit 334 also includes an alarm on/off indication circuit, which controls signals $\phi$FRS and $\phi$DRS when the alarm time display mode is entered, such that seconds hand 67 is rotated back and forth between the 1 second and 59 seconds positions about the zero seconds position, at a frequency of 8 Hz, if the alarm is in the set condition. This "alarm set" condition is designated by signal $\phi$AL being at the H level. Signal $\phi$PP is output at the H level, unless the latter "alarm set" indicating drive signals are being generated.

Second motor drive circuit 212 is identical to first motor drive circuit 208 described above, and therefore description of circuit 212 is omitted.

Figure 32:
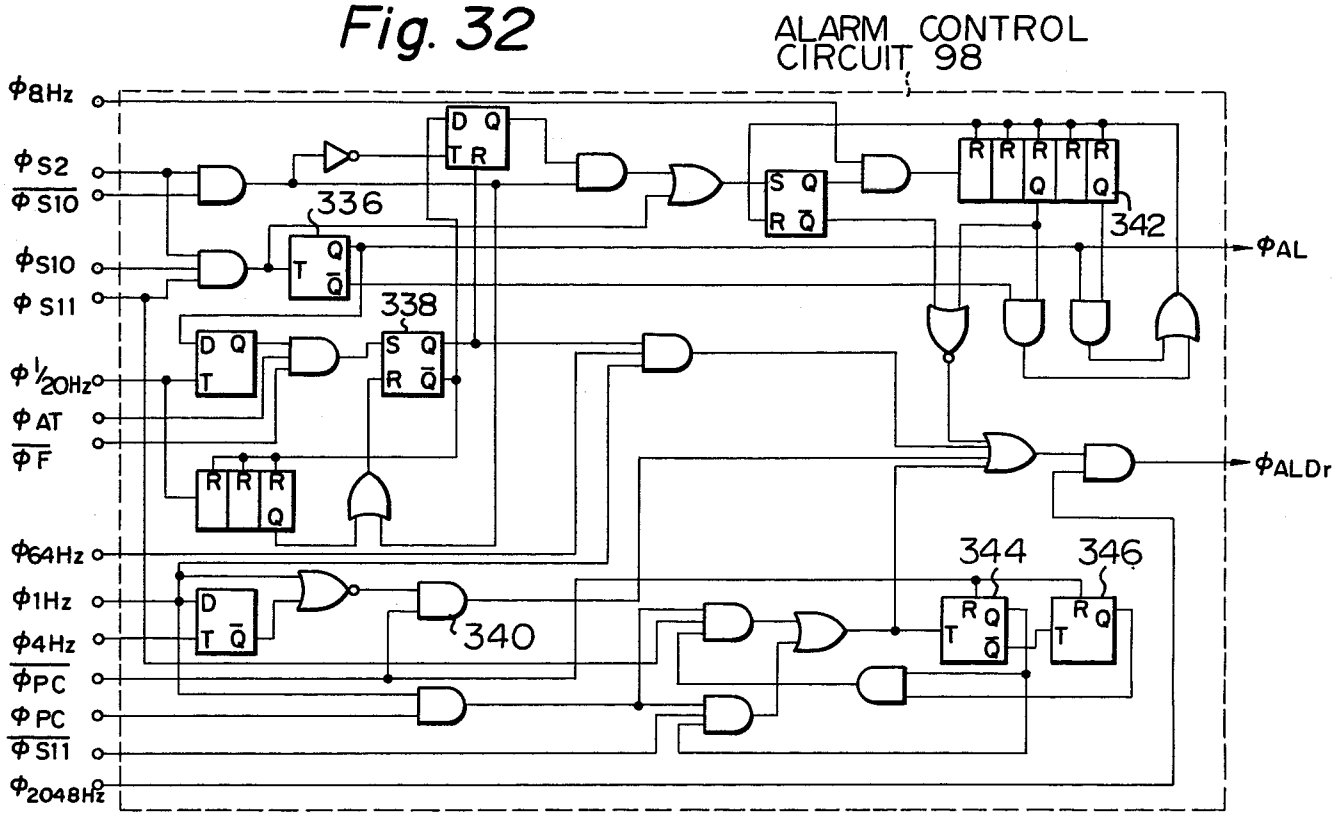
FIG. 32 is a circuit diagram of an alarm control circuit used in the second embodiment.

FIG. 32 shows the circuit of alarm control circuit 98. In this circuit, a flip-flop FF336 serves to memorize whether the timepiece is in the alarm set or alarm cancelled condition, with the current alarm set/cancelled condition being inverted when pushbutton 82 is depressed to thereby generate a pulse of signal SM S2, assuming that the timepiece is in the alarm time setting status so that switch signals $\phi$S10 and $\phi$S11 are both at the H level. When the preset alarm time coincides with the current time, a signal $\phi$AT which is applied to FF 338 goes to the H level, and as a result signal $\phi$ALDr goes to the H level. The H level state of signal $\phi$ALDr serves to actuate alarm device 100 to generate an audible alarm signal. After an interval of one minute has elapsed following this, or if pushbutton 82 is actuated to thereby generate a pulse of signal $\phi$S2, FF 338 will be reset and the audible alarm signal is terminated. A counter circuit 342 causes signal $\phi$ALDr to generate an alarm ON/OFF indication monitor tone signal, in response to signal $\phi$S2 alone being set to the H level by depressing pushbutton 82. In this case, if signal AL is at the H level, then two successive bursts of tone are emitted by alarm device 100, while if signal AL is at the L level then only one tone burst is emitted, thereby indicating the alarm set and alarm cancelled conditions, respectively. During mode changeover, signal $\phi$PC goes to the H level, whereby an output signal from AND gate 340 acts to cause periodic generation of audible tone bursts each with a duration of approximately 125 msec. When mode changeover is terminated, then depending upon the count in the counter circuit comprising FF 344 and 346, a single tone burst will be emitted by alarm device 100 if the timepiece has been set into the current time display mode and three consecutive tone bursts will be emitted if the alarm time display mode has been entered.

Figure 33:
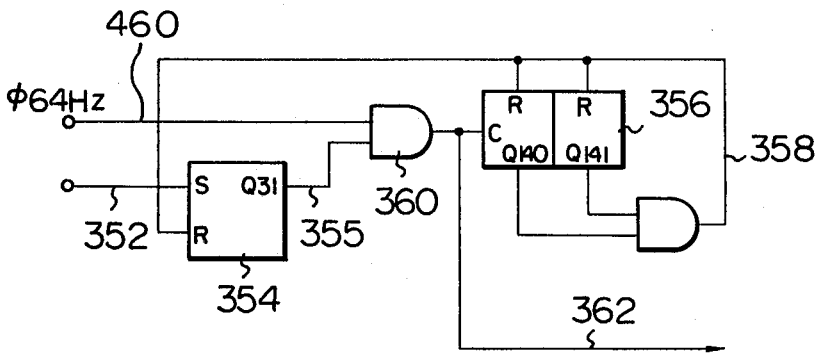
FIG. 33 is a diagram of a circuit for providing rotation of a minutes hand in an analog timepiece according to the present invention in integral steps of one minute each, during setting of an alarm time.

Referring now to FIG. 33, a circuit is shown therein whereby the minutes hand of an analog timepiece according to the present invention, which is normally advanced once every 20 seconds such as in the second embodiment described above, can be advanced by one step corresponding to one minute for each correction signal pulse generated by rotation of crown 68 when setting of the alarm time is performed. This circuit is basically identical to the "1-minute pulse generating circuit" of FIG. 20 above. In FIG. 33, pulses resulting from rotation of crown 68 during alteration of the alarm time, with one pulse being generated for each "click" of the crown during rotation, are input on a line 352, while the 64 Hz clock signal is input on a line 350. Each time an alarm time setting pulse is generated (e.g. each time switch 224 or 226 in FIG. 11 of the above embodiment is closed during the alarm mode), a flip-flop 354 is set, whereby a line 355 goes to the H level, thereby enabling an AND gate 360 to transfer the 64 Hz clock signal pulses to the count input of a counter circuit 356, comprising two binary counter stages. When three pulses of the 64 Hz clock signal have been counted by counter 356, and hence output on a line 362, then a line 358 goes to the H level, whereby counter 356 is reset to zero, and FF 354 is reset to thereby inhibit AND gate 360. Line 362 is connected such that, in the alarm time setting condition, the minutes hand is rotated in the forward or reverse direction by one minute for each pulse appearing on line 362. Thus, as crown 68 is rotated during setting of a new alarm time, the timepiece minutes hand will be advanced by precisely one minute for each switch closure caused by rotation of the crown, i.e. by one minute for each "click" sound produced by rotation of crown 68. During current time display, however, line 362 is isolated from the path whereby drive pulses for the hours/minutes hand stepping motor are generated, and the minutes hand (and hours hand) are then advanced by one step every 20 seconds.

Figure 34:
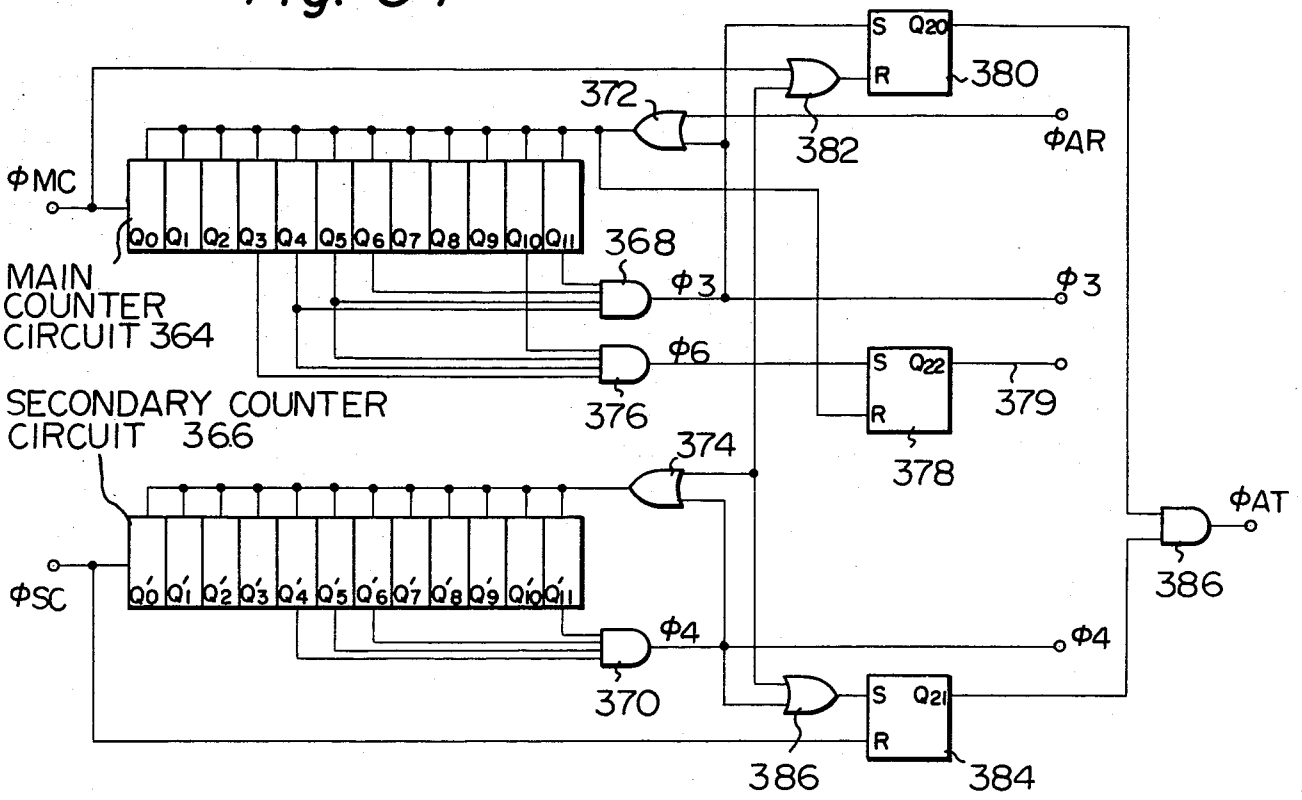
FIG. 34 is a circuit diagram of another example of a timekeeping function circuit which can be used in an analog electronic timepiece provided with an alarm function according to the present invention.

FIG. 34 is a circuit diagram of another example of a timekeeping function circuit suitable for use in an analog electronic timepiece according to the present invention, such as the embodiment of FIG. 3 above. The following description will assume that the circuit of FIG. 34 represents timekeeping function circuit 96 in FIG. 3, but that minutes and hours hands 64 and 66 are advanced once every 20 seconds. In FIG. 34, therefore, the contents of a main counter circuit 364 are advanced three times per minute, so that main counter circuit 364 must count to 2160 (i.e. $3\times60\times12$) over a 12 hour period. Thus, main counter circuit 364 has 12 binary counter stages, as also does a secondary counter circuit 366. Outputs Q4, Q5, Q6 and Q11 of main counter circuit 364 are connected to inputs of an AND gate 123, while similarly the outputs Q4', Q5', Q6' and Q11' of secondary counter circuit 366 are connected to inputs of an AND gate 370. Thus, when a count of 2160 is reached in main counter circuit 364 or secondary counter circuit 366, then the output signal $\phi3$ or $\phi4$ from AND gates 368 and 370 respectively will go to the H level, thereby resetting the count in main counter circuit 364 or secondary counter circuit 366 to zero The count in main counter circuit 364 and secondary counter circuit 366 is also reset to zero when "all reset" signal $\phi$AR, acting through OR gates 372 and 374, goes to the H level. The outputs Q3, Q4, Q5 and Q10 from main counter circuit 364 are input to an AND gate 376. Thus, when the contents of main counter circuit 364 reach 1080, corresponding to 6 hours, output signal $\phi6$ from ANd gate 376 goes to the H level. As a result, output signal Q22 from a set-reset FF 378 goes to the H level, FF 378 is reset when either signal $\phi3$ or signal $\phi$AR goes to the H level. Thus, when the count in main counter circuit 364 is in the range 0 to 1079, then output Q22 is at the L level, while when the count in main counter circuit 364 is within the range 1080 to 2059, then the output Q22 will be at the H level.

A set-reset FF 380 is coupled to be set by signal $\phi3$, and to be reset by signals $\phi$AR or $\phi$MC. Similarly, a set-reset FF 384 is coupled to be reset by signal $\phi$SC and to be set by signals $\phi4$ or $\phi$AR.

This embodiment differs from that of FIG. 15, or that described with reference to FIG. 4 to FIG. 6, in that the main and secondary counter circuits in the latter embodiments each had a maximum count value equivalent to 6 hours, i.e. 360 in the case of a timepiece in which the minutes hand is advanced once per minute, and 1080 in the case of a timepiece in which the minutes hand is advanced once in 20 seconds. In the timkeeping function circuit embodiment of FIG. 34, the maximum count attainable by main counter circuit 364 and secondary counter circuit 366 is equivalent to 12 hours. For this reason, no flag circuit is necessary, since during the current time display mode, the count in main counter circuit 364 directly represents the difference between the current time and a preset alarm time, measured by rotation in the counterclockwise direction on the timepiece dial from the current time to the alarm time. Thus for example if the current time is 6:30 (6 hours 30 minutes) and the count in main counter circuit 364 is 1800, equivalent to 10 hours, then this signifies that the preset alarm time is 8:30. When the current time thereafter becomes 8:30, then this will coincide with the count in main counter circuit 364 reaching 2060, whereby signal $\phi3$ will go to the H level, setting signal Q20 to the H level. At this time signal Q21 will be at the H level, due to FF 384 having been previously set by signals $\phi$AR or $\phi4$, so that signal $\phi$AT will be output at the H level to indicate that the alarm time has been reached, whereby an alarm device will be actuated to emit an audible alarm signal.

The control of input signals $\phi$MC and $\phi$SC to main counter circuit 364 and secondary counter circuit 366 in this embodiment will be slightly different from that described with reference to FIG. 4 to FIG. 6 hereinabove, but is essentially similar. For example, if the contents of main counter circuit 364 correspond to a time difference of less than 6 hours, as indicated by the state of signal Q22, then when changeover from the current time to the alarm time display mode is performed, pre-processing will be performed by simultaneous input of a high-frequency pulse train to main counter circuit 364 and secondary counter circuit 366 until the maximum count is attained by main counter circuit 364. Rapid advancement pulses are thereafter simulataneously input (at a frequency of 64 Hz, for example) to main counter circuit 364 and secondary counter circuit 366 until the count in the latter reaches the maximum value, with rapid advancement pulses being at the same time applied to rotate the hours and minutes hands in the counterclockwise direction, this direction being determined by the state of signal Q22. Similarly, if the contents of main counter circuit 364 correspond to a time difference between current time and alarm time of more than 6 hours, then when changeover from the current time to the alarm time display mode is performed, no preprocessing is necessary, but rapid advancement pulses are input (as signals $\phi$MC and $\phi$PC) simultaneously to main counter circuit 364 and secondary counter circuit 366 until the maximum count is attained by main counter circuit 364, with rapid advancement drive pulses being applied at the same time to rotate the hours and minutes hands in the clockwise direction. Post-processing, by applying high frequency pulses to be counted by the main counter circuit 364 and secondary counter circuit 366 until the count in the latter attains the maximum value, will then be necessary to leave the correct time difference count in main counter circuit 364. In either case, the timepiece hands will now display the preset alarm time. From the above description, it will be understood that the operation of the circuit of FIG. 34 during changeover from the alarm time to current time display mode, and during setting of new values of alarm time, is very similar to that described with reference to FIG. 4 to FIG. 6.

It is a feature of this embodiment that, when the timepiece is set into the current time setting condition, by pulling crown 68 outward while current time is displayed, then a pulse of the "all reset" signal $\phi$AR is automatically generated. As a result, the count in main counter circuit 364 is reset to zero. This has the effect that, when the timepiece is thereafter returned to the current time display mode, then the current time at the instant of return to the latter display mode will be automatically preset as the alarm time. For example, if the timepiece is set in the current time correction status, and the current time is then set to 2:00 and returned to the current time display mode by returning crown 68 to its normal position, then exactly 12 hours later, at 2:00, the count in main counter circuit 364 will reach maximum and be reset to zero. Alarm time coincidence will thereby be detected with signal $\phi$AT going to the H level, causing an audible alarm signal to be emitted. This can be highly convenient to the user, since, by setting the current time indicated by the timepiece in synchronism with some time signal, such as a radio time signal, and choosing the timing of the latter time signal to be that of a required alarm time, then both setting of the current time and setting of the alarm time can be carried out simulaneously.

Figure 35:
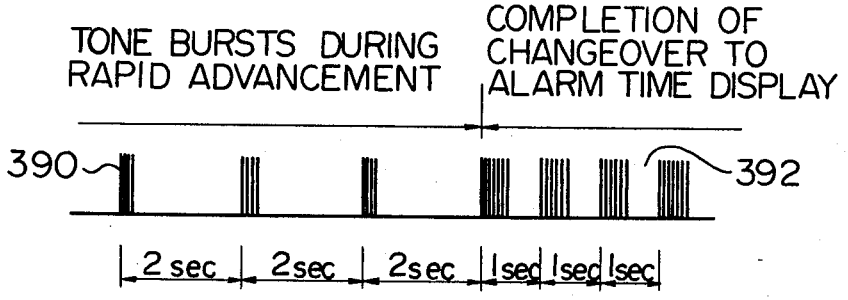
FIGS. 35 and 36 are diagrams for illustrating a method of providing audible indications of changeover between a current time and an alarm time display mode, and indication of the mode which has been entered by such a changeover, for use in an analog electronic timepiece provided with an alarm function according to the present invention.
Figure 36:
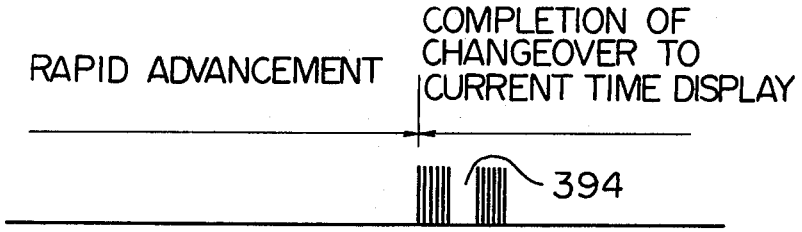

As stated hereinabove, audible indications can be provided with a timepiece according to the present invention, to indicate to the user when changeover between the current time and alarm time display mode is in progress, and to indicate when changeover has been completed. FIG. 35 and FIG. 36 are timing diagrams for illustrating specific examples of such audible indications. In this case, while rapid advancement changeover from the current time to the alarm time display mode is taking place, signals are applied, e.g. from changeover control circuit 90 to alarm control circuit 98 in the embodiment of FIG. 3, whereby consecutive tone bursts are emitted by alarm device 100. In the example of FIG. 35, these tone bursts 390 are at a frequency of 2 KHz, a duration of 250 msec, a repetition period of 2 seconds, and with a duty cycle of 50% for the pulses within each tone burst. Upon completion of changeover to the alarm time display mode, a series of four consecutive tone bursts are emitted by alarm device 100, each tone burst comprising 2 KHz frequency pulses with a 50% duty cycle, and with a period of 1 second between the tone bursts. Each of the tone bursts in this case, denoted by numeral 392, has a duration of 500 msecs.

When rapid advancement changeover from the alarm time to the current time display mode is performed thereafter, then no tone bursts are emitted while changeover is actually taking place. However upon completion of changeover, two consecutive tone bursts, at a frequency of 2 KHz, with a duration of 500 msec, a duty cycle of 50% are emitted, with a period of 1 second between the tone bursts, denoted by numeral 394. In this way, an audible indication is given to the user when rapid advancement changeover between the current time and alarm time display modes is taking place, and also, when changeover has been completed, an audible indication is given of the display mode which has been entered, either current time or alarm time.

Various other combinations of tone bursts other than the example of FIGS. 35 and 36 can be utilized for this purpose. Furthermore, in addition to the means utilized in the latter example for distinguishing between the type of rapid advancement changeover and between the display modes entered, namely by varying the duration of the tone bursts, the period between successive tone bursts, and the presence or absence of tone bursts, various other methods of providing audible differences between these tone indications can be envisaged. For example, the frequencies of tone bursts can be varied to denote different types of changeover and display mode, the amplitude of the tone bursts or the tone quality can be varied, and so on.

Figure 37:
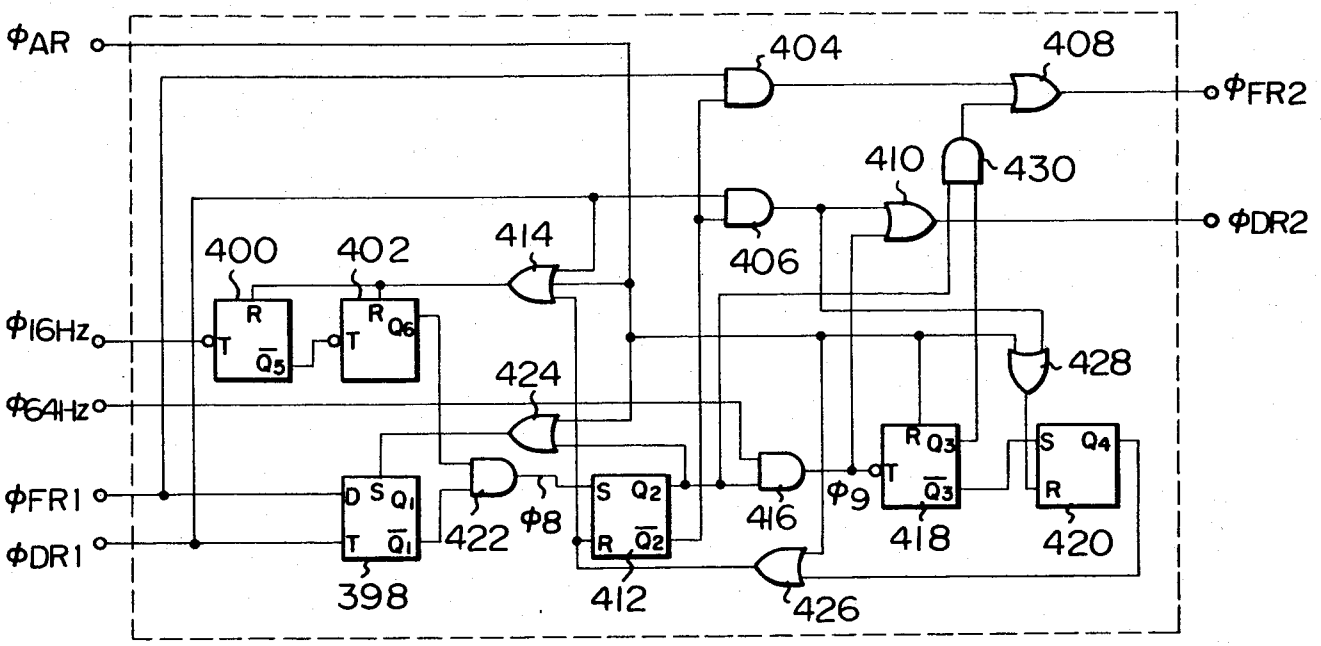
FIG. 37 is a circuit diagram of another example of a backlash compensation circuit usable in an analog electronic timepiece provided with an alarm function according to the present invention.

FIG. 37 is a circuit diagram of another example of a backlash compensation circuit. This is based on the same principles, and has identical functions to backlash compensation circuit 258 shown in FIG. 22 and described hereinabove. The circuit of FIG. 37 comprises three toggle-type flip-flops 400, 402 and 418, a data-type flip-flop 398, two set/reset flip-flops 412 and 420, AND gates 404, 406, 416, 422 and 440, and OR gates 408, 410, 414, 424 and 426, 428. As shown, a 16 Hz clock signal $\phi$16 Hz is applied to the T input of FF 400, with FF 400 and FF 402 being connected to form a counter circuit. The "all reset" signal $\phi$AR and 64 Hz clock signal $\phi$64 Hz are also input to the circuit, together with the drive input signals $\phi$FR1 and $\phi$DR1 which are applied to the data and trigger inputs of FF 398 respectively. As in the embodiment of FIG. 22, forward/reverse designating signal $\phi$FR1 goes to the H level when forward rotation of the hours and minutes hands is designated, and goes to the L level when reverse rotation is designated. Each pulse of signal $\phi$DR1 designates rotation of the hours and minutes hands by one step (corresponding to one minute or an integral submultiple of one minute such as 20 seconds).

The operation of this circuit is as follows. When the timepiece crown 68 is pulled outward to set the timepiece in the current time or alarm time setting condition, as described hereinabove, a pulse of signal $\phi$AR is generated. This acts to set FF398, and to reset the other flip-flops in the circuit. If now crown 68 is rotated such that forward rotation of the hours and minutes hands is designated, then signal $\phi$FR1 goes to the H level, and pulses of signal $\phi$DR1 will be generated. At this time, since output $\overline{Q2}$ of FF 412 is at the H level, signals $\phi$FR1 and $\phi$DR1 are transferred directly through AND gates 404 and 406 and OR gates 408 and 410, to be output as signals $\phi$FR2 and $\phi$DR2 respectively. Thus in the case of forward rotation setting being performed, the circuit of FIG. 37 has no effect upon signals $\phi$FR1 and $\phi$DR1.

If however crown 68 is rotated in the opposite direction, designating counterclockwise rotation of the hours and minutes hands, then signal $\phi$FR1 will go to the L level. FF400 and FF402 are each reset on the rising edge of each pulse of signal $\phi$DR1, while at the same time output $\overline{Q1}$ of FF398 is set to the H level on the first of the $\phi$DR1 pulses. At this time, output $\overline{Q2}$ of FF412 is still at the H level, so that signals $\phi$FR1 and $\phi$DR1 are transferred directly to be output as $\phi$FR2 and $\phi$DR2 respectively. When setting is completed and rotation of crown 68 is halted, so that the pulses of signal $\phi$DR1 are terminated, then the counter circuit comprising FF400 and FF402 begins to count signal $\phi$16 Hz. On the falling edge of the second of these clock pulses, i.e. after approximately 0.125 seconds, output Q6 from FF 402 goes to the H level, whereupon output $\phi$8 from AND gate 422 also goes to the H level, output Q2 from FF412 goes to the H level, and $\overline{Q2}$ goes to the L level. As a result, FF 412 is reset, and AND gates 406 and 404 are inhibited. Since output Q2 of FF 412 is now at the H level, AND gate 416 transfers the $\phi$64 Hz clock pulses, appearing at the output thereof as signal $\phi$9. This passes through OR gate 410 to be output as signal $\phi$DR2. At the same time, the logic level of output Q3 from FF 418 is transferred through AND gate 430 and OR gate 408 to set the state of signal $\phi$FR2. Initially, output Q3 of FF418 is still at the L level, due to the previous $\phi$AR pulse, and remains at the L level until the falling edge of the first pulse of signal $\phi$9. Q3 thereafter goes to the H level, and remains at that level until the falling edge of the second pulse of signal $\phi$9. As a result, following the last pulse of signal $\phi$DR1, i.e. shortly after rotation of crown 68 in the reverse direction is halted, output signals $\phi$FR2 and $\phi$DR2 designate one additional step of reverse rotation of the stepping motor driving the hours and minutes hands, and then one step of forward rotation. In this way, compensation for backlash in the teeth of the wheel train driving the hours and minutes hands is effectively attained, when these hands have been rotated in the counterclockwise direction.

Figure 38:
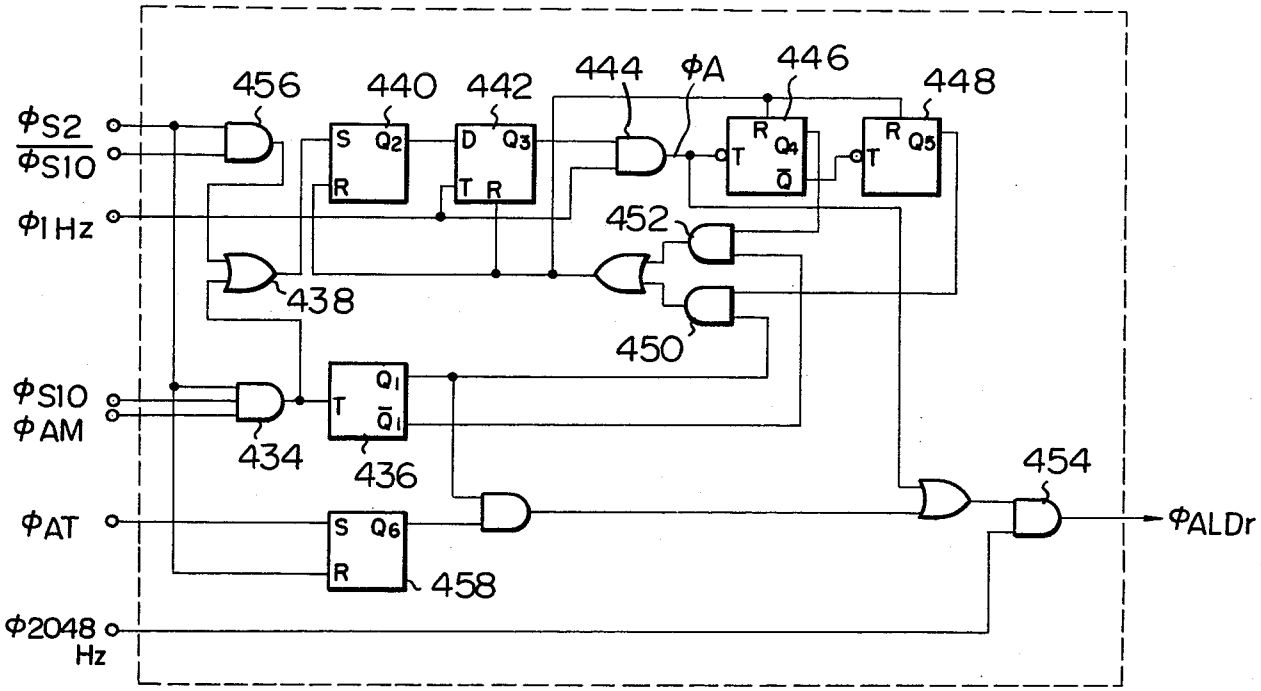
FIG. 38 is a circuit diagram of another example of an alarm control circuit usable in an analog timepiece according to the present invention.

FIG. 38 is a circuit diagram of another example of an alarm control circuit suitable for use in a timepiece provided with an alarm function according to the present invention. This circuit is rather simpler than that of FIG. 32, and serves only to produce output signals for driving the timepiece alarm device to provide audible indications of whether the alarm is in the set or reset condition, and to generate an alarm time coincidence drive signal. The circuit of FIG. 38 receives as inputs signal $\phi$S2 which appears as a single pulse each time a pushbutton, e.g. pushbutton 82 in FIG. 10 and FIG. 11, is depressed. The circuit also receives signal $\phi$S10 which is at the H level while crown 68 is in the normal position, i.e. while the timepiece is in the current time or alarm time display mode, a 1 Hz clock signal $\phi$1 Hz, a 2048 Hz clock signal $\phi$2048 Hz, signal $\overline{\phi S10}$ which goes to the H level when the current time or alarm time setting condition is entered, signal $\phi$AT which goes to the H level during a predetermined time interval when the preset alarm time coincides with the current time, and signal $\phi$AM which goes to the H level when the timepiece is in the alarm time display or setting condition.

The operation of this circuit will now be described. When the alarm time setting condition is established, then both of signals $\phi$S10 and $\phi$AM will go to the H level. As a result, if pushbutton 82 is actuated in this condition, causing a pulse of signal $\phi$S2 to be produced, then this pulse will be transferred through AND gate 434 to the T input of a toggle-type FF436. Thus, the state of FF436 will be inverted. FF436 serves to memorize whether the alarm is in the set or the cancelled status, and therefore corresponds to FF336 in the example of FIG. 32. When output Q1 of FF336 is at the H level, then the alarm is in the set condition, while when output $\overline{Q1}$ is at the H level, the alarm is in the cancelled condition. The output pulse from AND gate 434 will also be transferred through OR gate 438, thereby setting a set/reset FF440, whose output Q2 thereby goes to the H level. The output Q3 of a data-type FF 442 is thereby set to the H level by clock signal $\phi$1 Hz, whereby an AND gate 444 is enabled to transfer the $\phi$1 Hz signal to its output, to appear as signal $\phi$A. FF446 and FF448 are toggle-type flip-flops which are negative-edge triggered. These are connected to form a counter circuit, which counts the pulses of signal $\phi$A from AND gate 444. If it is assumed that signal Q1 from FF436 is changed over from the L to the H level, i.e. that the alarm is now in the set condition, then a reset signal will be output from circuit 450 after the second pulse of signal $\phi$A has been produced. This reset signal will reset FF440, FF442, FF444 and FF448. In addition, the output pulses $\phi$A are combined with the $\phi$2048 Hz clock signal pulses in an AND gate 454, to thereby produce an alarm drive signal $\phi$ALDr. This signal actuates the alarm device of the timepiece to emit two consecutive bursts of tone, thereby providing an audible indication that the timepiece is in the alarm set condition.

If on the other hand output $\overline{Q1}$ of FF436 is changed over from the L to the H level when pushbutton 82 is depressed as described above, then a reset signal will be output from circuit 450 after only one pulse of signal $\phi$A has been output from AND gate 444. As a result, only a single tone burst will be emitted in response to signal $\phi$ALDr, thereby indicating that the timepiece has been placed into the alarm cancelled status. Thus, with the timepiece in the alarm time setting condition, successive actuations of pushbutton 82 will result in successive changeover between the alarm set and the alarm cancelled conditions, with an audible indication being given to the user of the new status each time such a changeover has taken place.

If the timepiece is in the current time or alarm time display mode when pushbutton 82 is depressed, then in this case signal $\overline{\phi S10}$ will be at the H level. Thus, the pulse of signal $\phi$S2 will be transferred through AND gate 456 and hence through OR gate 438. As a result, by the process described above, either two tone bursts of 2048 Hz, to indicate that the alarm is in the set status, or a single tone burst to indicate that the alarm cancelled status has been established, will be emitted by the alarm device of the timepiece in response to signal $\phi$ALDr. However the state of FF436 will not be altered, so that the alarm set or alarm cancelled status will not be changed.

When the alarm time coincides with the current time, then signal $\phi$AT goes to the H level for a predetermined time interval, e.g. one minute. If the alarm is in the set state, so that output Q1 of FF436 is at the H level, then an alarm tone comprising a continuous train of 2048 Hz pulses will be emitted in response to signal $\phi$ALDr. In this condition, if pushbutton 82 is depressed to generate a pulse of signal $\phi$S2, then this pulse will reset FF458, whereby the output Q6 thereof will go to the L level, thereby terminating generating of the alarm tone signal, i.e. setting signal $\phi$ALDr to the H level.

Figure 39:
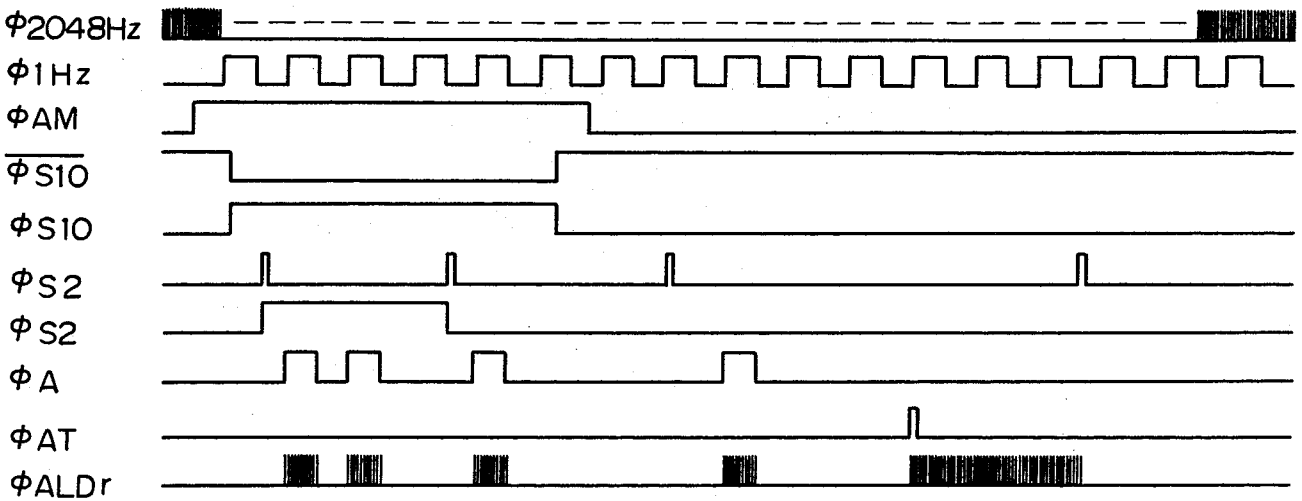
FIG. 39 is a timing chart for illustrating the operation of the circuit of FIG. 38.

The above description will be made more apparent by reference to the waveform diagrams of FIG. 39.

Another embodiment of the present invention will now be described, with reference to FIG. 40 to FIG. 43. An analog type of electronic timepiece equipped with an alarm function is generally provided with a set of minutes graduations, e.g. graduations 464 on analog display 462 of the timepiece embodiment shown in plan view in FIG. 40. Generally, the minutes hand 64 is advanced by steps of less than one minute, in the current time display mode, for example in steps of 20 seconds each, or 10 seconds. With a timepiece provided with an alarm system according to the present invention, as described hereinabove, setting in of a new alarm time is performed by actuation of an external member (i.e. by rotation of crown 68 in this embodiment), whereby the minutes and hours hands 64 and 66 are successively rotated to indicate the desired alarm time, while at the same time pulses are input to the main (i.e. hours and minutes) counter circuit in synchronism with the steps of rotation of the minutes and hours hands. When the timepiece is thereafter changed over from the alarm time setting to the alarm time display mode (e.g. by returning crown 68 from an outward position to a normal inward position, in this and in the previous embodiments), then the contents of the main counter circuit at the instant of changeover will precisely represent the difference between the alarm time which has been set and the current time at that instant. Normally therefore, it will be necessary for the user to position the minutes hand 64 exactly at a particular one of the minutes graduations 464 in order to set in an exact value of alarm time. It is possible to provide circuit means, such as has been described hereinabove with reference to FIG. 33, whereby when the timepiece is in the alarm setting condition, the minutes hand 64 is rotated from one minutes graduation to the next, in synchronism with each rotational "click" made by crown 68. Thus, minutes hand 64 can never become positioned intermediate between two of the graduations 464 in this case, and no problems of alarm time setting accuracy will arise. However if such a method is not adopted, then difficulties can occur. For example, if the user desires to set an alarm time of 3:00 (i.e. 3 hours zero minutes), he may rotate the minutes hand into a position which appears to coincide with the zero minutes graduation mark 466. However if it is assumed that the hours and minutes hands 64 and 66 are advanced in steps of 20 seconds at a time (i.e. 3 times per minute), then in fact the minutes hand 64 may actually be positioned 20 seconds prior to the zero seconds graduation 466, or 20 seconds after it, in which case when the user initiates changeover from the alarm time setting condition to the alarm time display mode, the contents of the main counter circuit of the timekeeping function circuit will correspond to a preset alarm time of 2:59:40 (2 hours, 59 minutes, 40 seconds), or 3:00:20. Thus, the audible alarm signal will thereafter be emitted by the timepiece at a time which differs by 20 seconds from the alarm time which the user desired to set. The user may thereby receive a mistaken impression that the timekeeping accuracy is poor.

Figure 40:
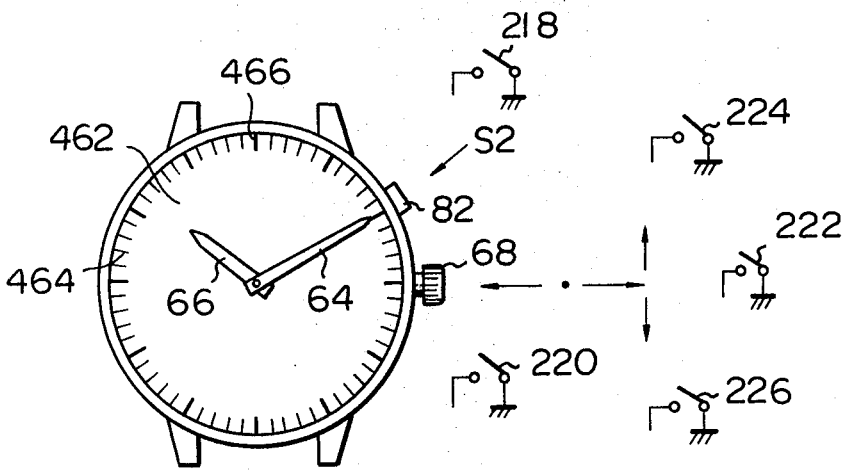
FIG. 40 is a plan view of a third embodiment of an analog electronic timepiece provided with an alarm function alarm function according to the present invention, which incorporates means for ensuring precise timing of generation of an audible alarm tone, irrespective of minor errors in setting the alarm time.
Figure 41:
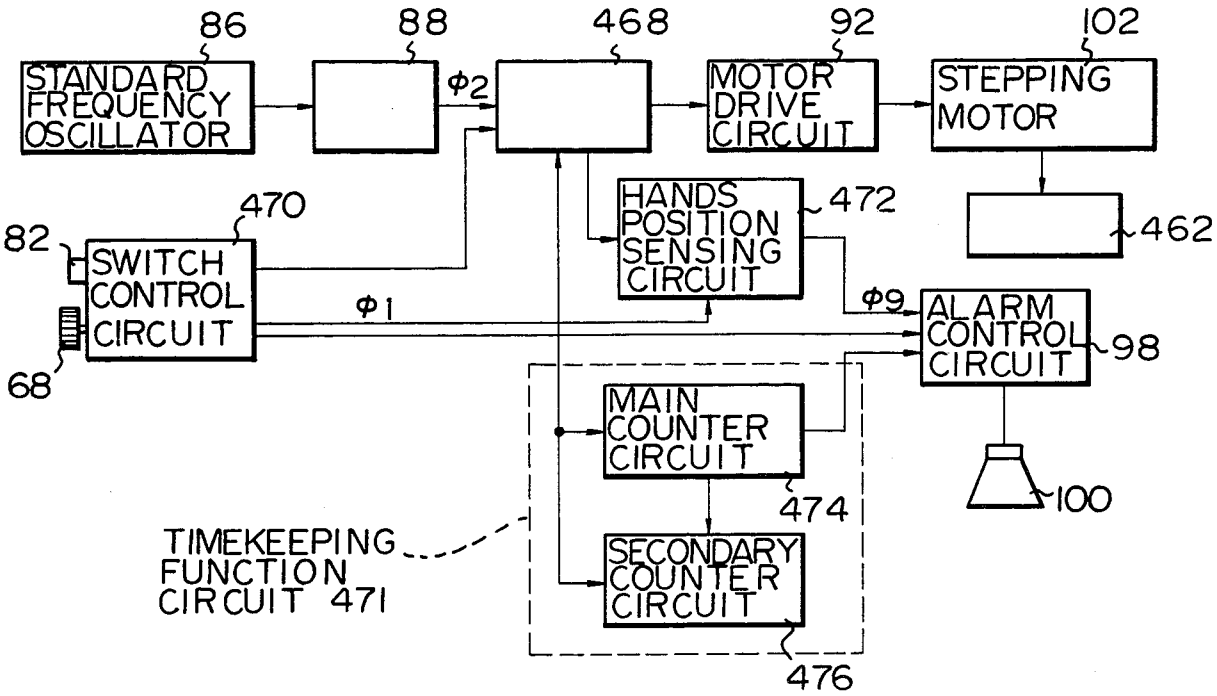
FIG. 41 is a simplified block circuit diagram of the third embodiment.

In this embodiment, the external operating members are identical in construction and function to those of the previously described embodiments, comprising crown 68 and pushbutton 82 as shown in FIG. 40. FIG. 41 is a simplified block circuit diagram of this embodiment, which is basically similar to the previous embodiments, comprising a standard frequency oscillator circuit 86 coupled to a frequency divider circuit 88 which generates a timekeeping signal at a frequency of 1/20 Hz and various clock timing signals. Control of transfer of drive input signals to motor drive circuit 92 is performed by changeover control circuit 468, to thereby rotate stepping motor 102 three times per minute in the current time display mode and by rapid advancement during changeover between the current time and alarm time display modes, with minutes hand 64 and hours hand 66 being rotated correspondingly by motor 102. This embodiment differs from the previous embodiments in having a hands position sensing circuit 472. This includes a counter circuit which is reset to zero when the timepiece is returned from the current time condition to the current time display mode. In this embodiment as in the previous embodiments, minutes hand 64 is always positioned precisely at one of minutes graduations 464 when such a changeover occurs, and since hands position sensing circuit 472 counts the pulses of the 1/20 Hz timekeeping signal (designated herein as $\phi 2$), an output signal $\phi 9$ from circuit 472 indicates each time that minutes hand 64 becomes positioned at a minutes graduation. A corresponding count in main counter circuit 474 of timekeeping function circuit 471 will be referred to as an integral minutes count, i.e. such a count will occur once for every three pulses of signal $\phi 2$, and 60 such counts will occur per hour.

In this embodiment, main counter circuit 474 and secondary counter circuit 476 of timekeeping function circuit 471 each comprises an up-down counter circuit, having a maximum count which corresponds to 12 hours, i.e. a count of 2159, since pulses of timekeeping signal $\phi 2$ are generated at a rate of three per minute. When either of main counter circuit 474 or secondary counter circuit 476 reaches a count of 2160 during up-counting, then it is reset to a count of zero, while after a count of zero has been passed during down-counting the counter contents are reset to 2159. The operation of main counter circuit 474 and main counter circuit 474 is basically as described hereinabove with reference to FIG. 7 to FIG. 9. However in the present embodiment, since each of main counter circuit 474 and secondary counter circuit 476 has a maximum count value corresponding to 12 hours, rather than to 6 hours as in the example of FIG. 7 to FIG. 9, it is not necessary to use a flag signal to control input of count pulses to these counters. During changeover from the current time to the alarm time display mode, for example, if the contents of main counter circuit 474 are more than 1080, representing a time difference of more than 6 hours between the alarm time and current time, then simultaneous up-counting of rapid advancement pulses by main counter circuit 474 and secondary counter circuit 476 is performed in conjunction with rapid advancement of the minutes and hours hands 64 and 66 in the forward direction (i.e. clockwise). If the count in main counter circuit 474 in this case is 1079 or less however, then simultaneous counting down of rapid advancement pulses by main counter circuit 474 and secondary counter circuit 476 is performed (i.e. until a count of zero is reached in main counter circuit 474) together with rotation of minutes and hours hands 64 and 66 in the reverse (i.e. counterclockwise) direction. Similarly, when changeover from the alarm time to the current time is performed, then if the contents of main counter circuit 474 are initially 1080 or more, then rapid advancement up-counting by main counter circuit 474 and secondary counter circuit 476 (i.e. to a count of 2160 in main counter circuit) is performed together with rotation of minutes and hours hands 64 and 66 in the reverse direction. If however the contents of main counter circuit 474 in this case are initially 1079 or less, then down-counting of rapid advancement pulses by main counter circuit 474 and secondary counter circuit 476 is performed together with rotation of minutes and hours hands 64 and 66 in the forward direction.

Figure 42:
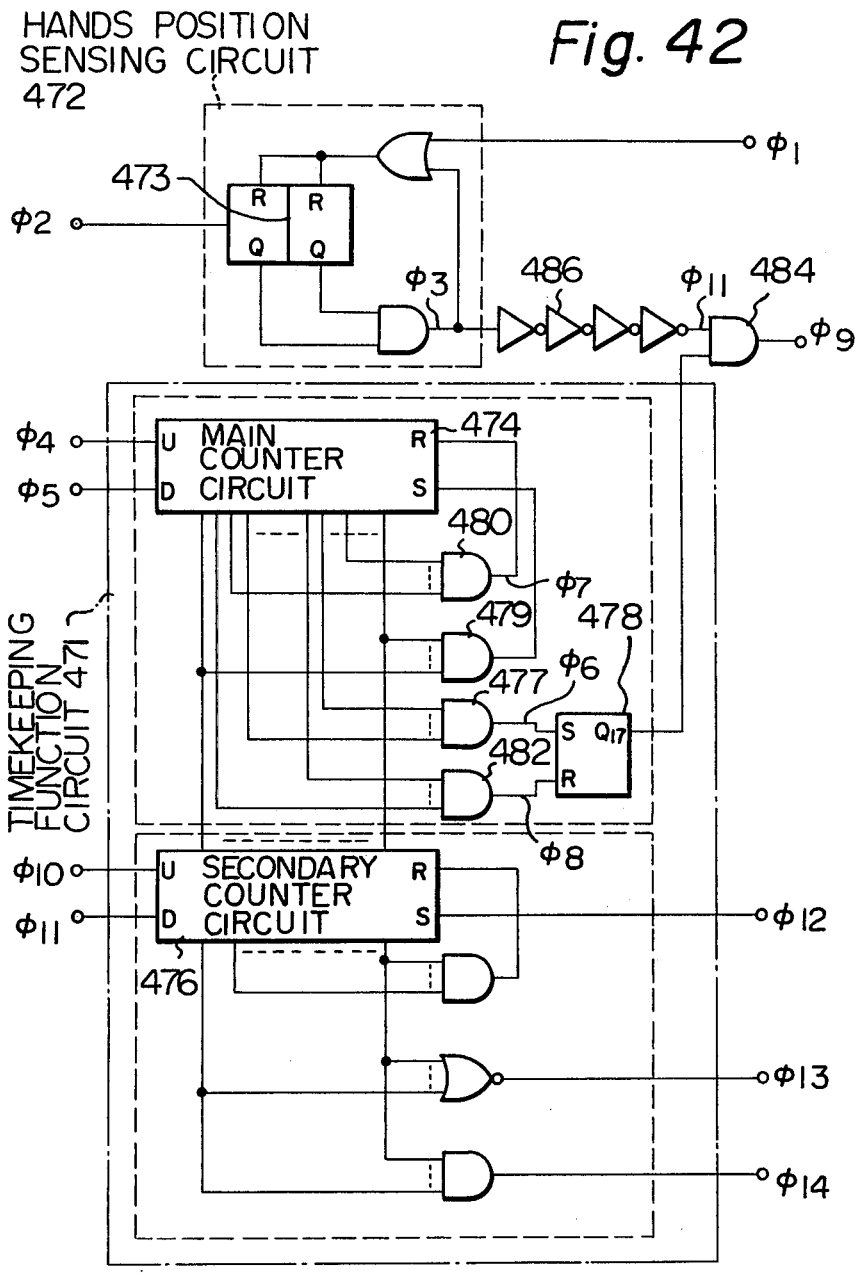
FIG. 42 is a circuit diagram of a hands position sensing circuit and a timekeeping function circuit in the third embodiment.
Figure 43:
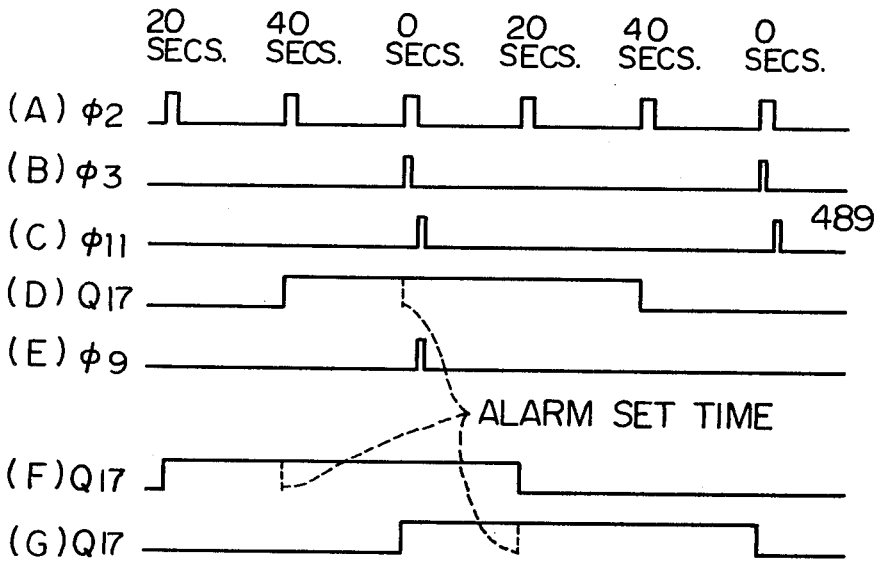
FIG. 43 is a timing chart for illustrating the operation of the circuit of FIG. 42.

FIG. 42 is a circuit diagram of timekeeping function circuit 471 and of hands position sensing circuit 472. FIG. 43 is a waveform diagram for assistance in describing the operation of FIG. 42. As stated above, when changeover from the current time setting state to the current time display mode is carried out, minutes hand 64 is positioned at one of minutes graduations 464 at the instant of changeover, while a signal pulse $\phi 1$ is applied from switch control circuit 470 to hands position sensing circuit 472. This signal pulse $\phi 1$ acts to reset a two-stage counter circuit 473 in hands position sensing circuit 472 to a count of zero. Counter circuit 473 counts pulses of timekeeping signal $\phi 2$, and hence is reset, thereby generating a pulse of signal $\phi 3$, each time minutes hand 64 reaches a minutes graduation, i.e. each time an integral minutes count value is reached in main counter circuit 474. This is shown in FIG. 43, which the "0 seconds" pulses of timekeeping signal $\phi 2$ correspond to these minutes graduation positions of minutes hand 64. As shown in FIG. 43(C), a signal pulse $\phi 11$ is output from delay circuit 486 in response to signal $\phi 3$, after a slight delay, and is input to an AND gate 484.

Counting up and counting down by main counter circuit 474 and secondary counter circuit 476 are performed in response to signals applied to the U and D inputs of these counters respectively, i.e. the signals $\phi 4$ and $\phi 10$ and signals $\phi 5$ and $\phi 11$ shown in FIG. 42. In the current time display mode, as explained hereinabove for the previous embodiments, the up-count input signal $\phi 4$ to main counter circuit 474 will be identical to timekeeping signal $\phi 2$. Each of counter circuits 474 and 476 is reset to a count of zero by an input signal to the R input, and is set to a count of 2059 by a signal applied to the S input. Various count states of main counter circuit 474 are detected by AND gates 477, 479, 480 and 482 as described hereinafter.

The operation of the circuits of FIG. 42 will be described with reference to a specific example of setting an alarm time. It will be assumed that an alarm time of 6:00 has been set at the instant when the current time is 3:00 (3 hours, 0 minutes), so that the time difference between alarm time and current time held in main counter circuit 474 will be 9 hours, i.e. the count value in main counter circuit 474 at the instant of changeover from the alarm time setting condition to the alarm time display mode will be 1620. This value will thereafter be successively incremented, once every 20 seconds, by pulses of timekeeping signal $\phi 2$. When the current time becomes 5:59:40 (i.e. 5 hours, 59 minutes, 40 seconds), then the contents of main counter circuit 474 will become 2159, and this count value will cause the output of AND gate 477, i.e. signal $\phi 6$, to go to the H level. A set-reset FF478 is thereby set, so that output Q17 therefrom goes to the H level. This output is coupled to an input of AND gate 484, which is thereby enabled to transfer signal pulse $\phi 11$ to the output thereof as signal pulse $\phi 9$, as shown in FIG. 44(E). In FIG. 43, pulse 488 of signal $\phi 2$occurs precisely at the current time 6:00, so that an audible alarm signal from alarm device 100 (triggered in response to signal pulse $\phi 9$ by circuit means not shown in the drawings) is initiated almost precisely when minutes minutes and hours hands 64 and 66 reach a current time indication of 6:00.

In the above case it has been assumed that the user correctly set an alarm time of 6:00, and as a result, signal Q17 remains at the H level from a point 20 seconds prior to the "0 seconds" pulse 488 until 40 seconds after that pulse, when the output of AND gate 482 goes to the H level to thereby reset FF478. If on the other hand the user has accidentally misread the position of minutes hand 64 during setting the alarm time, and has accidentally set in an alarm time of 2:59:40, then in this case as shown in FIG. 43 (F), signal Q17 will be set to the H level by the output from AND gate 477 40 seconds prior to the "zero seconds" pulse 488, i.e. when the current time reaches 5:59:20, and will return to the L level 20 seconds after the 6:00 instant. However again, since AND gate 484 will be enabled when the $\phi 11$ signal pulse is generated in response to timekeeping signal pulse 488, an alarm signal trigger pulse $\phi 9$ will be generated precisely at the alarm time of 6:00 in this case also.

Similarly, if the user should accidentally set the alarm time as 6:00:20 (i.e. 20 seconds later than the desired alarm time), then the output from AND gate 477 will set signal Q17 to the H level at the instant when "0 seconds" timekeeping signal $\phi 2$ pulse 488 goes to the H level (i.e. slightly in advance of the $\phi 11$ signal pulse) and Q17 will be reset to zero at the start of the next "0 seconds" pulse of signal $\phi 2$. Thus again, AND gate 484 will be enabled when a $\phi 11$ signal pulse occurs at the alarm time of 6:00, so that the audible alarm signal will be precisely generated at the correct instant. Because of the delay introduced by circuit 486, the next pulse of signal $\phi 11$, designated as 489 in FIG. 43(C), will occur after signal Q17 has returned to the L level, so that AND gate 484 is inhibited and no additional pulse of signal $\phi 9$ is generated at that time.

From the above, it can be understood that with the present embodiment an audible alarm signal is always generated precisely at a preset alarm time, with the timepiece minutes hand aligned with a minutes graduation mark, even if the alarm time has been set with the minutes hand positioned before or after the correct position by one or two hands advancement steps, so that the preset alarm time actually set in is slightly incorrect.

In the embodiment described hereinabove with reference to FIG. 10 and subsequent drawings, the timepiece is provided with a seconds hand 67 in addition to minutes and hours hands 64 and 66, and during changeover from the current time to the alarm time display mode the seconds hand is rapidly rotated to the zero seconds position. For that purpose, a seconds timekeeping function circuit 206, which includes a main counter circuit 208 and secondary counter circuit 310, is utilized. These are in addition to the main counter circuit 238 and secondary counter circuit 243 of the hours/minutes timekeeping function circuit, so that a total of four counter circuits are required for rapid advancement changeover of the seconds, minutes and hours hands positions during mode changeover. In general, with such an arrangement, the number of counter circuits required for the timekeeping function circuits will be 2n, if there are n different functions provided by the timepiece, such as a chronograph function, timer function, etc. However it is also possible to use a single secondary counter circuit in common with a plurality of main counter circuits for a plurality of different functions, by time-sharing operation of the common secondary counter circuit. This would obviously be possible with the embodiment of FIG. 10 described above, since the secondary counter circuits are held at a count of zero except while rapid advancement of the hands, post-processing or pre-processing is in progress. Thus it can be arranged that after the completion of processing involving the common secondary counter circuit in rapid advancement of the seconds hand, during mode changeover, the secondary counter circuit can immediately thereafter be used in processing to rotate the hours and minutes hands into their new positions. This will be made more apparent by the following description of the embodiment shown in simplified block circuit diagram form in FIG. 44.

Figure 44:
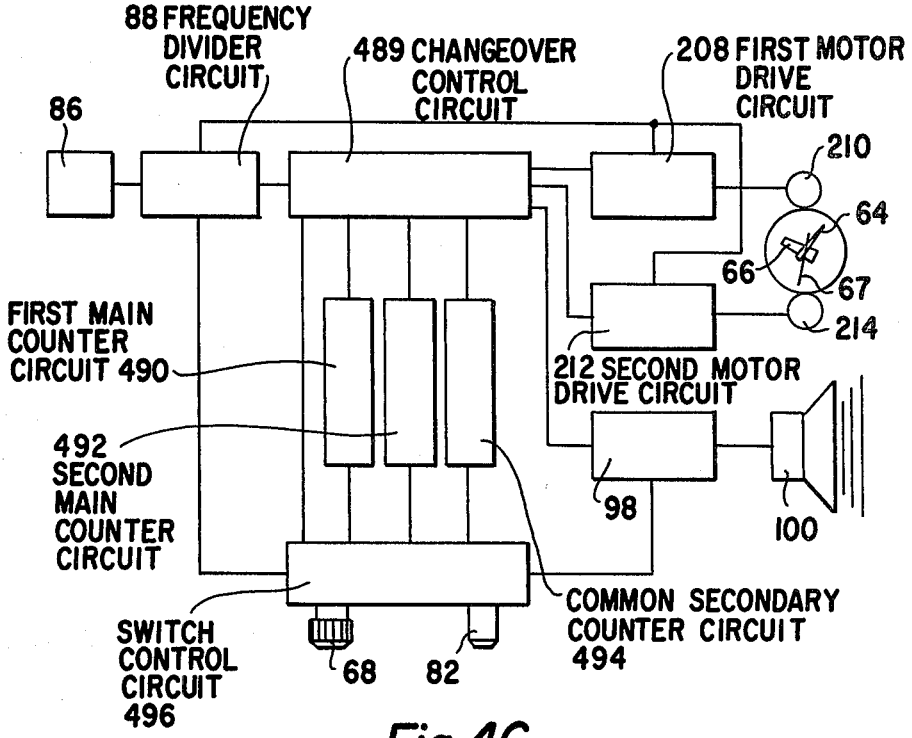
FIG. 44 is a simplified block circuit diagram of a fourth embodiment of an analog electronic timepiece provided with an alarm function according to the present invention, in which a single secondary counter circuit is used in common for rapid advancement rotation of a seconds hand and rapid advancement rotation of hours and minutes hands, upon mode changeover between current time and alarm time displays.

In FIG. 44, circuit blocks and components having identical functions to those of the embodiment of FIG. 10 described above are designated by corresponding reference numerals, and will not be described further. In this embodiment, a 1 Hz timekeeping signal and a 1/60 Hz timekeeping signal, together with various clock timing signals, are generated by frequency divider circuit 88, and applied to a changeover control circuit 49. This circuit applies drive input signals to a first motor drive circuit 208 to rotate a first stepping motor 210, for thereby rotating the hours and minutes hands 64 and 66 of the analog display. Changeover control circuit 489 also applies drive input signals to second motor drive circuit 212, which thereby generates drive signals for second stepping motor 214, for rotating seconds hand 67. When changeover between the current time and alarm time display modes is designated by actuation of crown 68, whereby a changeover designation signal is input to changeover control 489, then this circuit controls the transfer of rapid advancement count pulses into first main counter circuit 490, second main counter circuit 492 and common secondary counter circuit 494. The first main counter circuit 490 and common secondary counter circuit 494 comprise a first timekeeping function circuit, while second main counter circuit 492 in conjunction with common secondary counter circuit 494 comprises a second timekeeping function circuit.

In this embodiment, first main counter circuit 490 is an up-counter circuit having a maximum count value of 720, and is incremented once per minute by the 1/60 Hz timekeeping signal, in the current time display mode. The second main counter circuit 492 has a maximum count of 60, and is incremented once per second by the 1 Hz timekeeping signal during the current time display mode. The first main counter circuit 490 contains a count value representing the time difference between a preset alarm time and the current time. The second main counter circuit 492 contains a count value representing the current position of seconds hand 67. The common secondary counter circuit 494 is an up-counter having maximum count values of 60 and 720, during rapid advancement changeover of the seconds hand and of the hours and minutes hands, respectively, as described hereinafter.

Figure 45:
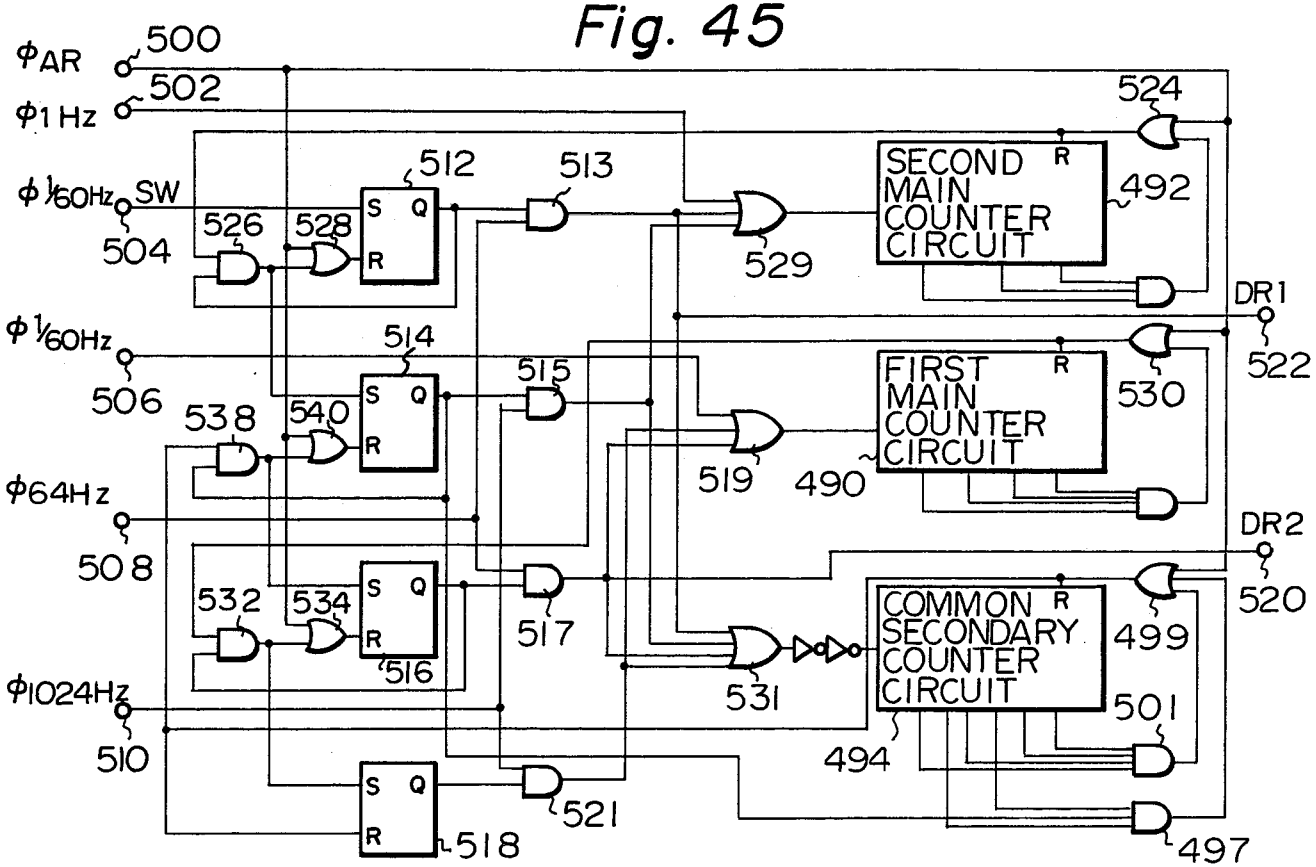
FIG. 45 is a circuit diagram showing the principal components of first and second main counter circuits, a common secondary counter circuit, and a control changeover circuit in the embodiment of FIG. 45.

FIG. 45 is a circuit diagram of the main components of changeover control circuit 489, first main counter circuit 490, second main counter circuit 492 and common secondary counter circuit 494. For brevity, first main counter circuit 490 and second main counter circuit 492 will be referred to hereinafter simply as the minutes counter and the seconds counter respectively. An "all reset" signal $\phi$AL is input on terminal 500, the 1 Hz timekeeping signal $\phi$1 Hz is input on terminal 502, the mode changeover designating signal SW is input on terminal 504, the 1/60 Hz timekeeping signal $\phi$1/60 Hz is input on terminal 506, and the 64 Hz and 1024 Hz clock signals are applied to input terminals 508 and 510 respectively. A group of set-reset flip-flops 512, 514, 516 and 518, with AND and OR gates coupled thereto, constitute the main components of changeover control circuit 489. Output pulses appearing on terminals 520 and 522 respectively during rapid advancement mode changeover are applied as drive input signals to first and second motor drive circuits 208 and 212 respectively, for thereby generating drive signals to rapidly rotate minutes and hours hands 64 and 66, and seconds hand 67 respectively into alarm time or current time display positions.

The operation of the circuit of FIG. 45 will be described for the case of changeover from the current time to the alarm time display mode. If crown 68 is depressed, with the timepiece in the current time display mode, then mode changeover designating signal SW from switch control circuit 496 goes to the H level, thereby setting FF512. AND gate 513 is thereby enabled to transfer the 64 Hz clock signal through OR gate 529 into seconds counter 492 and through OR gate 531 into common secondary counter circuit 494. These clock signal pulses at 64 Hz are therefore counted by seconds counter 492 and common secondary counter circuit 494 while being output from terminal 522, thereby causing rotation of seconds hand 67. If the count value in seconds counter circuit 492 at the start of this mode changeover is assumed to be 37, for example, then 23 pulses of the 64 Hz signal will be output on terminal 522 until the count in seconds counter circuit 492 reaches 60, whereupon the output of OR gate 524 goes to the H level, resetting seconds counter circuit 492 to a count of zero and also causing the output of an AND gate 526 to go to the H level, whereby FF512 is reset. AND gate 513 is thereby inhibited, so that further transfer of the 64 Hz clock signal therethrough is halted. Thus, seconds hand 67 will have been rotated rapidly forward by 23 seconds and then halted, in the zero seconds (12 o-clock) position. This condition of seconds hand 67 indicates that the timepiece is set in the alarm time display mode.

At this time, the H level output from AND gate 526 also acts to set FF514, whose Q output goes to the H level thereby enabling AND gate 515. As a result, post-processing now begins, with the 1024 Hz clock signal being transferred through AND gate 515 and OR gate 529 and OR gate 531 into seconds counter circuit 492 and common secondary counter circuit 494. At the start of this post-processing the count in common secondary counter circuit 494 is 23, and counting is continued until a count of 60 is detected in common secondary counter circuit 494, whereupon the output of AND gate 497 goes to the H level, threby resetting common secondary counter circuit 494 to zero through OR gate 499, and acting through AND gate 538 and OR gate 540 to reset FF514. As a result, the count in seconds counter circuit 492 at the end of this post-processing will be once more 37.

At the instant when FF514 is reset, the output from AND gate 538 also acts to set FF516, whose Q output thereby enables AND gate 517. The 64 Hz signal is thereby transferred through AND gate 517 and OR gate 519 into minutes counter 490 and through OR gate 531 to common secondary counter circuit 494. If the count in minutes counter 490 is assumed to be 700 at the start of mode changeover, for example, then 20 pulses of the 64 Hz clock signal will be output from terminal 520 before minutes counter 490 reaches its maximum count of 720, thereby causing rapid advancement of minutes and hours hands 64 and 66 in the clockwise direction by 20 minutes, to attain positions indicating the preset alarm time. When a count of 720 is reached by minutes counter 490 then the output of OR gate 530 goes to the H level thereby resetting minutes counter 490 and acting through AND gate 532 and OR gate 534 to reset FF516, and to set FF518. AND gate 521 is thereby enabled to transfer the 1024 Hz clock pulses to minutes counter 490 and common secondary counter circuit 494, for post-processing. At this instant, the count in common secondary counter circuit 494 is 20, so that 20 pulses of the 1024 Hz signal will be counted by this counter and minutes counter 490 before common secondary counter circuit 494 reaches a count of 720. An output signal is thereby produced from AND gate 501 which resets common secondary counter circuit 494 to zero, and also resets FF518, thereby terminating transfer of the 1024 Hz signal through AND gate 521. Thus, at the end of this post-processing, minutes and hours hands 64 and 66 are halted at the preset alarm time, while the original count of 700 has been set into minutes counter 490.

From the above it can be understood that with this embodiment, using a common secondary counter circuit 494 in conjunction with a first and a second main counter circuit, initiation of changeover from the current time to the alarm time display mode results in rapid advancement of seconds hand to the zero seconds position to remain halted in that position, and thereafter rapid advancement of the minutes and hours hands 64 and 66 from the current time indicating positions to the alarm time indicating positions. During post-processing the count in common secondary counter circuit 494 is reset to zero after rotation of seconds hand 67 is completed, and thereafter is used in processing for common secondary counter circuit 494 of minutes and hours hands 64 and 66. It will be apparent that changeover from the alarm time to the current time display mode can be performed in a similar manner, and description of this will be omitted.

In this embodiment, as in that of FIG. 10 etc. described above, it is possible to provide an interrupt feature, whereby the contents of seconds counter circuit 492 and minutes counter 490 are incremented by their respective timekeeping signals during changeover between the current time and alarm time display modes, if a timekeeping signal pulse should occur during such changeover, with the rapid advancement processing or post-processing then in progress being momentarily interrupted to permit this updating. Description of the means for providing this interrupt feature have beem omitted for this embodiment.

Figure 46:
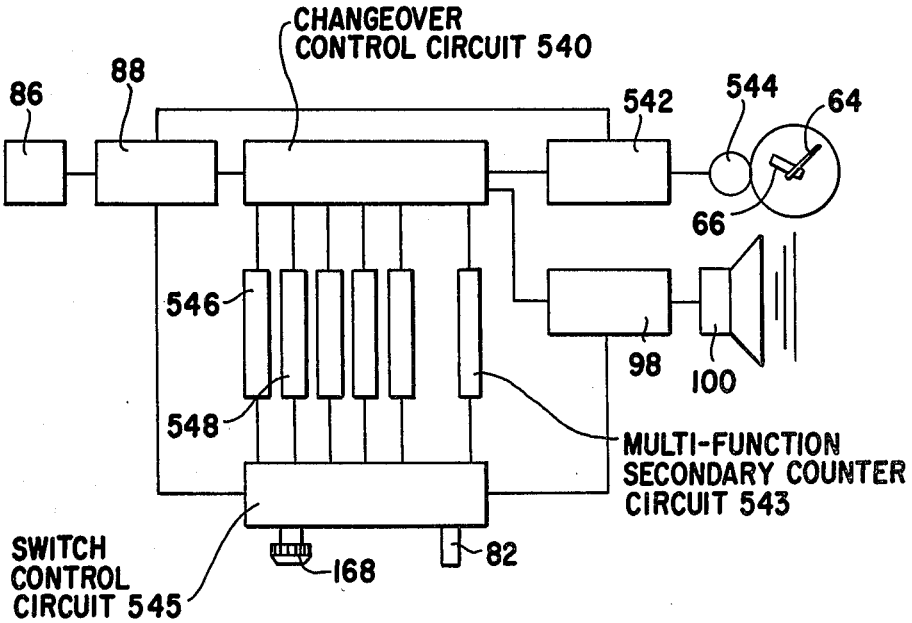
FIG. 46 is a simplified block circuit diagram of an embodiment of an analog electronic timepiece according to the present invention, which is provided with a plurality of main counter circuits for performing a plurality of functions, in conjunction with a signal secondary counter circuit.

FIG. 46 shows another embodiment of the present invention, in simplified block circuit diagram form. In this, a common secondary counter circuit comprising a multi-function secondary counter circuit 543 is used in conjunction with five different main counter circuits. The operating principles of this circuit will be apparent from the description of the preceding embodiment, and will not be described in detail, since it will be apparent that a common secondary counter circuit may be used in conjunction with any number of different main counter circuits, since the contents of the common main counter circuit are always reset to a predetermined value (e.g. zero) upon completion of post-processing operations for a particular main counter circuit. In FIG. 6, numeral 546 denotes a first alarm function main counter circuit, numeral 548 a second alarm function main counter circuit (i.e. to provide a dual alarm time setting capability), numeral 550 a timer function main counter circuit, numeral 552 a chronograph function main counter circuit, and numeral 554 a game function main counter circuit. As in the previous embodiment, rapid advancement drive input signals are applied from changeover control circuit 540 to motor drive circuit 542, when changeover from one function mode to another is designated by actuation of operating members 68 or 82, with the amount and direction of rapid advancement of hands 64 and 66 being determined in accordance with the count held in the corresponding main counter circuit.

It should be noted that the functions available with a multi-function analog electronic timepiece according to the present invention are not limited to time information systems, but can be extended to other types of information, such as temperature, humidity, etc. For all of such functions, relevant data is held in the form of a count value in a corresponding main counter circuit, and is read out by rapid advancement of the timepiece hands into positions indicative of that information (with the timepiece dial being graduated accordingly, if necessary), when mode changeover to that function is designated by actuation of external operating members by the user.

It should also be noted that other methods of utilizing a count value held in a main counter circuit for rapid advancement between a current time and alarm time display mode may be envisaged. For example, in all of the embodiments described hereinabove, the contents of the secondary counter circuit are reset to zero after rapid advancement of the hands and post-processing are completed. However it could for example be arranged that during mode changeover, rapid advancement by the secondary counter circuit alone is performed, synchronously with rapid advancement of the hands, until the count in the secondary counter circuit coincides with that in the main counter circuit. Subsequently, to perform changeover back to the original mode, counting-down of the contents of the secondary counter circuit would be performed in synchronism with rapid advancement drive pulses applied to rotate the hands, until the count in the secondary counter circuit becomes zero.

The basic features of an analog electronic timepiece provided with an alarm system according to the present invention therefore reside in the provision of a secondary counter circuit and at least one main counter circuit, together constituting a timekeeping function circuit, and a changeover control circuit for controlling rapid advancement changeover between the current time and alarm time display modes in accordance with the contents of these main and secondary counter circuits at the start of such mode changeover, the mode changeover being initiated in response to changeover designating signals generated by actuation of externally operable switch means, with the changeover control circuit acting to generate drive input signals whereby at least one stepping motor drive circuit drives a stepping motor into rotation to thereby perform rapid advancement of the timepiece hands from positions corresponding to the mode prior to changeover into positions corresponding to the new mode after changeover. Although the present invention has been described with references to embodiments in which only time information is displayed in each mode, it is equally appplicable to electronic analog timepieces provided with functions for displaying other types of information, such as temperature, etc.

From the preceding description, it will be apparent that the objectives set forth for the present invention are effectively attained. Since various changes and modifications to the above construction may be made without departing from the spirit and scope of the present invention, it is intended that all matter contained in the above description or shown in the accompanying drawings shall be interpreted as illustrative, and not in a limiting sense. The appended claims are intended to cover all of the generic and specific features of the invention described herein.

What is claimed is:

1. An analog electronic timepiece provided with an alarm function, comprising:

an analog display mechanism comprising time indicating hands;

an electro-mechanical transducer coupled to said analog display mechanism for rotating said hands;

transducer drive circuit means for generating drive signals to actuate said transducer to rotate said hands;

a source of a timekeeping signal comprising a pulse train of fixed period and a plurality of timing signals each comprising a pulse train of shorter period than said timekeeping signal;

timekeeping function circuit means comprising at least one main counter circuit for storing a quantity representing the time difference between the current time and a preset alarm time, a secondary counter circuit for counting the number of drive pulses of said electro-mechanical transducer by counting a quantity dependent on a count value of said main counter circuit during a changeover between a current time display mode and an alarm time display mode, and means for generating an alarm indication signal when said quantity becomes zero;

alarm signal generating means for producing an audible alarm signal in response to said alarm indication signal;

externally operable control signal generating means for generating signals to designate changeover between the current time display mode and the alarm time display mode, signals to designate changeover between said current time display mode and a current time setting mode signals to designate changeover between said alarm time display mode and an alarm time setting mode, and further for generating time setting signal pulses; and changeover control circuit means for acting during said current time display mode to transfer said timekeeping signal pulses to an input of said transducer drive circuit means for thereby generating drive pulses to periodically activate said electro-mechanical transducer to advance said time indicating hands and further acting during said current time display mode and said alarm time display mode to transfer said timekeeping signal pulses to be counted by said main counter circuit such that said quantity representing an alarm time difference is periodically decremented, and moreover for acting in response to said signals designating changeover between said current time and alarm time display modes for applying a first one of said timing signal pulse trains to said timekeeping function circuit for processing the contents of said main counter circuit and secondary counter circuit and for transferring to said transducer drive circuit means during said processing a number of said first timing signal pulses corresponding to said alarm time difference, to thereby generate drive pulses for driving said electro-mechanical transducer to rapidly advance said hands into positions corresponding to the display mode designated by said mode changeover designating signals, said changeover control circuit means further acting during said current time setting mode to transfer said time setting signal pulses to said transducer drive circuit for thereby generating drive signals to set a desired indication of current time by said hands, and acting during said alarm time setting mode to transfer said time setting signal pulses to said transducer drive circuit for thereby generating drive signals to set a desired indication of alarm time by said hands while simultaneously transferring said time setting signal pulses to be counted by said main counter circuit for thereby setting said quantity held in said main counter circuit to correspond with said indicated alarm time;

in which said changeover control circuit means is further operative to interrupt transfer of said timing signal pulses to said main counter circuit temporarily and input a pulse of said timekeeping signal to be counted by said main counter circuit during said changeover between the current time and alarm time display modes.

2. An analog electronic timepiece provided with an alarm function, comprising:

an analog display mechanism comprising time indicating hands;

an electro-mechanical transducer coupled to said analog display mechanism for rotating said hands;

transducer drive circuit means for generating drive signals to actuate said motor to rotate said hands;

a source of a timekeeping signal comprising a pulse train of fixed period and a plurality of timing signals each comprising a pulse train of shorter period than said timekeeping signal;

timekeeping function circuit means comprising at least one main counter circuit for storing a quantity representing the time difference between the current time and a preset alarm time, a secondary counter circuit for counting the number of drive pulses of said electro-mechanical transducer by counting a quantity dependent on a count value of said main counter circuit during a changeover between a current time display mode and an alarm time display mode, and means for generating an alarm indication signal when said quantity becomes zero;

alarm signal generating means for producing an audible alarm signal in response to said alarm indication signal;

externally operable control signal generating means for generating signals to designate changeover between the current time display mode and the alarm time display mode, signals to designate changeover between said current time dispaly mode and a current time setting mode, signals to designate changeover between said alarm time display mode and an alarm time setting mode, and further for generating time setting signal pulses; and changeover control circuit means for acting during said current time display mode to transfer said timekeeping signal pulses to an input of said transducer drive circuit means for thereby generating drive pulses to periodically activate said electro-mechanical transducer to advance said time indicating hands and further acting during said current time display mode and said alarm time display mode to transfer said timekeeping signal pulses to be counted by said main counter circuit such that said quantity representing an alarm time difference is periodically decremented, and moreover for acting in response to said signals designating changeover between said current time and alarm time display modes for applying a first one of said timing signal pulse trains to said timekeeping function circuit for processing the contents of said main counter circuit and secondary counter circuit and for transferring to said transducer drive circuit means during said processing a number of said first timing signal pulses corresponding to said alarm time difference, to thereby generate drive pulses for driving said electro-mechanical transducer to rapidly advance said hands into positions corresponding to the display mode designated by said mode changeover designating signals, said changeover control circuit means further acting during said current time setting mode to transfer said time setting signal pulses to said transducer drive circuit for thereby generating drive signals to set a desired indication of current time by said hands, and acting during said alarm time setting mode to transfer said time setting signal pulses to said transducer drive circuit for thereby generating drive signals to set a desired indication of alarm time by said hands while simultaneously transferring said time setting signal pulses to be counted by said main counter circuit for thereby setting said quantity held in said main counter circuit to correspond with said indicated alarm time;

in which during said changeover between alarm time and current time display modes, said first timing signal is transferred to inputs of both said main counter circuit and secondary counter circuit to be counted thereby, with pulses of said first timing signal being applied in synchronism with said counting to an input of said transducer drive circuit means to thereby produce rotation of said time indicating hands, and further comprising circuit means for terminating said counting by said main counter circuit and secondary counter circuit and transfer of said second timing signal pulses to said transducer drive circuit means when a predetermined count value is attained by said main counter circuit.

3. An analog electronic timepiece according to claim 2, in which upon completion of said changeover between said current time and alarm time display modes, said changeover control circuit means acts to perform post-processing of the contents of said main counter circuit and secondary counter circuit by applying a second one of said timing signal pulse trains to be counted by both said main counter circuit and secondary counter circuit, said counter being terminated when a predetermined count value is attained in said secondary counter circuit, whereby a quantity representing said time difference between the alarm time and current time is left in said main counter circuit.

4. An analog electronic timepiece according to claim 3, in which immediately prior to said changeover between said current time and alarm time display modes, said changeover control circuit means acts to perform pre-processing of the contents of said main counter circuit and secondary counter circuit by transferring said second timing signal pulse train to be counted by both said main counter circuit and secondary counter circuit, said counting being terminated when a predetermined count value is attained by said main counter circuit, and in which during said changeover between current time and alarm time display modes, said first timing signal pulses are applied to both said main counter circuit and secondary counter circuit to be counted thereby while also being applied to said electromechanical transducer input for thereby rapidly advancing said hands, said counting being terminated when a predetermined count value is attained by said secondary counter circuit.

5. An analog electronic timepiece according to claim 3 or claim 4, in which the period of said second timing signal pulse train is shorter than that of said first timing signal pulse train.

6. An analog electronic timepiece provided with an alarm function, comprising:

an analog display mechanism comprising time indicating hands;

an electro-mechanical trnasducer coupled to said analog display mechanism for rotating said hands;

transducer drive circuit means for generating drive signals to actuate said motor to rotate said hands;

a source of a timekeeping signal comprising a pulse train of fixed period and a plurality of timing signals each comprising a pulse train of shorter period than said timekeeping signal;

timekeeping function circuit means comprising at least one main counter circuit for storing a quantity representing the time difference between the current time and a preset alarm time, a secondary counter circuit for counting the number of drive pulses of said electromechanical transducer by counting a quantity dependent on a count value of said main counter circuit during a changeover between a current time display mode and an alarm time display mode, and means for generating an alarm indication signal when said quantity becomes zero;

alarm signal generating means for producing an audible alarm signal in response to said alarm indication signal;

externally operable control signal generating means for generating signals to designate changeover between the current time display mode and the alarm time display mode, signals to designate changeover between said current time display mode and a current time setting mode, signals to designate changeover between said alarm time display mode and an alarm time setting mode, and further for generating time setting signal pulses; and changeover control circuit means for acting during said current time display mode to transfer said timekeeping signal pulses to an input of said transducer drive circuit means for thereby generating drive pulses to periodically activate said electromechanical transducer to advance said time indicating hands and further acting during said current time display mode and said alarm time display mode to transfer said timekeeping signal pulses to be counted by said main counter circuit such that said quantity representing an alarm time difference is periodically decremented, and moreover for acting in response to said signals designating changeover between said current time and alarm time display modes for applying a first one of said timing signal pulse trains to said timekeeping function circuit for processing the contents of said main counter circuit and secondary counter circuit and for transferring to said transducer drive circuit means during said processing a number of said first timing signal pulses corresponding to said alarm time difference, to thereby generate drive pulses for driving said electro-mechanical transducer to rapidly advance said hands into positions corresponding to the display mode designated by said mode changeover designating signals, said changeover control circuit means further acting during said current time setting mode to transfer said time setting signal pulses to said transducer drive circuit for thereby generating drive signals to set a desired indication of current time by said hands, and acting during said alarm time setting mode to transfer said time setting signal pulses to said transducer drive circuit for thereby generating drive signals to set a desired indication of alarm time by said hands while simultaneously transferring said time setting signal pulses to be counted by said main counter circuit for thereby setting said quantity held in said main counter circuit to correspond with said indicated alarm time;

in which said time indicating hands comprise a minutes hand and an hours hand mutually coupled to be rotated by said electromechanical transducer;

in which said timekeeping signal source further produces a seconds timekeeping signal pulse train having a period of one second, and further comprising:

a seconds hand;

an electro-mechanical transducer coupled to rotate said seconds hand independently of said hours and minutes hands;

seconds transducer drive circuit means for driving said seconds hand electro-mechanical transducer;

seconds timekeeping function circuit means comprising a main seconds counter circuit for storing a quantity representing the difference between the current time indicating position of said seconds hand and a zero seconds position of said seconds hand, and a secondary seconds counter circuit for counting the number of drive pulses of said electromechanical transducer by counting a quantity dependent on a count value of said main seconds counter circuit during a changeover between said current time indicating position of said second hands and said zero seconds position of said second hand;

seconds changeover control circuit means for acting during said current time display mode to transfer said seconds timekeeping signal pulses to an input of said seconds transducer drive circuit means, for thereby periodically advancing said seconds hand, and further acting during said current time display mode and alarm time display mode to transfer said seconds timekeeping signal pulses to be counted by said main seconds counter circuit such that said quantity representing the difference between the current and zero positions of said seconds hand is successively decremented, and moreover acting in response to said signals designating changeover from the current time to the alarm time display mode to transfer said first timing signal pulses to said seconds timekeeping function circuit for processing the contents of said main seconds counter circuit and secondary seconds counter circuit and for transferring to said seconds transducer drive circuit means during said processing a number of said first timing signal pulses corresponding to said difference between the current time and zero seconds positions of said seconds hand, to thereby generate drive pulses for rapidly advancing said seconds hand to said zero seconds position, and further acting in response to said signals designating changeover from the alarm time to the current time display mode to transfer said first timing signal pulses to said seconds timekeeping function circuit to process the contents of said main seconds counter circuit and secondary seconds counter circuit and for transferring to said seconds transducer drive circuit means during said processing a number of pulses of said first timing signal corresponding to said difference between the current time and zero seconds positions of said seconds hand, for thereby generating drive signals to rapidly advance said seconds hand from the zero second position to the current time indicating position.

7. An analog electronic timepiece according to claim 6, in which said seconds hand electro-mechanical transducer comprises a stepping motor controllable for bidirectional rotation.

8. An analog electronic timepiece according to claim 7, in which during said changeover between the current time and zero seconds positions of said seconds hands, said seconds changeover control circuit means applies signals to said seconds transducer drive circuit for controlling the direction of rotation of said seconds hand such as to minimize the degree of rotation thereof during said changeover, said direction of rotation being determined in accordance with the magnitude of said time difference between the zero seconds and current time positions of said seconds hand.

9. An analog electronic timepiece according to claim 7, in which said control signal generating means is selectively actuatable to generate an alarm set designating signal for designating an operating condition in which said alarm signal generating means is enabled to generate said audible alarm signal in response to said alarm indication signal and an alarm cancel designating signal for designating an operating condition in which said alarm signal generating means is inhibited from generating said audible alarm signal, and in which said seconds changeover control circuit means is responsive to said alarm set designating signal during said alarm time display mode for applying signals to said seconds transducer drive circuit means such as to produce drive signals therefrom which drive said seconds electromechanical transducer to continuously vibrate said seconds hand about said zero seconds position thereof, by a predetermined amount, for thereby providing visible indication of said alarm set operating condition.

10. An analog electronic timepiece provided with an alarm function, comprising:

an analog display mechanism comprising time indicating hands;

an electro-mechanical transducer coupled to said analog display mechanism for rotating said hands;

transducer drive circuit means for generating drive signals to actuate said motor to rotate said hands;

a source of a timekeeping signal comprising a pulse train of fixed period and a plurality of timing signals each comprising a pulse train of shorter period than said timekeeping signal;

timekeeping function circuit means comprising at least one main counter circuit for storing a quantity representing the time difference between the current time and a preset alarm time, a secondary counter circuit for counting the number of drive pulses of said electromechanical transducer by counting a quantity dependent on a count value of said main counter circuit during a changeover between a current time display mode and an alarm time display mode, and means for generating an alarm indication signal when said quantity becomes zero;

alarm signal generating means for producing an audible alarm signal in response to said alarm indication signal;

externally operable control signal generating means for generating signals to designate changeover between the current time display mode and the alarm time display mode, signals to designate changeover between said current time display mode and a current time setting mode, signals to designate changeover between said alarm time display mode and an alarm time setting mode, and further for generating time setting signal pulses; and changeover control circuit means for acting during said current time display mode to transfer said timekeeping signal pulses to an input of said transducer drive circuit means for thereby generating drive pulses to periodically activate said electromechanical transducer to advance said time indicating hands and further acting during said current time display mode and said alarm time display mode to transfer said timekeeping signal pulses to be counted by said main counter circuit such that said quantity representing an alarm time difference is periodically decremented, and moreover for acting in response to said signals designating changeover between said current time and alarm time display modes for applying a first one of said timing signal pulse trains to said timekeeping function circuit for processing the contents of said main counter circuit and secondary counter circuit and for transferring to said transducer drive circuit means during said processing a number of said first timing signal pulses corresponding to said alarm time difference, to thereby generate drive pulses for driving said electro-mechanical transducer to rapidly advance said hands into positions corresponding to the display mode designated by said mode changeover designating signals, said changeover control circuit means further acting during said current time setting mode to transfer said time setting signal pulses to said transducer drive circuit for thereby generating drive signals to set a desired indication of current time by said hands, and acting during said alarm time setting mode to transfer said time setting signal pulses to said transducer drive circuit for thereby generating drive signals to set a desired indication of alarm time by said hands while simultaneously transferring said time setting signal pulses to be counted by said main counter circuit for thereby setting said quantity held in said main counter circuit to correspond with said indicated alarm time;

in which the period of said timekeeping signal is 1/n minutes, where n is an integer, whereby said hands are advanced n times per minute and counting of n pulses per minute is performed by said main counter circuit during said current time display mode, and in which each of said time setting pulses causes rotation of said hands by an amount representing 1/n minutes and a change in the contents of said main counter circuit equivalent to 1/n minutes during said current time setting mode;

in which said control signal generating means further comprises means for generating one alarm time setting pulse in response to n successive ones of said time setting pulses during said alarm time setting mode, said alarm time setting pulses being transferred to said transducer drive circuit means for thereby rotating said hands by an amount representing one minute for every n of said alarm time setting pulses, but in which said main counter circuit contents are varied by n-pulses equivalent to one minute in response to each of said time setting pulses during said alarm time setting mode.

11. An analog electronic timepiece provided with an alarm function, comprising:

an analog display mechanism comprising time indicating hands;

an electro-mechanical transducer coupled to said analog display mechanism for rotating said hands;

transducer drive circuit means for generating drive signals to actuate said motor to rotate said hands;

a source of a timekeeping signal comprising a pulse train of fixed period and a plurality of timing signals each comprising a pulse train of shorter period than said timekeeping signal;

timekeeping function circuit means comprising at least one main counter circuit for storing a quantity representing the time difference between the current time and a preset alarm time, a secondary counter circuit for counting the number of drive pulses of said electromechanical transducer by counting a quantity dependent on a count value of said main counter circuit during a changeover between a current time display mode and an alarm time display mode, and means for generating an alarm indication signal when said quantity becomes zero;

alarm signal generating means for producing an audible alarm signal in response to said alarm indication signal;

externally operable control signal generating means for generating signals to designate changeover between the current time display mode and the alarm time display mode, signals to designate changeover between said current time display mode and a current time setting mode, signals to designate changeover between said alarm time display mode and an alarm time setting mode, and further for generating time setting signal pulses; and changeover control circuit means for acting during said current time display mode to transfer said timekeeping signal pulses to an input of said transducer drive circuit means for thereby generating drive pulses to periodically activate said electromechanical transducer to advance said time indicating hands and further acting during said current time display mode and said alarm time display mode to transfer said timekeeping signal pulses to be counted by said main counter circuit such that said quantity representing an alarm time difference is periodically decremented, and moreover for acting in response to said signals designating changeover between said current time and alarm time display modes for applying a first one of said timing signal pulse trains to said timekeeping function circuit for processing the contents of said main counter circuit and secondary counter circuit and for transferring to said transducer drive circuit means during said processing a number of said first timing signal pulses corresponding to said alarm time difference, to thereby generate drive pulses for driving said electro-mechanical transducer to rapidly advance said hands into positions corresponding to the display mode designated by said mode changeover designating signals, said changeover control circuit means further acting during said current time setting mode to transfer said time setting signal pulses to said transducer drive circuit for thereby generating drive signals to set a desired indication of current time by said hands, and acting during said alarm time setting mode to transfer said time setting signal pulses to said transducer drive circuit for thereby generating drive signals to set a desired indication of alarm time by said hands while simultaneously transferring said time setting signal pulses to be counted by said main counter circuit for thereby setting said quantity held in said main counter circuit to correspond with said indicated alarm time;

in which during said current time setting mode, said control signal generating means are further actuatable for generating an "all reset" signal, said "all reset" signal acting to set said main counter circuit to a count value representing a time difference between said alarm time and current time of zero, whereby upon subsequent return from said current time setting mode to said current time display mode the time indicated by said hands at the initiation of the latter changeover will be set as the alarm time, without generation of said time setting pulses being required to set said alarm time.

12. An analog electronic timepiece provided with an alarm function, comprising:

an analog display mechanism comprising time indicating hands;

an electro-mechanical transducer coupled to said analog display mechanism for rotating said hands;

transducer drive circuit means for generating drive signals to actuate said motor to rotate said hands;

a source of a timekeeping signal comprising a pulse train of fixed period and a plurality of timing signals each comprising a pulse train of shorter period than said timekeeping signal;

timekeeping function circuit means comprising at least one main counter circuit for storing a quantity representing the time difference between the current time and a preset alarm time, a secondary counter circuit for counting the number of drive pulses of said electro-mechanical on a count value of said main counter circuit during a changeover between a current time display mode and an alarm time display mode, and means for generating an alarm indication signal when said quantity becomes zero;

alarm signal generating means for producing an audible alarm signal in response to said alarm indication signal;

externally operable control signal generating means for generating signals to designate changeover between the current time display mode and the alarm time display mode, signals to designate changeover between said current time display mode and a current time setting mode, signals to designate changeover between said alarm time display mode and an alarm time setting mode, and further for generating time setting signal pulses; and changeover control circuit means for acting during said current time display mode to transfer said timekeeping signal pulses to an input of said transducer drive circuit means for thereby generating drive pulses to periodically activate said electro-mechanical transducer to advance said time indicating hands and further acting during said current time display mode and said alarm time display mode to transfer said timekeeping signal pulses to be counted by said main counter circuit such that said quantity representing an alarm time difference is periodically decremented, and moreover for acting in response to said signals designating changeover between said current time and alarm time display modes for applying a first one of said timing signal pulse trains to said timekeeping function circuit for processing the contents of said main counter circuit and secondary counter circuit and for transferring to said transducer drive circuit means during said processing a number of said first timing signal pulses corresponding to said alarm time difference, to thereby generate drive pulses for driving said electro-mechanical transducer to rapidly advance said hands into positions corresponding to the display mode designated by said mode changeover designating signals, said changeover control circuit means further acting during said current time setting mode to transfer said time setting signal pulses to said transducer drive circuit for thereby generating drive signals to set a desired indication of current time by said hands, and acting during said alarm time setting mode to transfer said time setting signal pulses to said transducer drive circuit for thereby generating drive signals to set a desired indication of alarm time by said hands while simultaneously transferring said time setting signal pulses to be counted by said main counter circuit for thereby setting said quantity held in said main counter circuit to correspond with said indicated alarm time;

in which upon changeover from said current time display mode to said current time setting mode, said control signal generating means automatically generate an "all reset" signal, said "all reset" signal acting to set said main counter circuit to a count value representing a difference between the alarm time and current time of zero, whereby upon subsequent return from said current time setting mode to said current time display mode the time indicated by said hands at the initiation of the latter changeover will be set as the alarm time, without generation of said time setting pulses being required to set said alarm time.

13. An analog electronic timepiece provided with an alarm function, comprising:

an analog display mechanism comprising time indicating hands;

an electro-mechanical transducer coupled to said analog display mechanism for rotating said hands;

transducer drive circuit means for generating drive signals to actuate said motor to rotate said hands;

a source of a timekeeping signal comprising a pulse train of fixed period and a plurality of timing signals each comprising a pulse train of shorter period than said timekeeping signal;

timekeeping function circuit means comprising at least one main counter circuit for storing a quantity representing the time difference between the current time and a preset alarm time, a secondary counter circuit for counting the number of drive pulses of said electro-mechanical transducer by counting a quantity dependent on a count value of said main counter circuit during a changeover between a current time display mode and an alarm time display mode, and means for generating an alarm indication signal when said quantity becomes zero;

alarm signal generating means for producing an audible alarm signal in response to said alarm indication signal;

externally operable control signal generating means for generating signals to designate changeover between the current time display mode and the alarm time display mode, signals to designate changeover between said current time display mode and a current time setting mode, signals to designate changeover between said alarm time display mode and an alarm time setting mode, and further for generating time setting signal pulses; and changeover control circuit means for acting during said current time display mode to transfer said timekeeping signal pulses to an input of said transducer drive circuit means for thereby generating drive pulses to periodically activate said electro-mechanical transducer to advance said time indicating hands and further acting during said current time display mode and said alarm time display mode to transfer said timekeeping signal pulses to be counted by said main counter circuit such that said quantity representing an alarm time difference is periodically decremented, and moreover for acting in response to said signals designating changeover between said current time and alarm time display modes for applying a first one of said timing signal pulse trains to said timekeeping function circuit for processing the contents of said main counter circuit and secondary counter circuit and for transferring to said transducer drive circuit means during said processing a number of said first timing signal pulses corresponding to said alarm time difference, to thereby generate drive pulses for driving said electro-mechanical transducer to rapidly advance said hands into positions corresponding to the display mode designated by said mode changeover designating signals, said changeover control circuit means further acting during said current time setting mode to transfer said time setting signal pulses to said transducer drive circuit for thereby generating drive signals to set a desired indication of current time by said hands, and acting during said alarm time setting mode to transfer said time setting signal pulses to said transducer drive circuit for thereby generating drive signals to set a desired indication of alarm time by said hands while simultaneously transferring said time setting signal pulses to be counted by said main counter circuit for thereby setting said quantity held in said main counter circuit to correspond with said indicated alarm time;

in which said electro-mechanical transducer is a stepping motor controllable for bidirectional rotation, and further comprising a wheel train for coupling said hands to be rotated by said stepping motor, and moreover comprising backlash compensation means operating to eliminate positional inaccuracies of said hands occurring as a result of backlash effects within said wheel train due to counterclockwise rotation of said hands;

in which said backlash compensation means comprise a backlash compensation circuit for detecting cessation of signals applied to said transducer drive circuit means designating reverse rotation of said stepping motor to produce counterclockwise rotation of said hands, said backlash compensation circuit being responsive to detection of cessation of said counterclockwise rotation designing signals for applying signals to said transducer drive circuit means designating rotation of said hands in the counterclockwise direction by an integral number of steps followed by signals designating rotation of said hands in the clockwise direction by an identical number of steps.

14. An analog electronic timepiece according to claim 13, in which said backlash compensation circuit comprises a timer circuit coupled to be reset by successive pulses of said signals designating counterclockwise rotation and adapted to generate a signal indicating cessation of said counterclockwise rotation designating signals if the period between successive ones of said pulses exceeds a predetermined maximum value.

15. An analog electronic timepiece provided with an alarm function, comprising:

an analog display mechanism comprising time indicating hands;

an electro-mechanical transducer coupled to said analog display mechanism for rotating said hands;

transducer drive circuit means for generating drive signals to actuate said motor to rotate said hands;

a source of a timekeeping signal comprising a pulse train of fixed period and a plurality of timing signals each comprising a pulse train of shorter period than said timekeeping signal;

timekeeping function circuit means comprising at least one main counter circuit for storing a quantity representing the time difference between the current time and a preset alarm time, a secondary counter circuit for counting the number of drive pulses of said electro-mechanical transducer by counting a quantity dependent on a count value of said main counter circuit during a changeover between a current time display mode and an alarm time display mode, and means for generating an alarm indication signal when said quantity becomes zero;

alarm signal generating means for producing an audible alarm signal in response to said alarm indication signal;

externally operable control signal generating means for generating signals to designate changeover between the current time display mode and the alarm time display mode, signals to designate changeover between said current time display mode and a current time setting mode, signals to designate changeover between said alarm time display mode and an alarm time setting mode, and further for generating time setting signal pulses; and changeover control circuit means for acting during said current time display mode to transfer said timekeeping signal pulses to an input of said transducer drive circuit means for thereby generating drive pulses to periodically activate said electro-mechanical transducer to advance said time indicating hands and further acting during said current time display mode and said alarm time display mode to transfer said timekeeping signal pulses to be counted by said main counter circuit such that said quantity representing an alarm time difference is periodically decremented, and moreover for acting in response to said signals designating changeover between said current time and alarm time display modes for applying a first one of said timing signal pulse trains to said timekeeping function circuit for processing the contents of said main counter circuit and secondary counter circuit and for transferring to said transducer drive circuit means during said processing a number of said first timing signal pulses corresponding to said alarm time difference, to thereby generate drive pulses for driving said electro-mechanical transducer to rapidly advance said hands into positions corresponding to the display mode designated by said mode changeover designating signals, said changeover control circuit means further acting during said current time setting mode to transfer said time setting signal pulses to said transducer drive circuit for thereby generating drive signals to set a desired indication of current time by said hands, and acting during said alarm time setting mode to transfer said time setting signal pulses to said transducer drive circuit for thereby generating drive signals to set a desired indication of alarm time by said hands while simultaneously transferring said time setting signal pulses to be counted by said main counter circuit for thereby setting said quantity held in said main counter circuit to correspond with said indicated alarm time;

in which said control signal generating means are actuatable to generate signals selectively designating changeover between a plurality of display modes and in which said timekeeping function circuit comprises a plurality of main counter circuits each storing data corresponding to one of said display modes, and in which said changeover control circuit means is responsive to signals designating changeover from one of said display modes to another for applying said first timing signal pulses to said timekeeping function circuit for processing the contents of said secondary counter and the main counter circuit corresponding to the designated display mode while transferring to said transducer drive circuit means a number of said first timing signal pulses corresponding to said information stored in the latter main counter circuit, said changeover control circuit means acting to reset said secondary counter circuit to a predetermined count value upon completion of said processing, whereby said secondary counter circuit is utilized in common for all changeover operations between said plurality of display modes.

16. An analog electronic timepiece according to claim 15, in which one of said main counter circuits stores information representing the time difference between a preset alarm time and the current time and another of said main counter circuits stores information representing the difference between the current time and zero seconds positions of a seconds hand.

* * * * *